US009707438B2

(12) United States Patent
Vorozilchak et al.

(10) Patent No.: US 9,707,438 B2
(45) Date of Patent: Jul. 18, 2017

(54) ADJUSTABLE ANGLE WEIGHT LIFTING BENCH

(71) Applicant: Maxx Bench, Wilkes Barre, PA (US)

(72) Inventors: David Vorozilchak, Shavertown, PA (US); James J. Lennox, Shickshinny, PA (US); Kenneth Brown, Hamburg, NY (US)

(73) Assignee: MAXX BENCH

( * ) Notice: Subject to any disclaimer, the term of this patent is extended or adjusted under 35 U.S.C. 154(b) by 0 days.

(21) Appl. No.: 15/236,006

(22) Filed: Aug. 12, 2016

(65) Prior Publication Data

US 2017/0001064 A1 Jan. 5, 2017

Related U.S. Application Data

(63) Continuation-in-part of application No. 15/200,517, filed on Jul. 1, 2016.

(Continued)

(51) Int. Cl.

| | |
|---|---|
| ***A63B 21/078*** | (2006.01) |
| ***A63B 21/00*** | (2006.01) |
| ***A63B 21/072*** | (2006.01) |

(52) U.S. Cl.

CPC .... *A63B 21/4047* (2015.10); *A63B 21/00047* (2013.01); *A63B 21/0724* (2013.01); *A63B 21/0783* (2015.10); *A63B 21/4029* (2015.10)

(58) Field of Classification Search

CPC ..... A63B 21/4047; A63B 21/4029; A63B 21/00047; A63B 21/0783; A63B 21/0724;

(Continued)

(56) References Cited

U.S. PATENT DOCUMENTS

| | | | |
|---|---|---|---|
| 3,905,496 | A | 9/1975 | Reeder |
| 4,995,130 | A | 2/1991 | Hahn et al. |

(Continued)

FOREIGN PATENT DOCUMENTS

| | | |
|---|---|---|
| EP | 0214328 | 3/1987 |

OTHER PUBLICATIONS

Corresponding International Search Report and Written Opinion for PCT/US2016/046806 dated Oct. 24, 2016.

*Primary Examiner* — Loan H Thanh
*Assistant Examiner* — Megan Anderson
(74) *Attorney, Agent, or Firm* — The Belles Group, P.C.

(57) ABSTRACT

An adjustable weight lifting bench includes a frame, a seat pad, and a back pad. The back pad is pivotably coupled to the frame about a first pivot axis and angularly adjustable between a plurality of user-selectable incline and decline positions. A hydraulic mechanism supports the back pad in the incline and decline positions. A movable operating lever operably coupled to the hydraulic mechanism operates to change the mechanism between an activated condition in which the back pad is movable and a deactivated condition in which the back pad locks into a selected one of the positions. When the mechanism is in activated condition, applying pressure against the back pad the lowers the back pad and removing the pressure raises the back pad. In one embodiment, the mechanism automatically raises the back pad when the pressure is removed and the mechanism is in the deactivated condition.

18 Claims, 49 Drawing Sheets

Related U.S. Application Data

(60) Provisional application No. 62/187,364, filed on Jul. 1, 2015, provisional application No. 62/195,106, filed on Jul. 21, 2015, provisional application No. 62/254,755, filed on Nov. 13, 2015, provisional application No. 62/203,961, filed on Aug. 12, 2015, provisional application No. 62/240,623, filed on Oct. 13, 2015.

(58) Field of Classification Search
CPC ..... A63B 21/4033; A63B 21/4035; Y10T 403/32557; Y10T 403/32581
See application file for complete search history.

(56) References Cited

U.S. PATENT DOCUMENTS

| | | | | |
|---|---|---|---|---|
| 5,125,884 | A | 6/1992 | Weber et al. | |
| 5,141,480 | A | 8/1992 | Lennox et al. | |
| 5,281,193 | A | 1/1994 | Colbo, Jr. | |
| 6,605,023 | B1 | 8/2003 | Mobley | |
| 6,689,027 | B1 | 2/2004 | Gardikis, Jr. | |
| 6,746,379 | B1 | 6/2004 | Brawner | |
| 6,926,648 | B2 * | 8/2005 | Capizzo | A63B 21/4029 482/104 |
| 7,331,912 | B2 * | 2/2008 | Keiser | A63B 21/4029 482/142 |
| 8,066,622 | B2 | 11/2011 | Kim | |
| 8,834,329 | B2 * | 9/2014 | Kelly | A63B 21/0724 482/104 |
| 2003/0114277 | A1 | 6/2003 | Capizzo | |
| 2005/0032614 | A1 | 2/2005 | Keiser et al. | |
| 2008/0004165 | A1 | 1/2008 | Brawner | |
| 2009/0143203 | A1 | 6/2009 | Knapp | |
| 2009/0203505 | A1 | 8/2009 | Kroll et al. | |
| 2011/0082016 | A1 | 4/2011 | Kim | |
| 2011/0172066 | A1 | 7/2011 | Roppolo | |
| 2014/0187391 | A1 | 7/2014 | Kelly | |

* cited by examiner

ADJUSTABLE ANGLE WEIGHT LIFTING BENCH

CROSS-REFERENCE TO RELATED APPLICATIONS

The present application is a continuation-in-part of U.S. patent application Ser. No. 15/200,517 filed Jul. 1, 2016, which claims priority to U.S. Provisional Application No. 62/187,364 filed Jul. 1, 2015, and 62/195,106 filed Jul. 21, 2015, and 62/254,755 filed Nov. 13, 2015. The present application further claims the benefit of priority to U.S. Provisional Application No. 62/203,961 filed Aug. 12, 2015 and U.S. Provisional Application No. 62/240,623 filed Oct. 13, 2015. The entireties of all of the foregoing listed applications are hereby incorporated herein by reference.

BACKGROUND

The present invention relates to exercise equipment, and more particularly to improvements for a self-spotting and hands free adjustable weight bench that allows weight lifters to adjust their positioning while remaining on the weight training equipment, and also remove themselves from heavy weights and a high risk of injury if fatigue prevents continuation of the exercise.

Weight training is performed to develop the strength and size of skeletal muscles. Weight lifters use the gravity force of weight, in the form of barbells and dumbbells, to oppose the force generated by muscle through concentric or eccentric contraction. Weight training uses a variety of specialized equipment for users to target specific muscle groups with different types of movement. While weight lifting, it is common to push oneself to a limit of fatigue that prevents returning the barbell to the rack. At this point in a workout, the weight lifter is at a serious risk for injury. However, even though weight lifters take this into account, it is common for weightlifters to workout alone and without a "spotter" or assistance of a work out companion.

In addition to safety concerns with traditional equipment, adjustability is cumbersome and problematic. It is beneficial for weight training equipment to offer adjustability to accommodate different size users and training with different heights, angles, and strengths. When muscles are forced to contract at different angles, additional muscle fibers are incorporated into the workout, which increases the potential for muscular growth. For a large muscle group, such as the chest, the muscles must be trained from different angles to involve fibers from all parts of the muscle. This type of training builds stronger, fuller muscles. With traditional equipment, weightlifters must put the weight down, get off the equipment, adjust the equipment manually, get back on the equipment, pick the weight back up, and start the exercise again from a different position. The time wasted adjusting the equipment is not only cumbersome, but makes the workout inefficient.

It is further desirable to provide a safe device which is mechanically simple, easy to operate, non-compromising to traditional weight training exercises, and extremely functional for weight training.

A safe and convenient adjustable weight lifting bench is desirable.

SUMMARY

An adjustable weight lifting bench according to the present disclosure is provided which incorporates various features for safe and convenient operation in addition to a flexible user-changeable configuration adapted for performing a variety of weight-lifting or exercise routines. The bench is configured and operable to allow "hands free" adjustment of the bench position for performing different types of exercises and/or working different parts of muscles without the user getting of the bench. In one embodiment, the back pad of the bench is adjustable between an uppermost incline position, a lowermost decline position, and a continuum of intermediate positions therebetween. In combination with one embodiment of a power rack described herein, the adjustable utility bench and power rack combination may be used for self-spotting scenarios.

The adjustable utility bench in one implementation allows weight lifters to adjust the angle of the back pad while remaining seated on the weight training equipment while exercising, and to lower themselves out from under heavy weight when fatigue failure is reached by the user during exercise. In one embodiment, the angle of the back pad could be adjusted from at or near 90 degrees to the bench frame to negative angles up to −90 degrees measured relative to the pivot axis of the back pad. With the wide variety of adjustability, weight lifters have the ability to perform a full range of exercises from sitting in the straight up position, to sitting at inclined positions, to lying flat, to lying in the decline position. Because the back pad and seat pad in some embodiments are adjustable with respect to the bench frame and its supports which remain, the design is advantageously mechanically simplified resulting in manufacturing savings and improved reliability.

In conjunction with a weight lifting power rack such as the one disclosed herein, the "hands free" adjustable angle utility bench allows weight lifters to remove themselves from heavy weights and a high risk of injury if fatigue prevents continuation of the exercise. By increasing the angle of the bench towards the ground towards a lowermost decline escape position, the user can lower the bench to a point at which the barbell hits the safety rack on the rack and the weight is removed safely from the user's hands and torso.

The adjustable utility bench design provides a new method for performing a variety of exercises back to back, or as a "superset." With the user's ability to change the angle of the back rest or pad, a range of exercises could be performed to work different muscle groups back to back as supersets without the user ever getting off the equipment. Through this embodiment, the user can change the back angle with an operating lever such as a foot pedal, never having to get off the bench to change angle with mechanical pins.

In one implementation, the foot pedal may be double sided or ambidextrous operable with either foot of the user. The double sided foot pedal serves an additional function. When the bench back pad is in the flat or decline position, it could be difficult to get up from the position. The double sided foot pedal could alternately be used by the user to sit-up by locking the feet beneath each side of the foot pedal. As a user positions his/her feet on the underside of the foot pedal, the user can then press his/her legs against the foot pedal to provide force in the opposite direction while sitting up. Alternatively, it is further desirable to perform sit-ups from a flat or decline position for maximum exercise effectiveness in working the stomach muscles. When the angle of the back pad is adjusted to the flat or decline position, users can lock their feet under the foot pedal and perform sit-ups on the adjustable bench.

According to one aspect, an adjustable weight lifting bench includes: a bench frame configured for resting on a surface, the frame defining a horizontal longitudinal axis parallel to the surface and a vertical axis; a seat pad coupled to the frame; a back pad pivotably coupled to the frame about a first pivot axis defined at an orthogonal intersection between the longitudinal axis and the vertical axis, the back pad angularly adjustable relative to the frame between a plurality of user-selectable incline and decline positions; a hydraulic cylinder mechanism operably coupled between the frame and back pad that supports the back pad in the incline and decline positions, the hydraulic cylinder mechanism changeable between an activated condition in which the back pad is movable between the incline and decline positions, and a deactivated condition in which the back pad is locked into a selected one of the incline and decline positions; and an operating lever operably coupled to the hydraulic cylinder mechanism, the operating lever movable to change position of the hydraulic cylinder mechanism between the activated and deactivated conditions.

According to another aspect, a hands free adjustable weight lifting bench includes: a bench frame comprising a longitudinal axis, a bottom configured for resting on a surface, and a top spaced above the bottom; a seat pad coupled to the frame; a back pad pivotably coupled to the frame about a first pivot axis, the back pad angularly movable between an uppermost position, a lowermost position, and a continuum of intermediate positions therebetween; a hydraulic cylinder assembly operable to support and move the back pad; the hydraulic cylinder assembly including a hydraulic cylinder comprising an extendable-retractable cylinder rod pivotably coupled to the back pad and containing a hydraulic fluid, an accumulator pivotably coupled to the frame and containing a compressible liquid, and a flow control valve fluidly connected between the hydraulic cylinder and the accumulator for exchange of hydraulic fluid therebetween; the valve having an open position allowing exchange of hydraulic fluid between the hydraulic cylinder and accumulator and concomitant retraction or extension of the cylinder rod, and a closed position blocking the exchange of hydraulic fluid and retraction or extension of the cylinder rod; a foot-operated lever operably coupled to the valve and movable to change the valve between the open and closed positions; wherein depressing the lever opens the valve and allows movement of the back pad to a selected one of the back pad positions by retracting or extending the cylinder rod, and releasing the lever closes the valve and prevents movement of the back pad.

A method for operating any of the foregoing adjustable weight lifting benches is provided. The method includes: providing the weight lifting bench; a user sitting on the seat pad; depressing the foot-operated lever a first time; applying pressure against the back pad; the back pad moving downward from the uppermost position to a first intermediate position; releasing the foot-operated lever which locks the back pad into the first intermediate position; depressing the foot-operator lever a second time; applying pressure against the back pad; the back pad moving downward from the uppermost position to a second intermediate position lower than the first intermediate position; releasing the foot-operated lever which locks the back pad into the second intermediate position; and depressing the foot-operated lever a third time; removing pressure from the back pad; the back pad automatically moving upward from the second intermediate position to the uppermost position.

According to another aspect, an adjustable weightlifting system includes: any of the foregoing adjustable weight lifting benches and a power rack. The power rack comprises: a base frame configured for resting on a surface; a first pair of upright stanchions extending upwards from a first lateral side of the base frame and longitudinally spaced apart; a second pair of upright stanchions extending upwards from a second lateral side of the base frame and longitudinally spaced apart, the first and second lateral sides being laterally spaced apart; and an elongated safety rack mounted between each of the first and second pairs of stanchions. The bench is positioned between the first and second pairs of stanchions, wherein each safety rack is positioned at a critical height above the back pad when the back pad is in a lowermost decline position, the safety racks when the back pad is in the lowermost decline escape position operable to remove a barbell from the user's torso for allowing the user to escape from the bench.

BRIEF DESCRIPTION OF THE DRAWINGS

The features of the exemplary embodiments will be described with reference to the following drawings where like elements are labeled similarly, and in which:

FIGS. 49A, 49B, 49C, and 49D are sequential side cross sectional views of the flow control valve assembly taken from FIG. 44 in various stages of operation, in which FIG. 49A shows a first position of the valve assembly, FIG. 49B shows a second position thereof; FIG. 49C shows a third position thereof; and FIG. 49D shows a fourth position thereof;

All drawings are schematic and not necessarily to scale. Parts given a reference numerical designation in one figure may be considered to be the same parts where they appear in other figures without a numerical designation for brevity unless specifically labeled with a different part number and/or described herein. Any reference to whole figure numbers (e.g. FIG. 1) which are comprised of multiple sub-parts (e.g. 1A, 1B, etc.) shall be construed as a reference to all sub-parts unless indicated otherwise.

DETAILED DESCRIPTION

Figure 1:
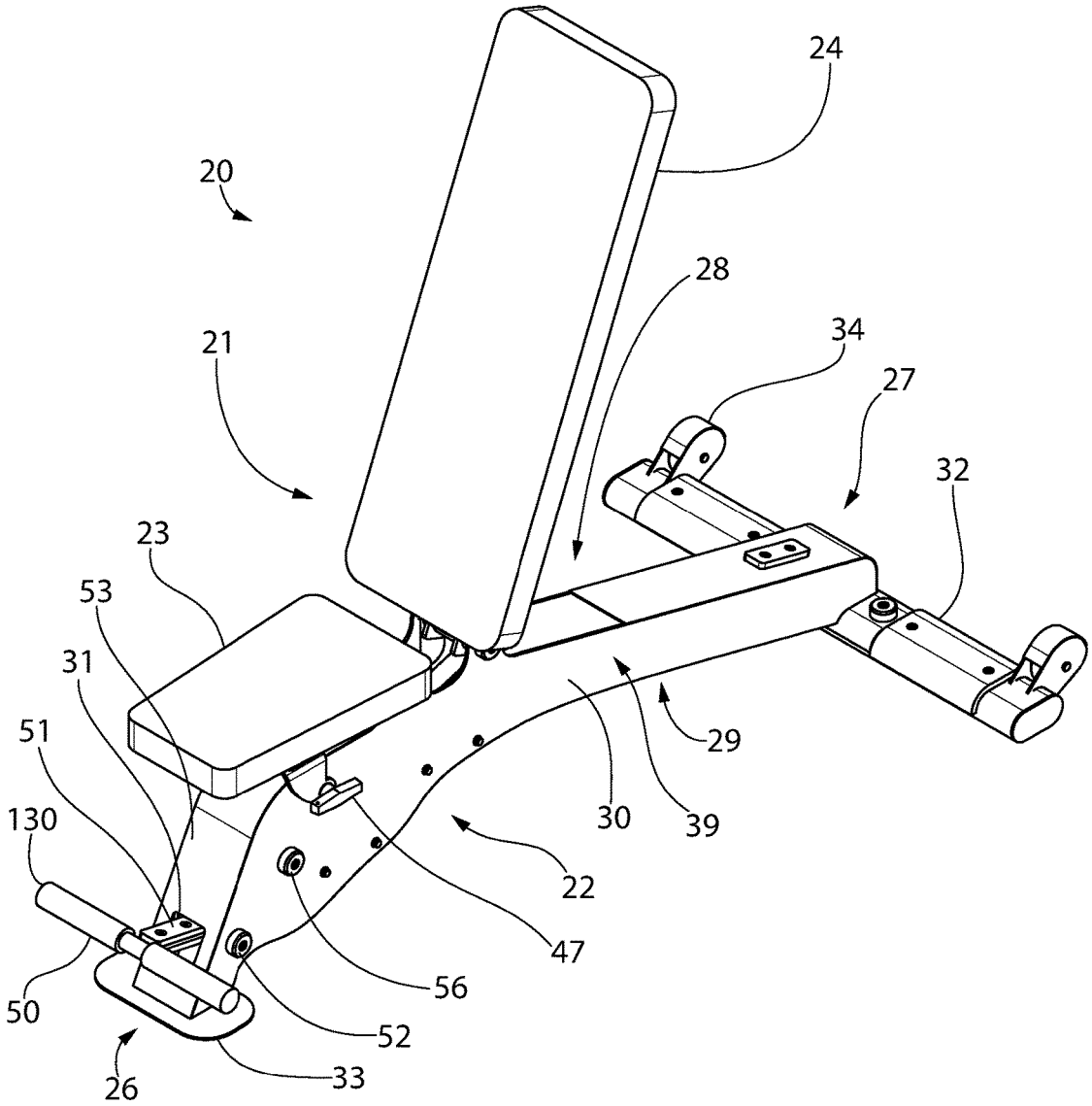
FIG. 1 is a front perspective view of an embodiment of a "hands free" weight lifting bench with automatic back pad return and descent control mechanisms according to the present disclosure.
Figure 2:
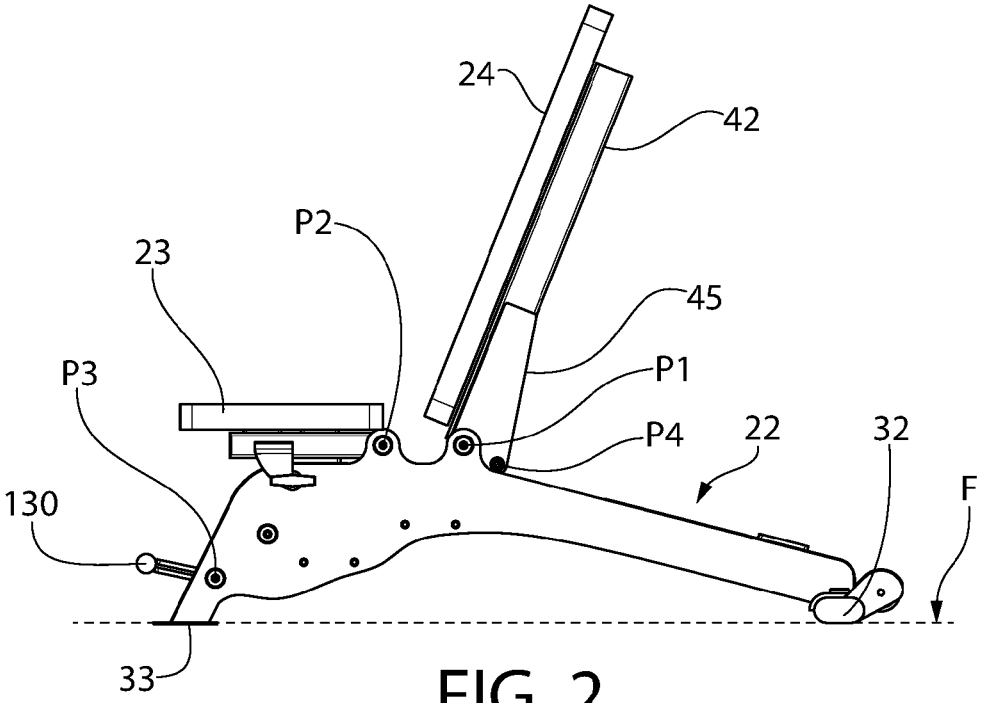
FIG. 2 is a left side view thereof.
Figure 3:
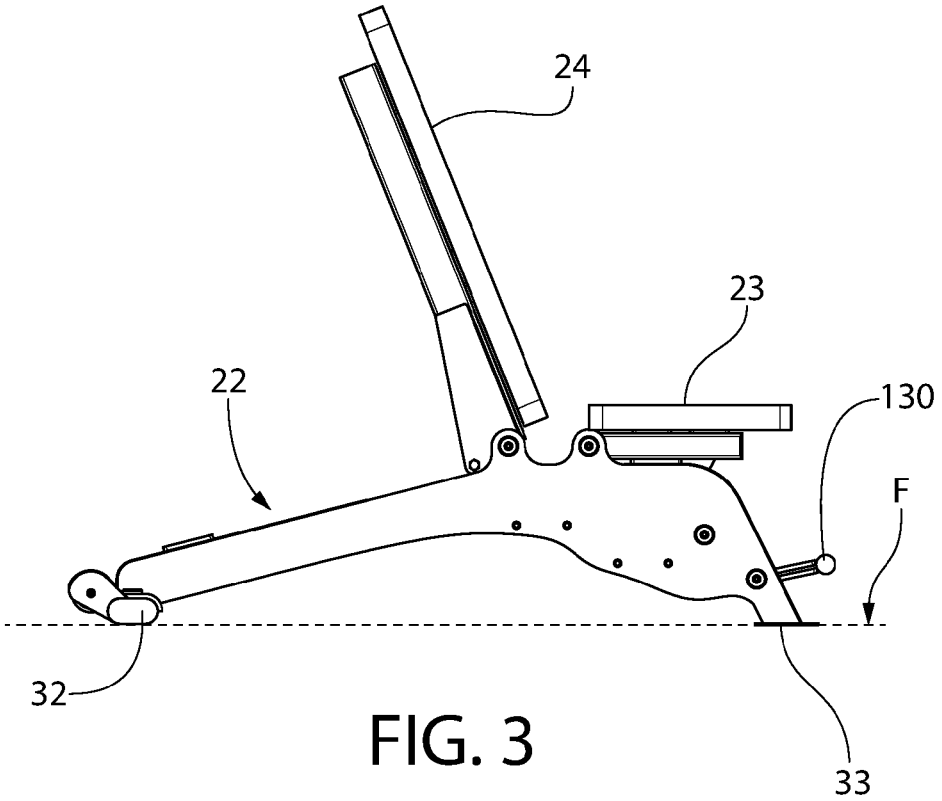
FIG. 3 is a right side view thereof.
Figure 5:
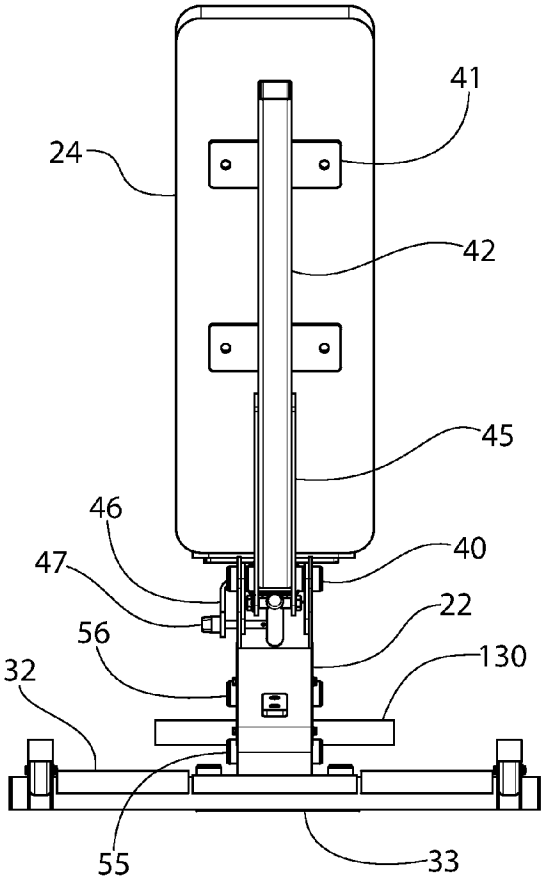
FIG. 5 is a rear view thereof.
Figure 4:
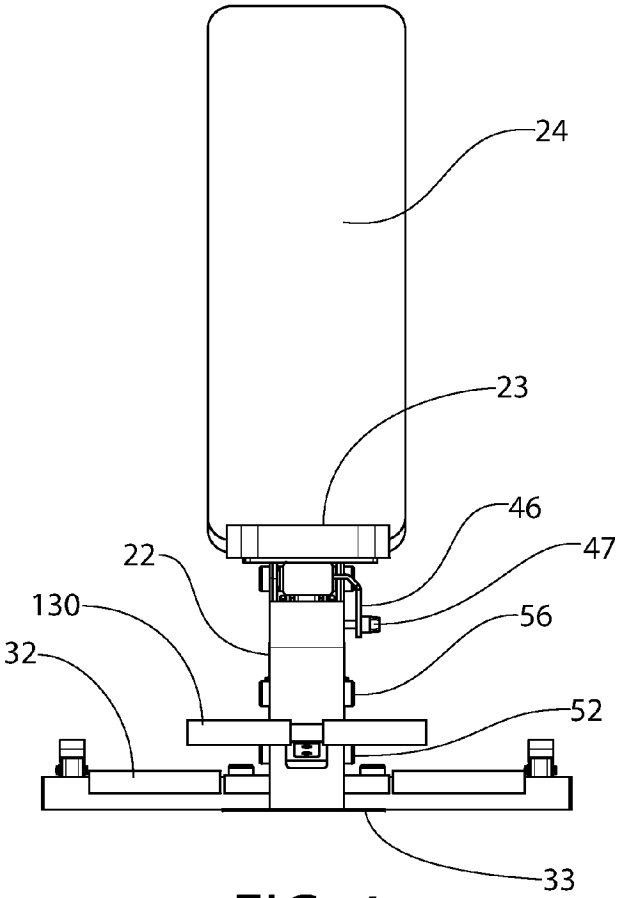
FIG. 4 is a front view thereof.
Figure 6:
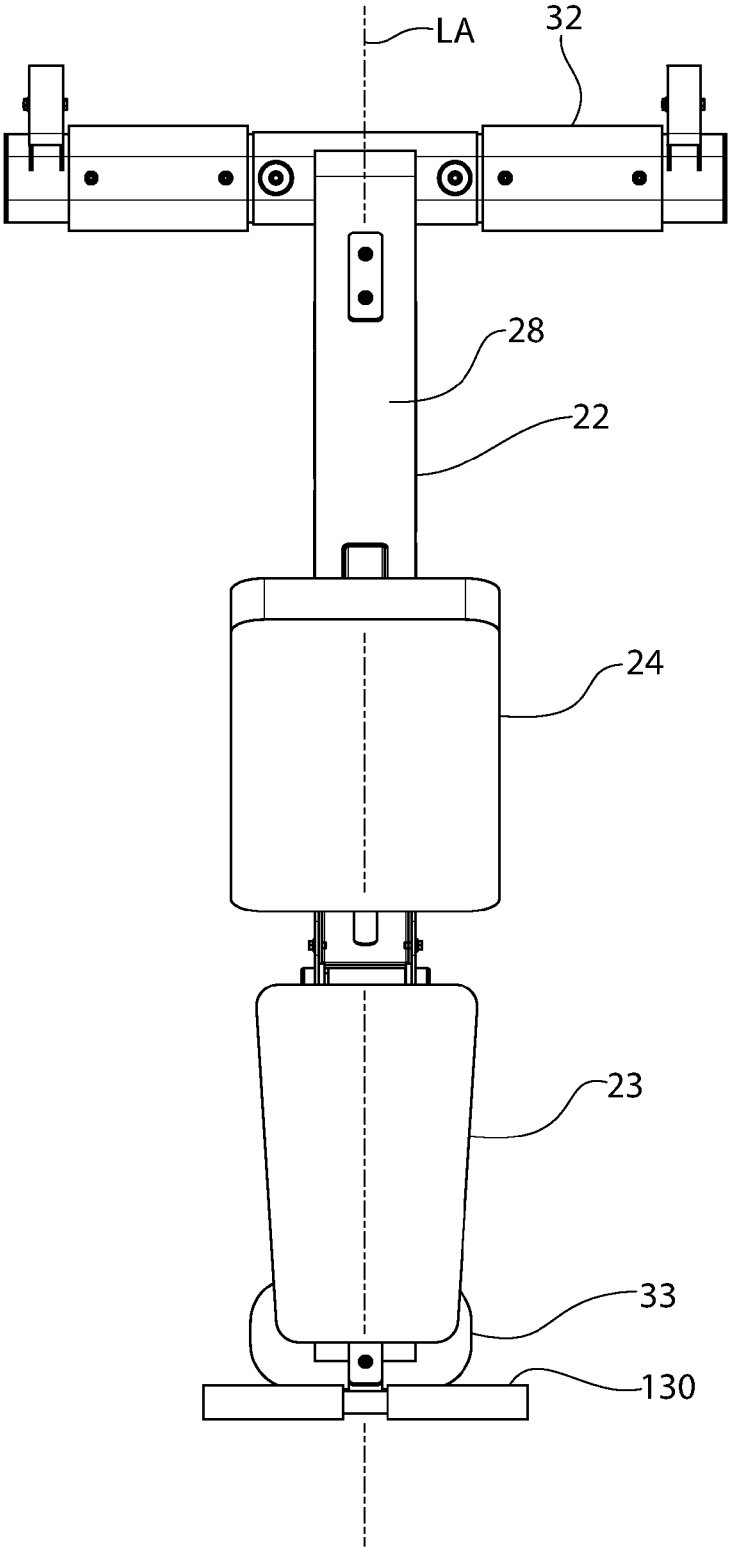
FIG. 6 is a top view thereof.
Figure 7:
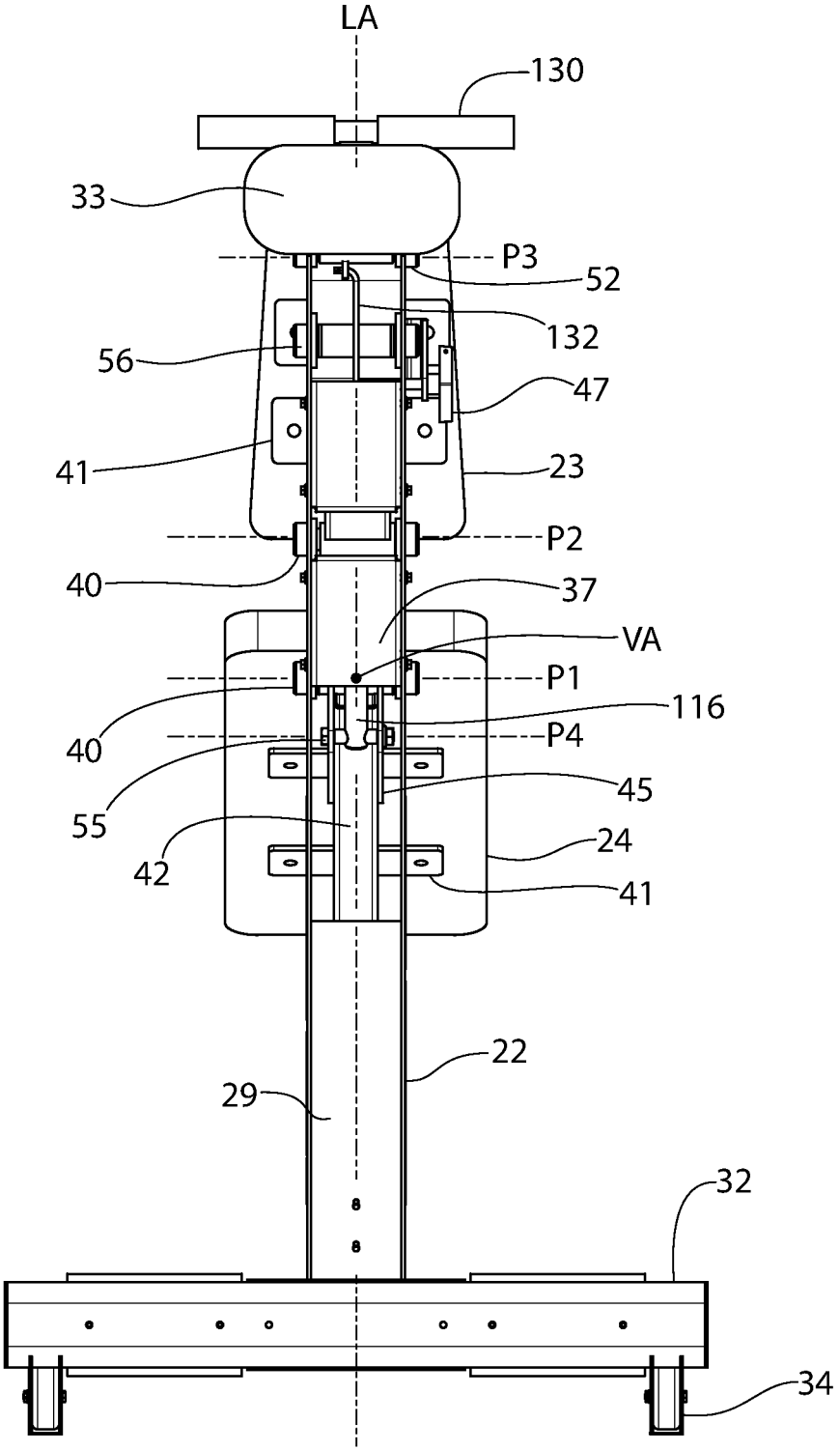
FIG. 7 is bottom view thereof.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

FIGS. 1-16 depict a non-limiting embodiment of an angularly adjustable exercise bench in the form of weight lifting bench 20 according to the present disclosure. Bench 20 incorporates features and operability of a flat, incline, and decline benches in a single machine. Advantageously, this provides a multitude of user-adjustable angles for the bench back pad in various configurations to work different portions or groups of muscles. In one preferred embodiment, the bench 20 and it hydraulic control system are configured to provide hands-free adjustment of the angular orientation of the back pad in relation to the bench frame.

Adjustable weight lifting bench 20 may be configured as a free standing "utility" bench which is useable on its own or with multiple different weight rack configurations for performing different types of weight lifting exercise routines. In other embodiments, as another example, the bench 20 may instead be incorporated into the frame of the weight rack Bench 20 generally includes a bench frame 22 and an elongated user bench pad 21 comprising a separate seat pad 23 and back pad 24 each supported independently by the frame, as further described herein. At least the back pad 24 is preferably angularly adjustable in orientation relative to the frame 22 and seat pad 23. The bench 20 further includes an hydraulic support mechanism such as hydraulic cylinder 100 described below which acts as an infinitely adjustable support that maintains the back pad 24 one of a plurality of user selectable angular positions (see, e.g. FIGS. 12-16).

Frame 22 is configured for placement on a horizontal surface such as a floor F. For convenience of reference, the frame 22 may be considered to define a horizontal longitudinal axis LA extending between the front and rear ends 26, 27 and a corresponding axial direction. Frame 22 also defines a vertical axis VA which intersects and is oriented orthogonally to the longitudinal axis. The longitudinal and vertical axes intersect at the pivot axis P1 of the back pad 24 of the bench 20 (formed by cross bolt 40 described below) which serves as a convenient reference location for explaining the angular motions of the back pad as further elaborated herein. A lateral or transverse direction is defined as being orthogonally transverse to the longitudinal axis for convenience of reference also.

The frame 22 includes a front end 26, rear end 27, opposing lateral sides 30, top 28, and bottom 29. In one embodiment, frame 22 has an at least partially enclosed configuration defining an internal cavity 36 which may extend for a majority of the axial length of the frame. Cavity 36 conceals and protects various appurtenances therein which may include portions of the operating lever mechanism and hydraulic support mechanism each further described herein. To provide structural stability, the frame may include one or more internal lateral supports 37 of any suitable configuration which are disposed in internal cavity 36. Supports 37 extend transversely and are fixedly attached to the frame between the lateral sides 30. The lateral supports may be fixedly attached the sides 30 by any suitable method used in the art, such as without limitation fasteners (see, e.g. FIGS. 8 and 9), welding, soldering, etc. Any suitable number of lateral supports 37 may be provided.

To facilitate placement on the floor and for stability when performing an exercise routine or adjusting the bench pad position, frame 22 may include a transversely/laterally extending front base member 33 affixed to front end 26 and a transversely/laterally extending rear base member 32 affixed to rear end 27. The front and rear base members 33, 32 may each have a lateral width (measured in the direction transverse to longitudinal axis LA) which is greater than the lateral width of the frame measured between the opposing lateral sides 30. Accordingly, the front and rear base members 33, 32 may each have right and left portions which extend laterally beyond the lateral sides 30 of the frame. In one embodiment, front base member 33 has a smaller width than rear base member 32 to avoid interfering with user access and the feet of the user when positioned on the bench. The base members 33, 32 may have any suitable configuration and dimension selected for bench stability and aesthetics. In one embodiment, the rear base member 32 may include a pair of wheels 34 to facilitate transport of the bench 20.

In one non-limiting embodiment, the frame 22 may only rest on the horizontal support surface or floor F at the front and rear ends 26, 27 via base members 33 and 32. The intermediate portion 39 of the frame 22 defined between the ends may therefore be spaced apart and does not contact the floor, as shown for example in the illustrated embodiment. In other implementations contemplated, the intermediate portion 39 may engage the floor at various portions. The shape of the intermediate portion 39 and engagement or non-engagement with the floor does not limit the invention.

Frame 22 may be made of any suitable metallic or non-metallic material, or a combination thereof having sufficient structural strength for supporting a user, weight held and lifted by the user (e.g. barbells), and bench pad 21. In one embodiment, the frame may be made of entirely of metal such as steel, aluminum, titanium, or other suitable metals. The material selected does not limit the invention.

In one embodiment, back pad 24 is pivotably coupled to frame 24 for movement into a plurality of user-adjustable and lockable angular positions. The pivot linkage mechanism may include a rear strut 42 pivotably connected at a lower end to frame 22 via transversely oriented cross bolt 40 which forms a pivot. Cross bolt 40 extends laterally through opposite sides of rear strut 42 and defines a pivot axis P1 of the back pad 24. Each end of the cross bolt 40 is received through mating laterally spaced apart mounting holes 43 in the lateral sides 30 of the frame 22. The lower end of the rear strut 42 may include enlarged laterally spaced apart angular gusset plates 45 attached to rear strut 42 to strengthen the back pad support and facilitate creation of the pivot connection. The cross bolt 40 extends through the gusset plates. To structurally reinforce the frame at the pivot mounting locations, reinforcing weldments 44 of a suitable shape may be welded to inside of the frame's lateral sides 30 which also have mounting holes that become concentrically aligned with the frame's mounting holes for receiving the cross bolt 40.

The upper portions of the rear strut 42 above the pivot axis P1 are fixedly attached to the underside of the back pad such as via spaced apart mounting tabs 41 using fasteners or another suitable fixed type mounting arrangement. The rear strut 42 has a sufficient length and width to sufficiently support for the back pad 24 which may be laterally wider than the rear strut as illustrated. It bears noting that the top 28 of the bench frame 22 may be sloped in a downwards direction to the rear of pivot axis P1 to allow the full decline position to be reached (see, e.g. FIG. 16). Portions of the frame 22 forward of pivot axis P1 may have any suitable shape including horizontal or flat as shown. Other shapes and configurations of the frame are possible.

In one embodiment, seat pad 23 may also be pivotably coupled to frame 24 using the same basic construction and features as the back pad 24 pivot connection described above. Seat pad 23 includes an axially elongated seat bracket 35 attached to the underside of the pad such as via mounting tabs 41 using threaded fasteners. Bracket 35 has a front and rear end. The rear end is pivotably mounted to the top 28 of the frame 22 by a second cross bolt 40 that defines a second pivot axis P2 for moving the seat pad into a plurality of user-adjustable angular positions upwards towards the back pad 24. Laterally spaced apart holes 43 in the frame and reinforcing weldments 44 if provided receive the cross bolt.

To adjust and lock the seat pad 23 into a multitude of angular positions with respect to the frame 22, an adjustment bracket 46 has a top end attached to the underside of seat pad 23 and an opposite bottom end positioned adjacent to one of the lateral sides 30 of the bench frame. The bottom end defines a locking hole 49 which may be concentrically aligned with a series of mating locking apertures 48 formed in the lateral side 30 (best shown in FIG. 8). After a selected angular position of the seat pad 23 is selected, a lock pin 47 is inserted through the locking hole 49 and aperture 48 to lock the seat pad in position. In one embodiment, the seat pad may be adjusted from a horizontal position (parallel to longitudinal axis LA) to a selected number of angular positions obliquely angled with respect to the top 28 of the frame 22. Although adjustment bracket 46 may have a generally L-shaped configuration as shown, other suitable configurations of the bracket may be used so long as at least the foregoing functionality is retained.

In the non-limiting illustrated embodiment, both the seat pad and back pad are angularly adjustable. In other possible embodiments, the seat pad 23 may be fixedly attached to the frame in a single angular position or orientation.

Bench 20 may utilize the hydraulic cylinder assembly 100 describe below having either of the valve configurations for a pressure compensating valve assembly 145 or user adjustable flow control plunger valve 150, both of which may incorporate the safety feature of a speed control mechanism to regulate the rate of descent of the back pad 24 in a controlled slow manner. The adjustable bench 20 may further incorporate the auto-return feature which automatically returns the back pad 24 to the uppermost position from any of the positions below the uppermost one simply when the user releases the foot lever or pedal 130.

Using any of the hydraulic control systems described below which provide a support mechanism for the back pad 24, the back pad is adjustable and lockable into a plurality of user-selected angular positions ranging from an uppermost incline position to a lowermost decline position, and a continuum of possible intermediate angular positions therebetween as illustrated in FIGS. 12-16. The lowermost decline position provides an escape position to combat user fatigue when the bench is used with a weight rack having safety bars, as further described herein.

Figure 12:
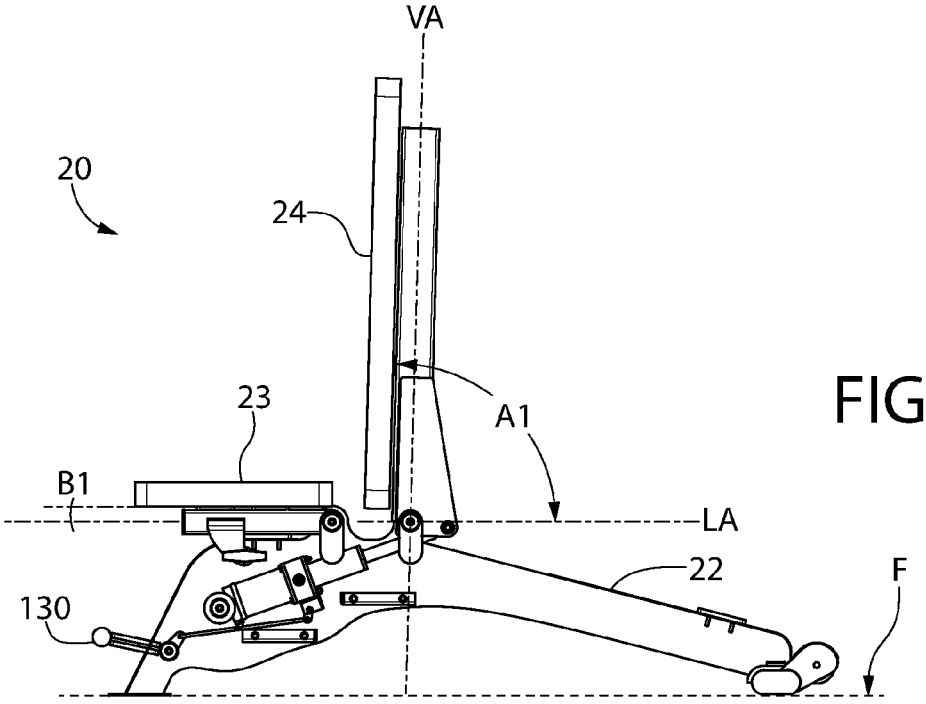
FIG. 12 is a left side view of the bench showing the back pad in an uppermost incline position.

FIG. 12 shows back pad 24 in the uppermost incline position. The back pad is position above the longitudinal axis LA. In one embodiment, the uppermost incline position may be substantially vertical as shown with the back pad being oriented parallel to vertical axis VA and perpendicular to the horizontal longitudinal axis LA at a first angle A1 of 90 degrees. The back pad is locked into position by its hydraulic support mechanism described below. Seat pad 23 is horizontal and disposed parallel to longitudinal axis LA at an angle B1 of 0 degrees.

As the terms are used herein, an incline positions describe the back pad positioned above the longitudinal axis LA and decline positions describe the back pad positioned below the longitudinal axis.

Figure 13:
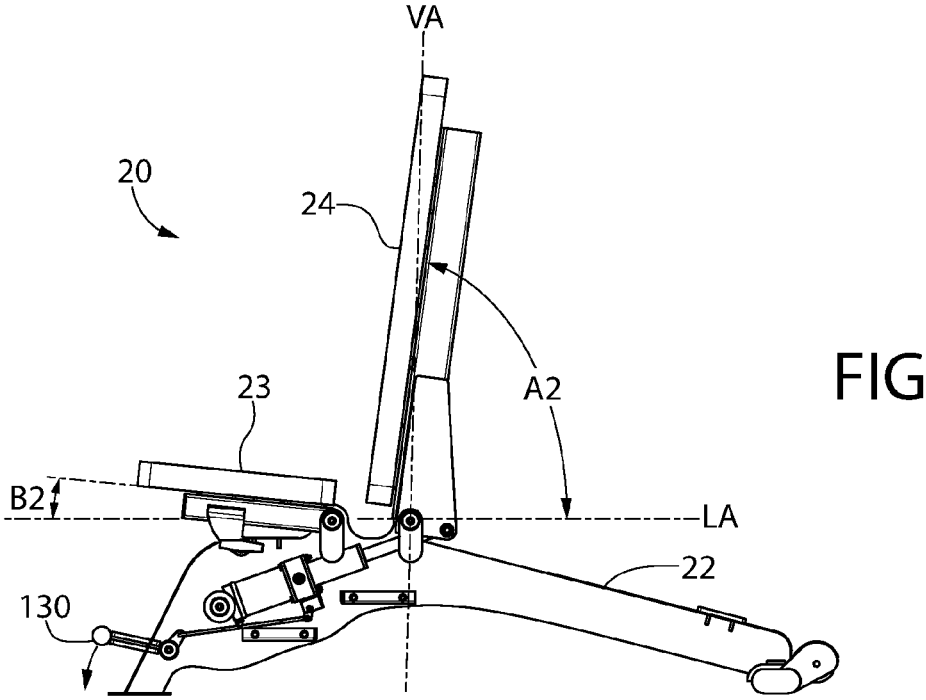
FIG. 13 is a left side view of the bench showing the back pad in a first incline position.

FIG. 13 shows back pad 24 in a possible second incline position relative to the frame 22 and floor F. The back pad 24 is lowered automatically via operation of the hydraulic support mechanism using foot pedal 130 thereby providing "hands free" operation. A second angle A2 is formed which is less than angle A1 shown in FIG. 12. Angle A2 is between 0 and 90 degrees. In this figure, the seat pad 23 is manually raised and angularly positioned at a second angle B2 relative to longitudinal axis LA.

Figure 14:
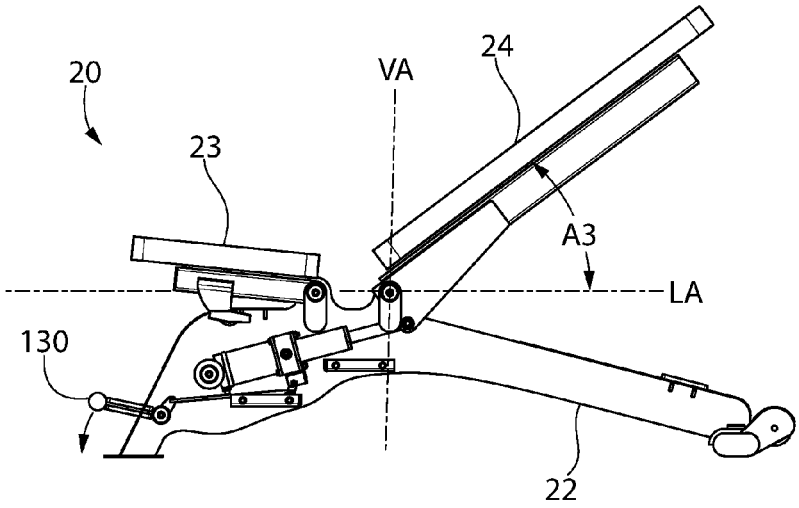
FIG. 14 is a left side view of the bench showing the back pad in a second incline position.

FIG. 14 shows back pad 24 in a possible third incline position relative to the frame 22 and floor F. A third angle A3 is formed which is less than angles A1 or A2. Angle A3 is between 0 and 90 degrees.

Figure 15:
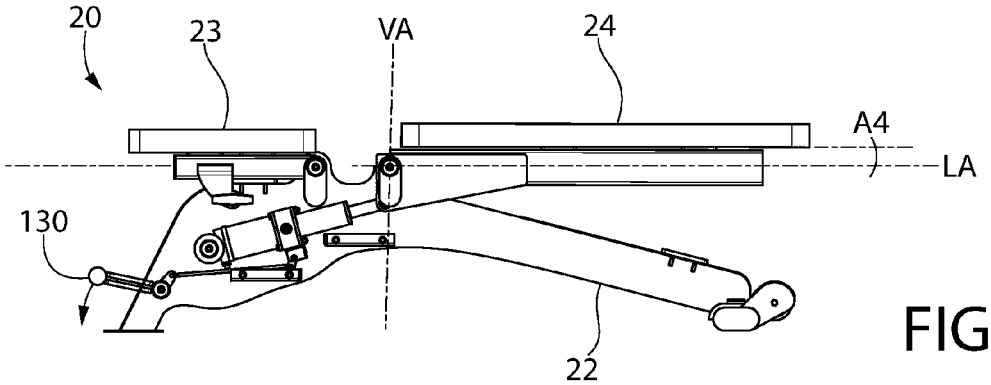
FIG. 15 is a left side view of the bench showing the back pad in a horizontal position.

FIG. 15 shows back pad 24 in a possible fourth horizontal position relative to the frame 22 and floor F. A fourth angle A4 is formed relative to longitudinal axis LA which is 0 degrees. The position allows the user to utilize the bench 20 as a conventional flat bench.

Figure 16:
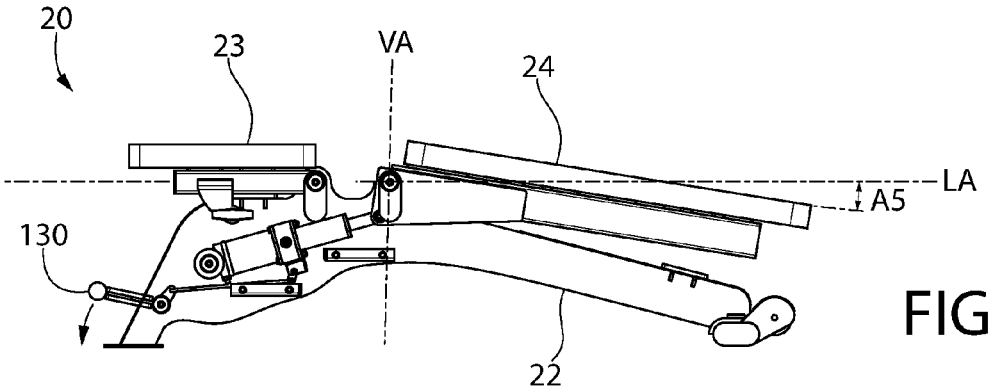
FIG. 16 is a left side view of the bench showing the back pad in a lowermost decline position.
Figure 17:
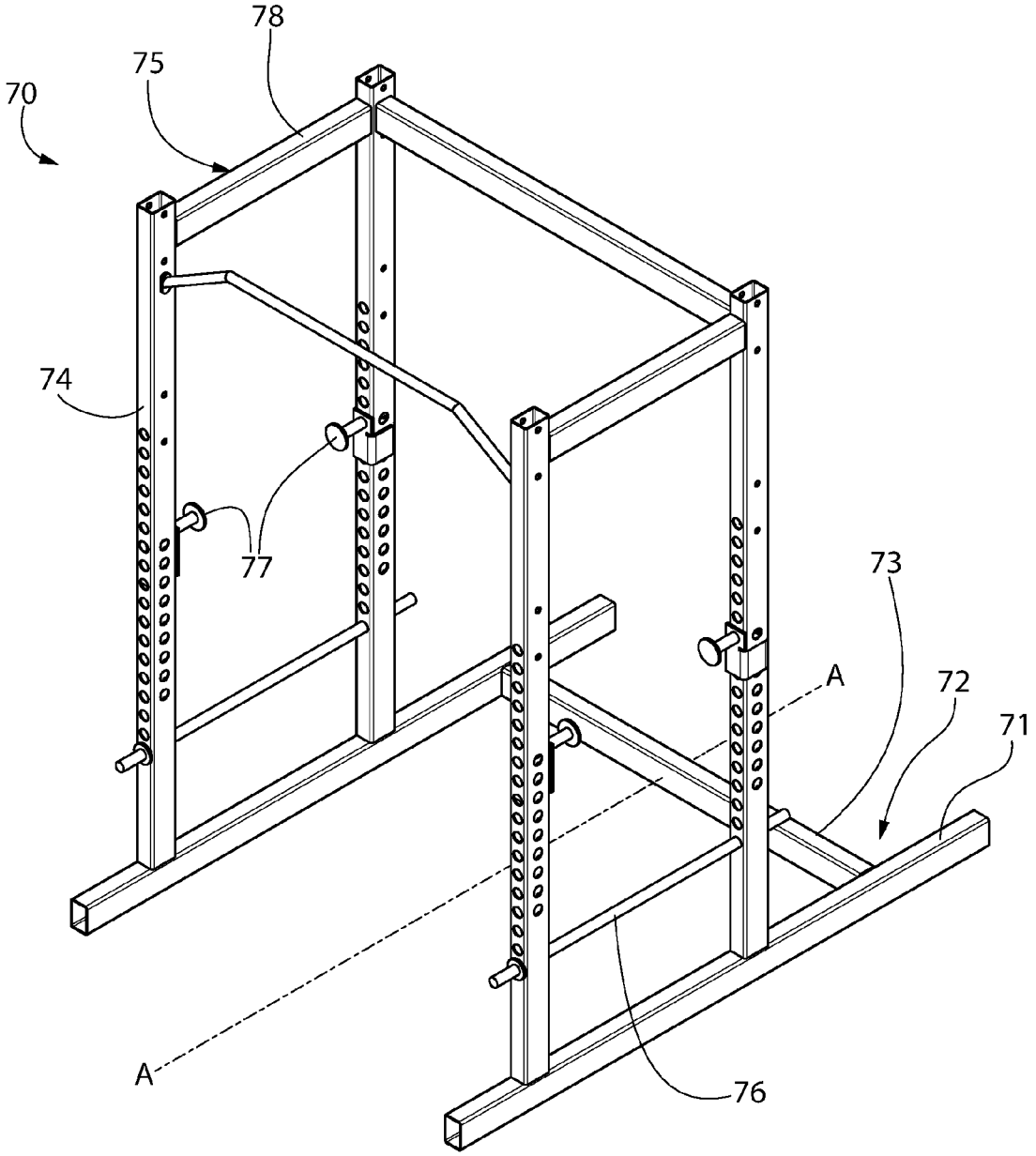
FIG. 17 is a perspective view of a power rack usable with the bench of FIG. 1.
Figure 18:
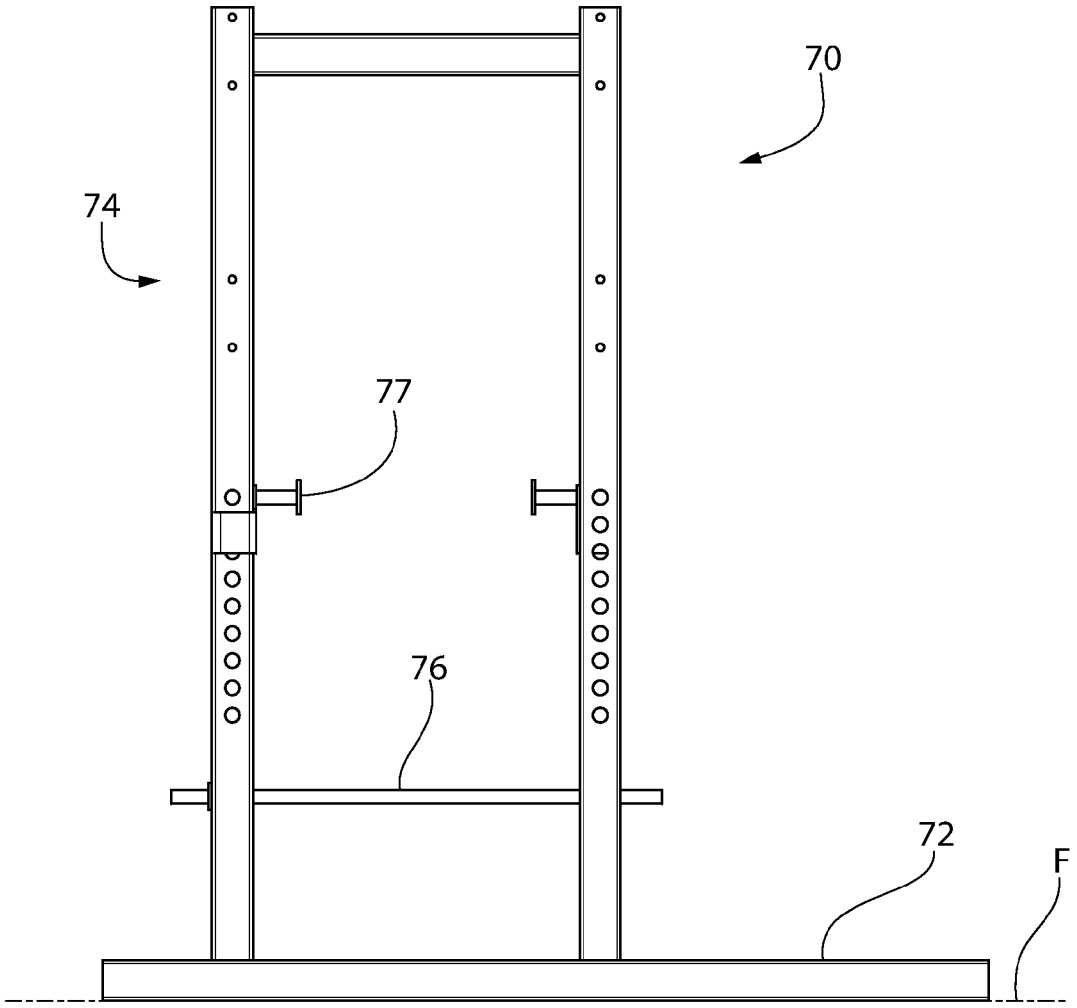
FIG. 18 is a left side view thereof.

FIG. 16 shows back pad 24 in a possible first decline position relative to the frame 22 and floor F. A fifth negative angle A5 is formed relative to longitudinal axis LA. Angle A5 may be between 0 and −90 degrees. In one embodiment, angle A5 may be between 0 and −45 degrees. The back pad position shown may be the lowermost decline position. In this position, when bench 20 is used in conjunction with a weight lifting rack such as power rack 80 described herein, this lowermost decline position may also represent an escape position which the user may use to safely exit the bench when too fatigued to return the barbell to the normal weight rests of the rack.

Hydraulic Control System

A hydraulic control system provides a support mechanism which controls the angular adjustment and motion of the back pad 24, and further operates to both support the back pad and maintain the user selected angular position of the back pad. The hydraulic support is operably coupled between the frame 22 and back pad 24 as shown in FIGS. 10-16. The system controls movement of the back pad 24 between the uppermost incline position and the lowermost decline position, and a plurality or continuum of infinitely adjustable intermediate positions therebetween which includes incline, horizontal, and decline positions. According to one aspect of the invention, the hydraulic support mechanism may be configured to control the back pad descent rate providing a speed control mechanism as further described herein. According to another aspect, the hydraulic support mechanism may also be configured to provide an auto-return mechanism for automatically returning the back pad 24 to its uppermost position as further described herein.

FIGS. 21-31 depict one embodiment of a hydraulic control system and arrangement in greater detail which may be used with bench 20. The system may include a hybrid hydraulic-pneumatic operator which includes a hydraulic cylinder assembly 100 generally comprising a single-acting hydraulic cylinder 102 and an accumulator 106 in fluid communication with the cylinder. In single-acting cylinder designs, the cylinder piston rod extends under hydraulic pressure and retracts under an externally applied force (e.g. gravity weight of equipment, user, etc.) acting against the rod.

The hydraulic cylinder 102 has an axial centerline CL1 and accumulator 106 has an axial centerline CL2. In the illustrated embodiment, the axial centerlines are coaxially aligned forming an end-to-end mounting relationship between the hydraulic cylinder and accumulator. The hydraulic cylinder 102 comprises an elongated tubular body or barrel 108 forming an internal bore 110 which holds hydraulic fluid 101 and an axially movable piston 112 comprising a piston head 114 and cylinder rod 116 having one end rigidly coupled thereto inside the bore. Piston head 114 is sealed at its peripheral edges to the bore 110 by a suitable annular seal 114*a* to keep oil from leaking past the head into the part of the cylinder bore behind the head (space on the left side of the head in FIG. 29). A transversely oriented aperture 120 is formed in an opposite end of the rod 116 which pivotably couples the rod to a transversely oriented cross pin 55 disposed on the lower end of rear strut 42. In one embodiment, cross bolt 55 may be located between and extend through the opposing gusset plates 45 attached to the rear strut 32 at a point below back pad 24 cross bolt 40 and offset from the vertical axial centerline of the rear strut 32 to provide leverage so that the cylinder rod 116 acts to pivot the extension 32*a* about bolt 55 for raising/lowering back pad and holding the pad in stationary position via the hydraulic system. Cross bolt 55 defines a pivot axis for cylinder rod 116 which is parallel to pivot axis P1 of the back pad 26. Pivot axis P4 of the cylinder rod 116 is spaced apart rearward from and below pivot axis P1 to create a lever arm which facilitates rotation of the back pad strut 42 about axis P1.

The accumulator end of the hydraulic cylinder assembly 100 is pivotably coupled to bench frame 22 via transversely oriented tubular sleeve 125. Sleeve 125 receives a transversely mounted cylindrical mounting rod 56 extending between lateral sides 30 of frame 22. Mounting rod 56 defines a pivot axis P5 of the hydraulic cylinder assembly. It bears noting that the hydraulic cylinder assembly 100 may be substantially disposed inside frame 22 within cavity 36 so as to conceal a majority of the assembly from view and protect the linkages associated with the cylinder assembly.

The accumulator 106 in one embodiment comprises an elongated body forming an internal chamber 104 for holding hydraulic fluid 101 and a compressible gas. The internal chamber 104 of the accumulator 106 is fluidly connected to the cylinder bore 110 by one or more flow conduits 118 configured to provide bidirectional exchange and flow of hydraulic fluid between the accumulator 106 and cylinder 102. In one non-limiting embodiment, the accumulator 106 may physically be directly coupled to the cylinder 102 to form a compact cylinder assembly 100. A unique flow control valve assembly 145 may be provided which internally incorporates the flow conduits 118 and is configured to control the flow and exchange of hydraulic fluid between the accumulator 106 and hydraulic cylinder 102 as shown in FIGS. 21-31. Advantageously, this eliminates the need for external tubing to form the flow conduits which may be exposed to damage during shipping or use of the bench.

In one embodiment, the valve assembly 145 may be designed directly as part of the hydraulic cylinder assembly. The valve assembly 145 may be interspersed directly between the accumulator 106 and hydraulic cylinder 102 to provide a compact hydraulic assembly. In this arrangement, one proximal end of hydraulic cylinder barrel 108 is coupled to one side of the valve assembly body and one proximal end of the accumulator 106 is coupled to the other side of the valve assembly body. The accumulator and barrel may be welded to the valve assembly 145 to provide a leak-proof seal in one embodiment; however, other mounting methods may be used such as without limitation bolting or other. The flow conduits 118 extend through the valve assembly 145 which fluidly connects the cylinder bore 110 to the accumulator chamber 104 as describe below.

Referring to FIGS. 27-31, valve assembly 145 includes a shut-off valve such as spring-biased plunger valve 122, check valve 147, and optionally a pressure compensating valve 146. In other embodiments, the shut-off valve may a different type such as a ball or other valve capable of interrupting the flow of hydraulic fluid. Accordingly, the invention is not limited to any particular type of shut-off valve. The pressure compensating valve 146 provides an automatic means for controlling the rate of descent of the back pad 24 when an escape scenario is initiated by a user. One flow conduit circuit 118*a* fluidly connects the plunger valve 122 and pressure compensating valve 146. Flow conduit circuit 118*a* fluidly communicates with and extends through the body of valve assembly 145 in order from: the hydraulic cylinder bore 110 to the plunger valve 122, to the pressure compensating valve 146, and finally to the accumulator chamber 104. This provides a first fluid or flow path for exchange of hydraulic fluid between the hydraulic cylinder 102 and accumulator 106. Plunger valve 122 and pressure compensating valve 146 may be removably disposed in suitably configured bores 148 formed in the body of the valve assembly 145 to facilitate installation and replacement if needed. In one embodiment, the bores 148 may open downwards through the body of the valve assembly 145 for insertion of the valves 122, 146 into their respective bores.

Check valve 147 is disposed in a separate flow conduit circuit 118*b* that extends through the body of the valve assembly 145 and which is fluidly isolated from flow conduit circuit 118*a*. Circuit 118*b* extends from in order hydraulic cylinder bore 110 through the check valve 147 and to the accumulator chamber 104. The check valve 147 is arranged to permit one-way flow from the accumulator 106 into to the hydraulic cylinder 102. Flow in the reverse direction is blocked by the check valve. In one embodiment, check valve 147 may be a ball check type comprising a spring 147*b* and biased ball 147*c* which is seated against a valve seat 147*a*. Valve seat 147*a* may be formed by or include an O-ring in some embodiments.

Plunger valve 122 comprises a spring-biased movable stem or plunger assembly including elongated plunger 124 and compression spring 123 which is manually operated to open and close the valve. Other suitable type springs may be used. The plunger 124 is disposed 90 degrees to the axial centerline hydraulic cylinder 102 in this embodiment. The plunger 124 functions to shut off the flow of hydraulic fluid between the accumulator 106 and hydraulic cylinder 102 by moving the plunger 124 to a closed or blocking position, thereby obstructing flow conduit circuit 118*a*. Conversely, withdrawing the plunger 124 from the flow conduit circuit 118*a* to an open position permits the exchange of hydraulic fluid between the accumulator 106 and hydraulic cylinder 102. The valve 122 and plunger assembly is operated via an operating lever assembly which in one non-limiting preferred embodiment is configured as a foot lever 130. Alternatively, a hand-operated lever may be provided. Foot lever 130 is pivotably mounted to frame 22 for upwards and downwards movement between unactuated and actuated positions.

Figure 8:
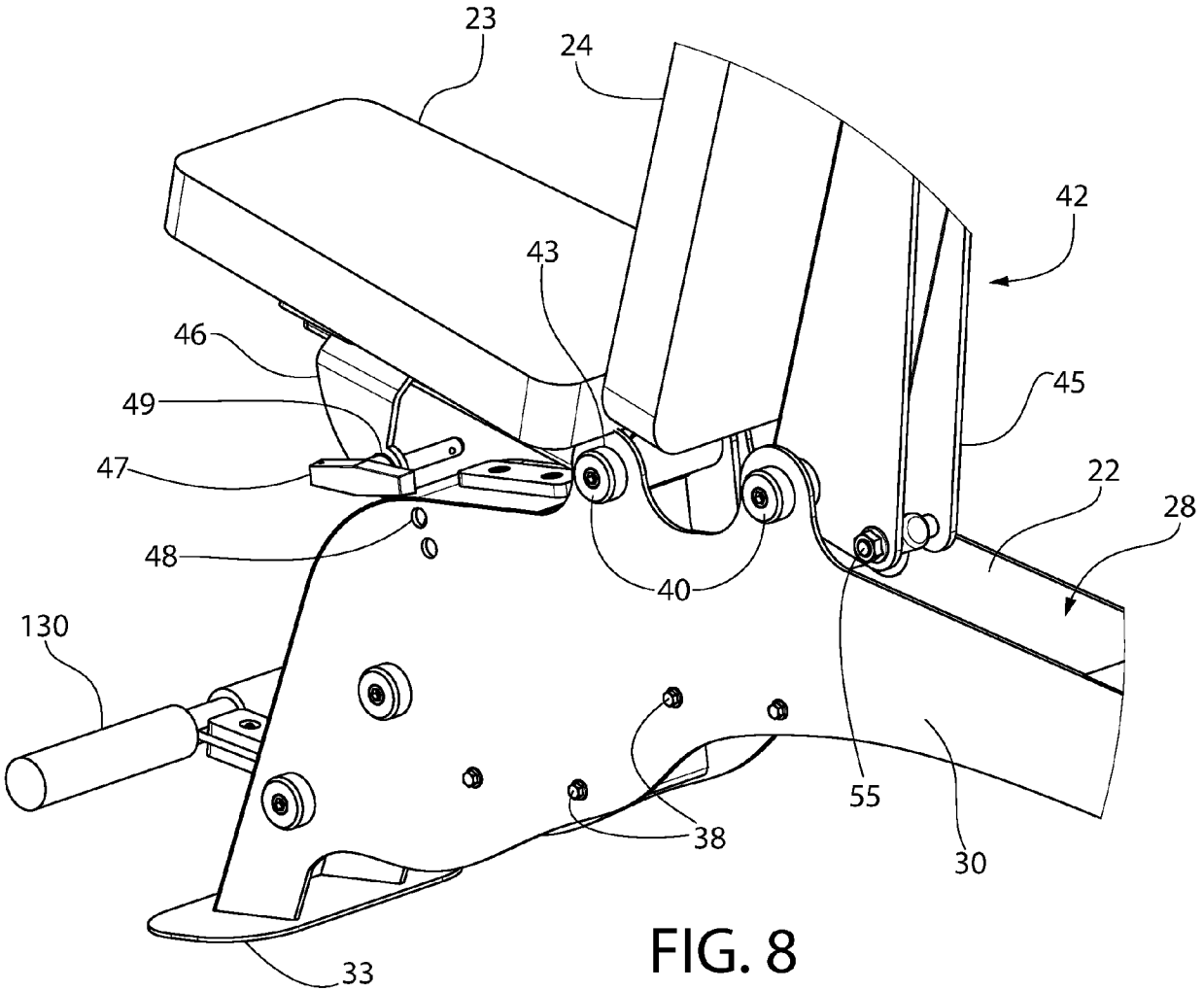
FIG. 8 is a left partial perspective view thereof.
Figure 9:
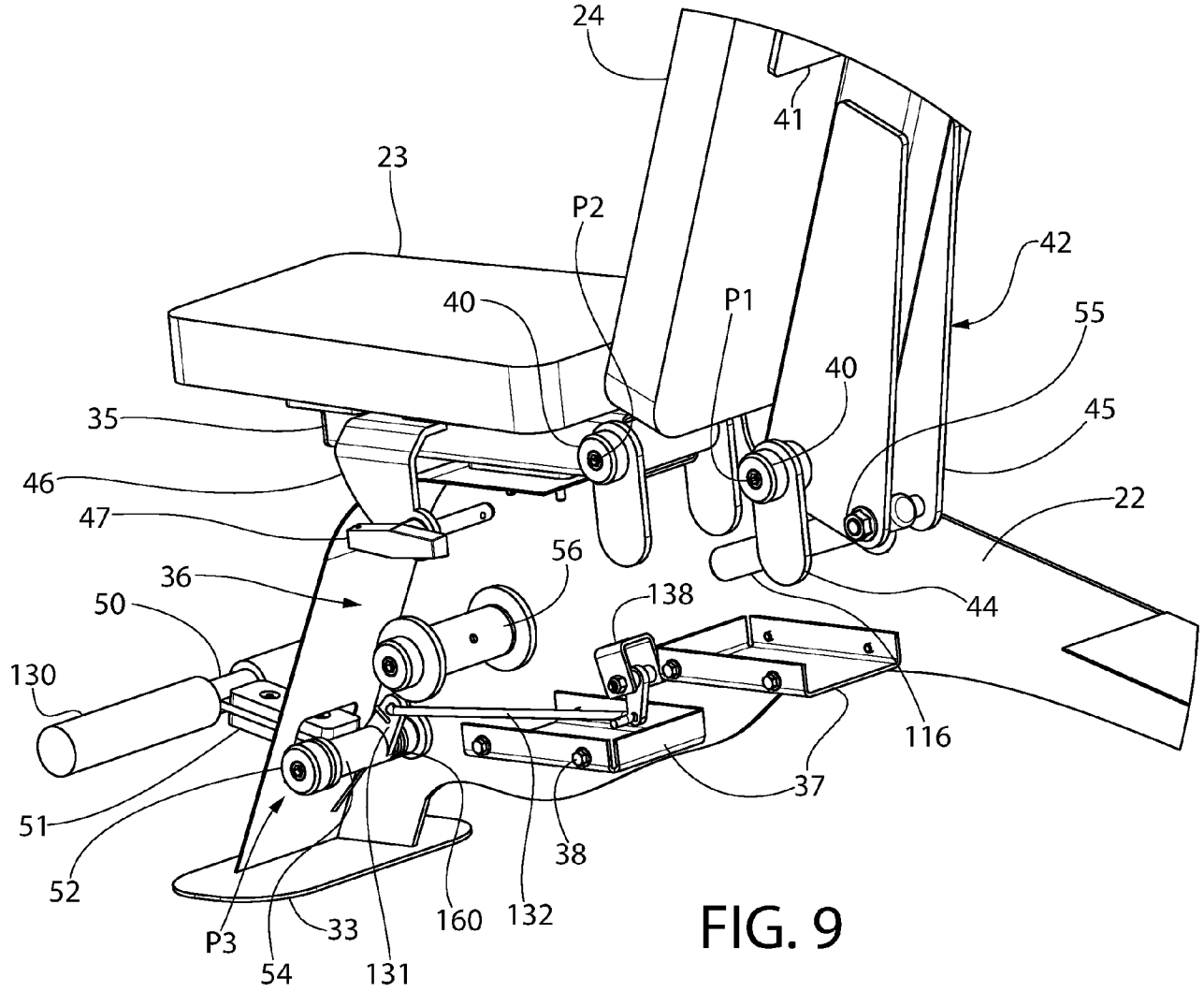
FIG. 9 is a left partial perspective view thereof with a portion of the frame removed without the hydraulic cylinder assembly.

In one embodiment, an ambidextrous operating lever is provided which can be depressed by either foot of a user. Referring briefly to FIGS. 1, 8, and 9, an ambidextrous foot lever 130 has a generally T-shaped configuration comprised of a transversely elongated operating segment 50 connected to an axially oriented mounting segment 51. Each segment may have any suitable polygonal or non-polygonal cross sectional shape, such as circular, square, rectangular, etc. Mounting segment 51 extends through a window 31 in a front wall 53 of the frame 22 into internal cavity 36. The end of mounting segment 51 opposite the end connected to operating segment 50 may be pivotably attached by a tubular collar 54 to a transversely mounted cylindrical cylinder mounting rod 52 extending between lateral sides 30 of frame 22. Mounting rod 52 defines a pivot axis P3 of the foot pedal 130. Depressing the foot pedal 130 in a downward direction in turn rotates the collar 54 relative to the mounting rod 52. In an alternative arrangement, mounting segment 54 may instead be fixedly attached to mounting rod 52 of the frame which instead rotates relative to the frame to provide the same functionality.

In other possible embodiments, the foot pedal 130 may instead be configured for single-sided operation with either the right or left foot of the user. In such an embodiment, the foot lever 130 may be a generally S-shaped lever in the form of a cylindrical rod comprising a horizontal mounting section 130*a* which replaces mounting rod 52 and extends through openings in each of the lateral sides 30 of the frame, a horizontal operating section 130*b* offset but parallel to section 130*a* which is configured for operation preferably by the foot of a user to rotate the foot lever, and an intermediate section 130*c* extending orthogonally therebetween. An enlarged pedal as shown may be provided on operating section 130*b* in some embodiments for easier operation by the user. It bears noting that in this embodiment of a foot lever, mounting section 130*a* is rotatably coupled to the lateral sides 30 of frame 22.

Referring back now to FIGS. 1-16 and the T-shaped foot pedal 130, the foot pedal mounting assembly includes an elongated cantilevered lever arm 131 fixedly connected to and protruding perpendicularly outwards from mounting rod 52 in a radial direction. A mechanical linkage 132 which may be a solid shaft, spring, cable, or other type linkage connects lever arm 131 of the foot lever to a toggle cam 133 pivotably mounted proximate to plunger valve 122 (see, e.g. FIGS. 27-28). In the present embodiment, mechanical linkage 132 is shown as a rod. Toggle cam 133 has a generally flattened plate-like body in the illustrated embodiment defining a cam surface 133*a* at a working end which acts on a cam follower 134 coupled to plunger 124. An opposite operating end of the cam is pivotably connected to mechanical linkage 132, and two opposing lateral sides extends between the working and operating ends. In one embodiment as shown, the cam follower 134 may be defined by a distal cylindrical end portion of the plunger 124 which projects outward and below the valve 122 body. Retracting or projecting the cam follower 134 from valve 122 therefore selectively closes or opens the valve 122, respectively.

The cylindrical cam follower 134 protrudes downwards from and below the body of valve assembly 145 to engage the toggle cam 133. The cam follower 134 formed as an integral part of the valve plunger 124 (or separate part coupled thereto) operates such that pivoting the foot lever 130 in opposite directions open or closes the plunger valve 122 since arcuately curved cam surface 133*a* is asymmetrically offset from pivot 135 which mounts the toggle cam 133 to the body of the valve assembly 145 (see, e.g. FIGS. 27-28). The pivot hole formed in toggle cam 133 which receives pivot 135 is asymmetrically located between the lateral sides of the toggle cam body as shown so that the distance from the pivot to either of the lateral sides is unequal. In one embodiment, pivot 135 may be formed by a transverse pin which is supported by a support bracket such as inverted U-shaped clevis 138 attached to the bottom of the valve assembly 145 body. Other style mounting brackets and arrangements may be used for the pivotable connection.

Figure 28:
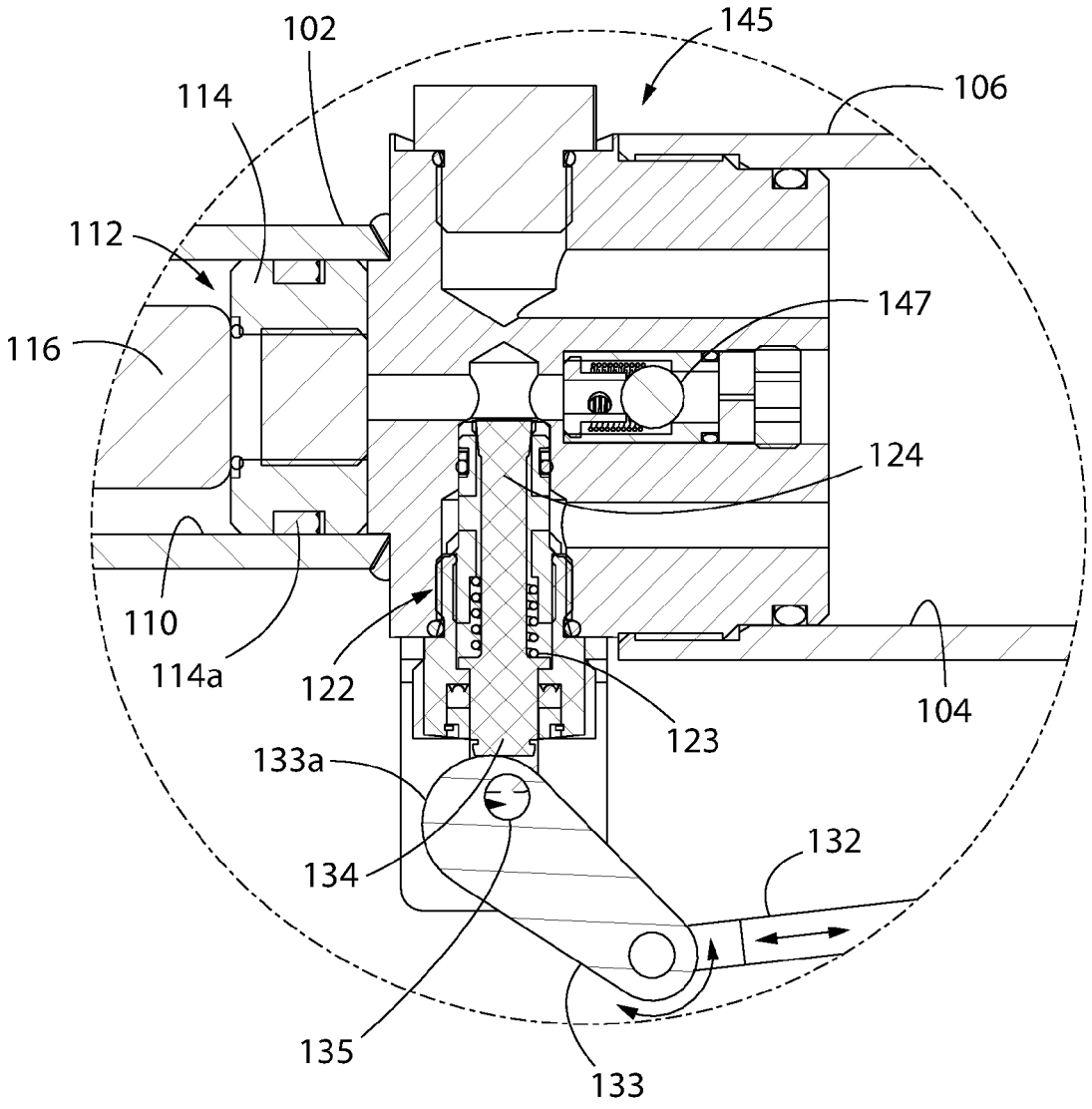
FIG. 28 is a detail view taken from FIG. 27.
Figure 29:
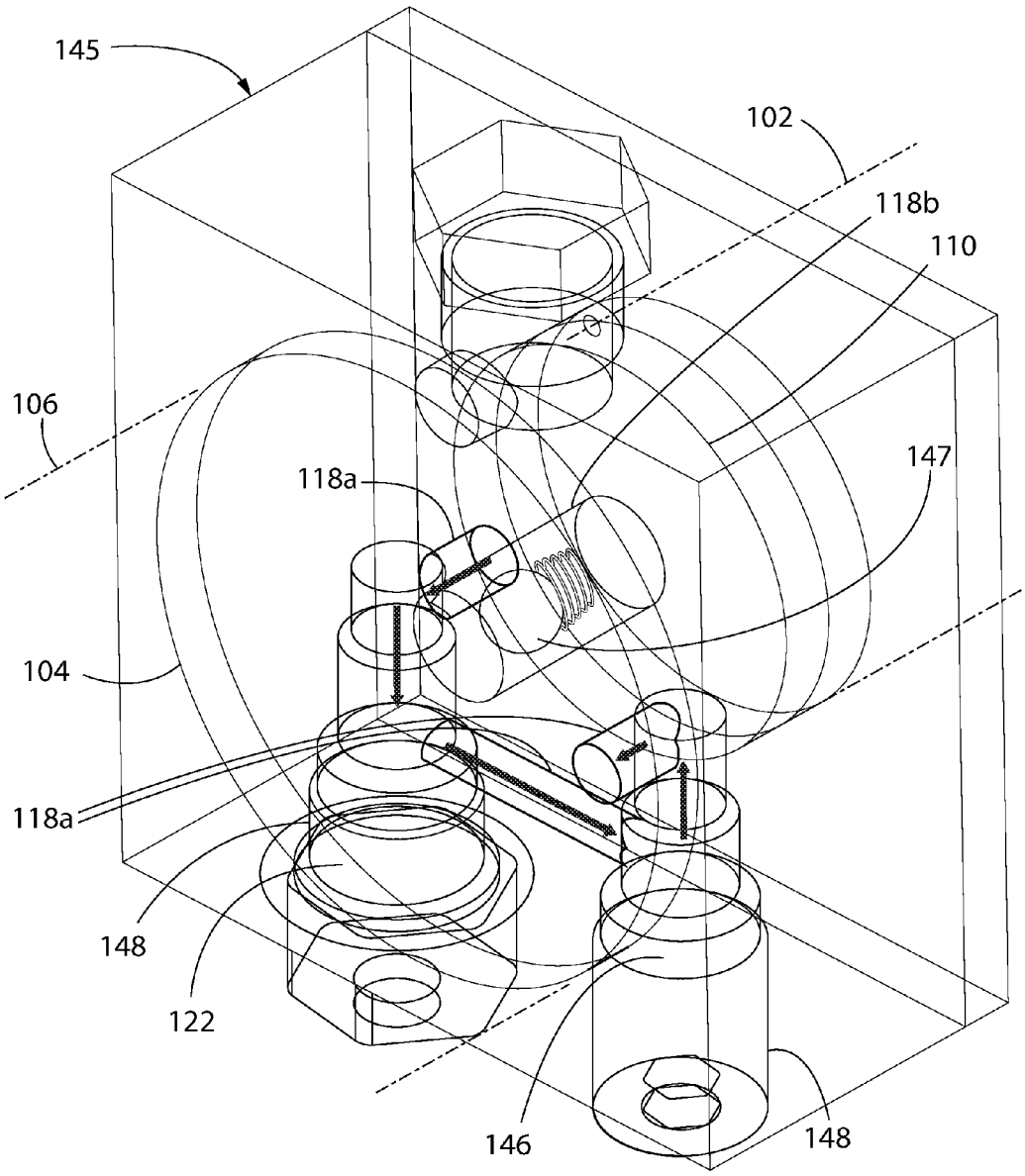
FIG. 29 is a perspective view of the flow control valve assembly of FIG. 21 showing the interior components and flow paths.
Figure 30:
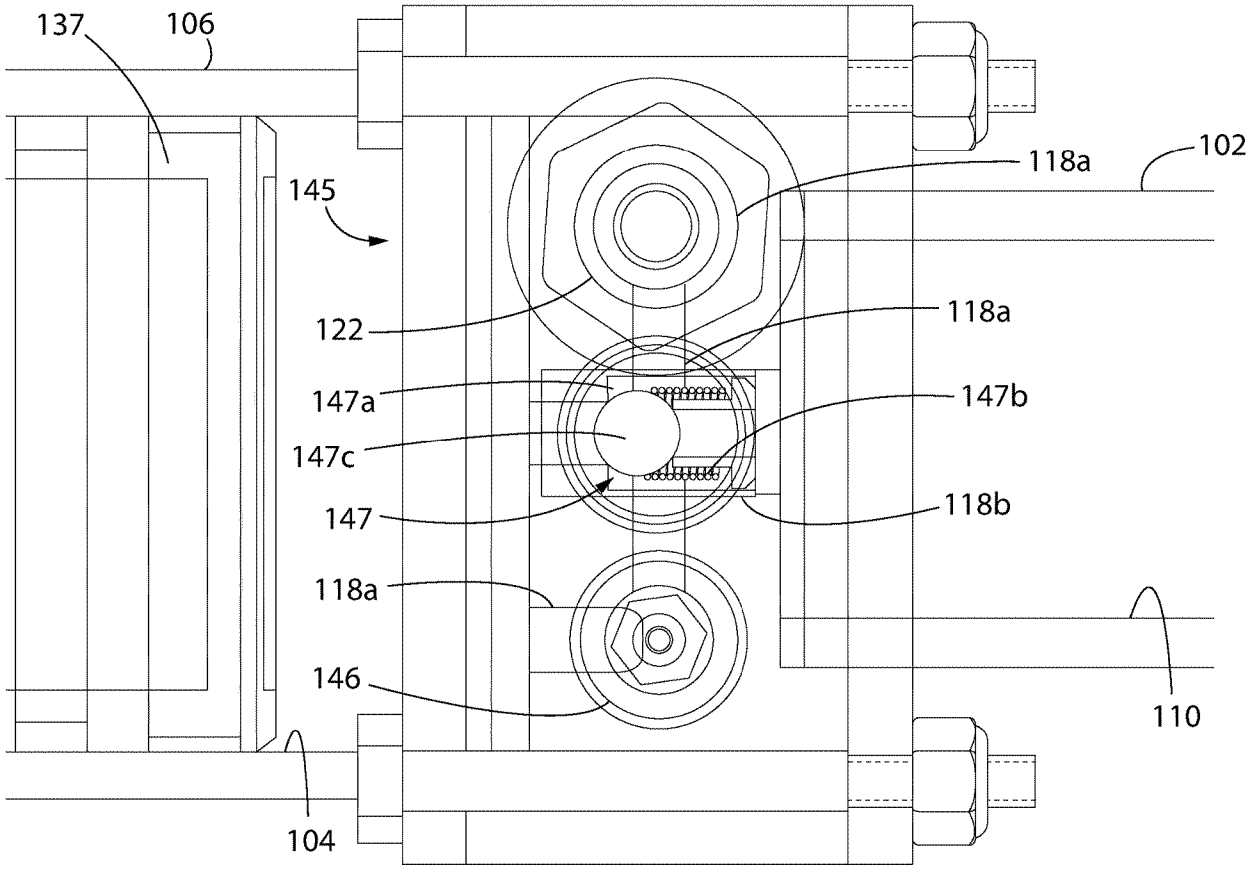
FIG. 30 is a top plan view thereof showing the valve assembly interior components.
Figure 31:
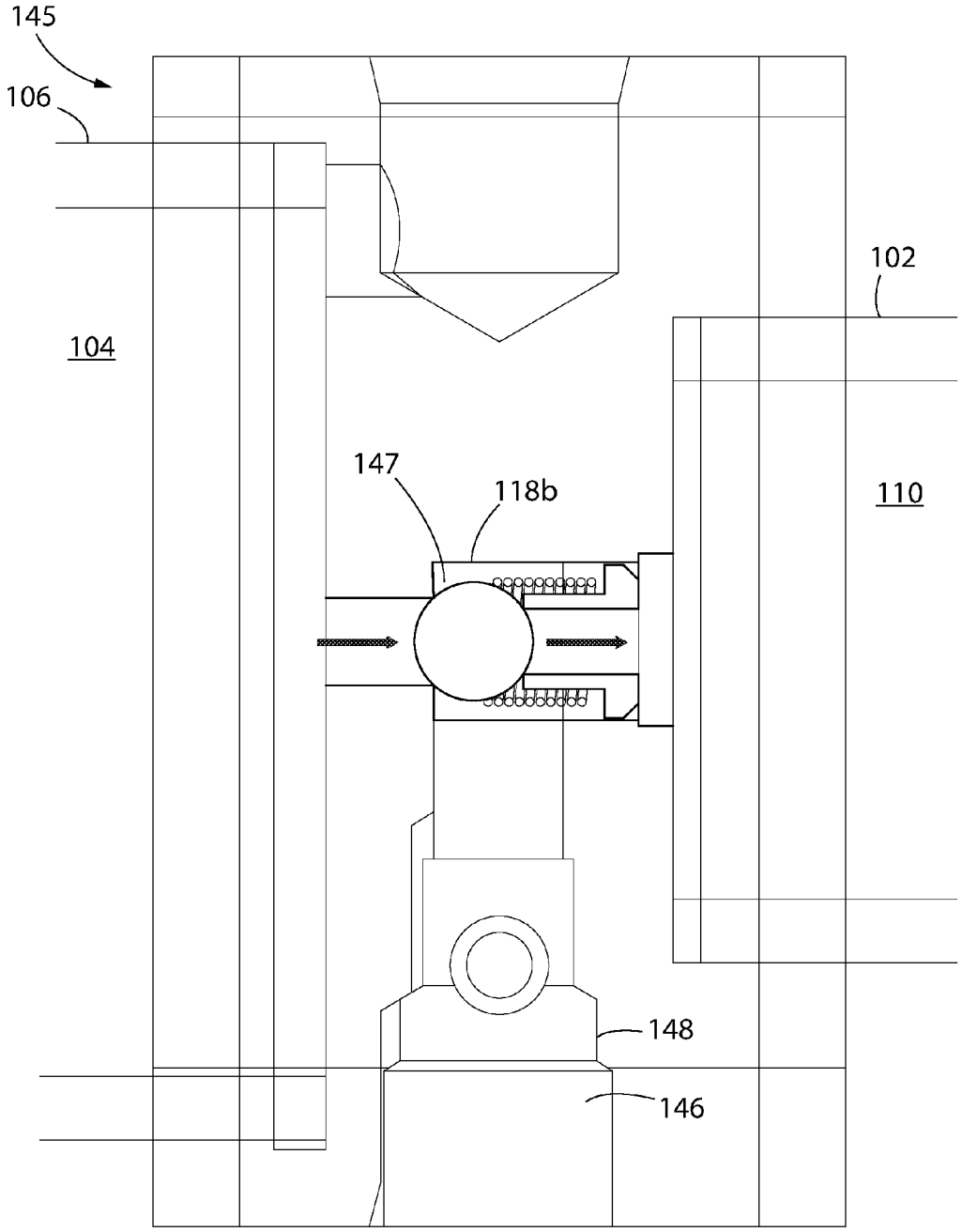
FIG. 31 is a side view thereof showing the valve assembly interior components.
Figure 32:
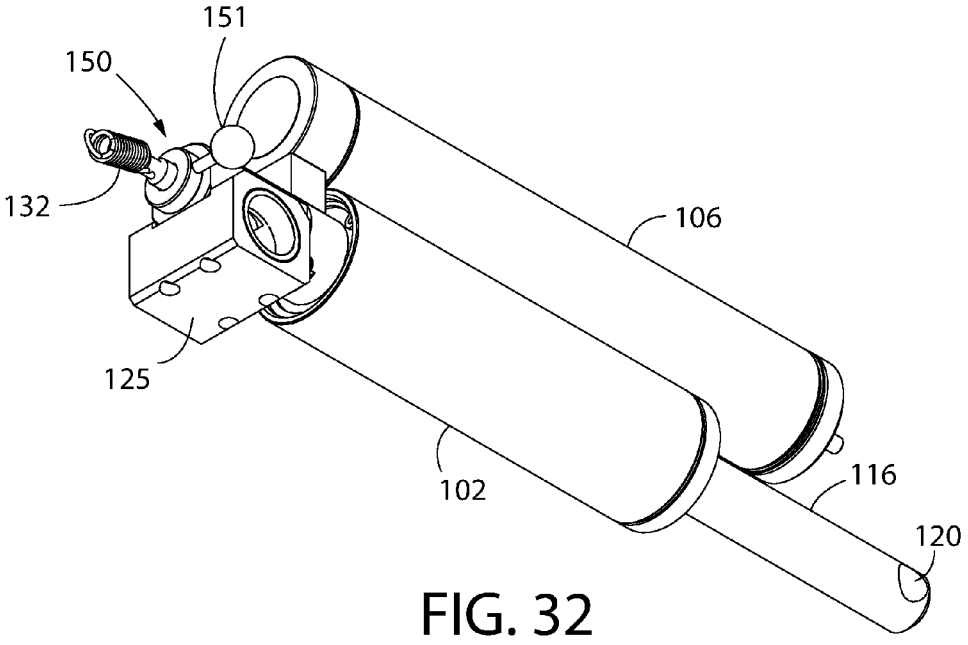
FIG. 32 is a front bottom perspective view of another alternative embodiment of a hybrid hydraulic cylinder system for operating the weight lifting bench of FIG. 1 and back pad assembly that comprises an integrated hydraulic cylinder, accumulator, and operating flow control valve assembly in which the accumulator is arranged parallel to the cylinder.
Figure 33:
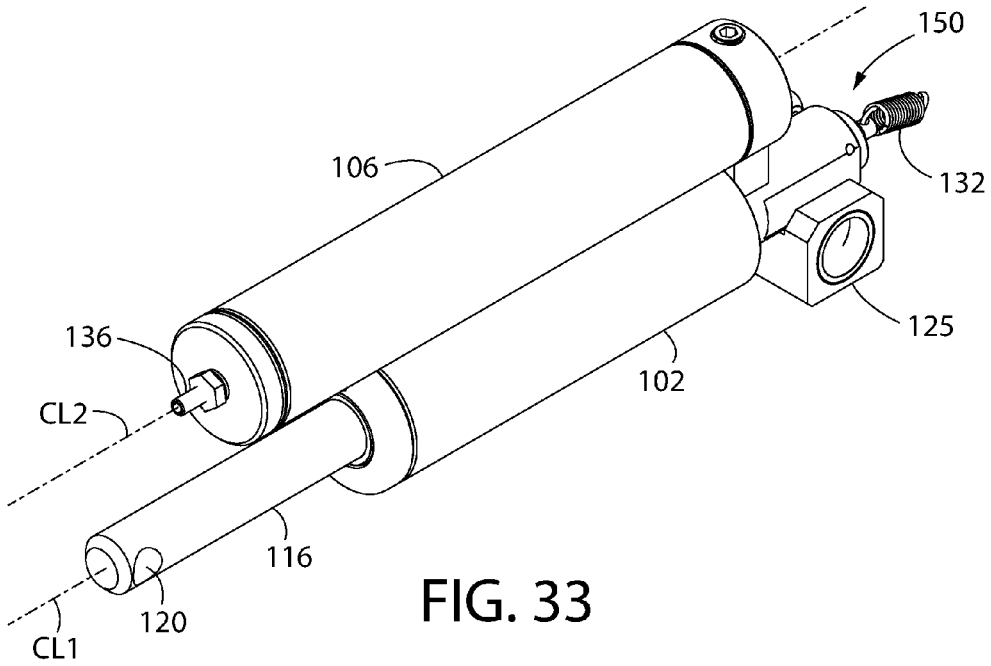
FIG. 33 is a rear perspective view thereof.
Figure 34:
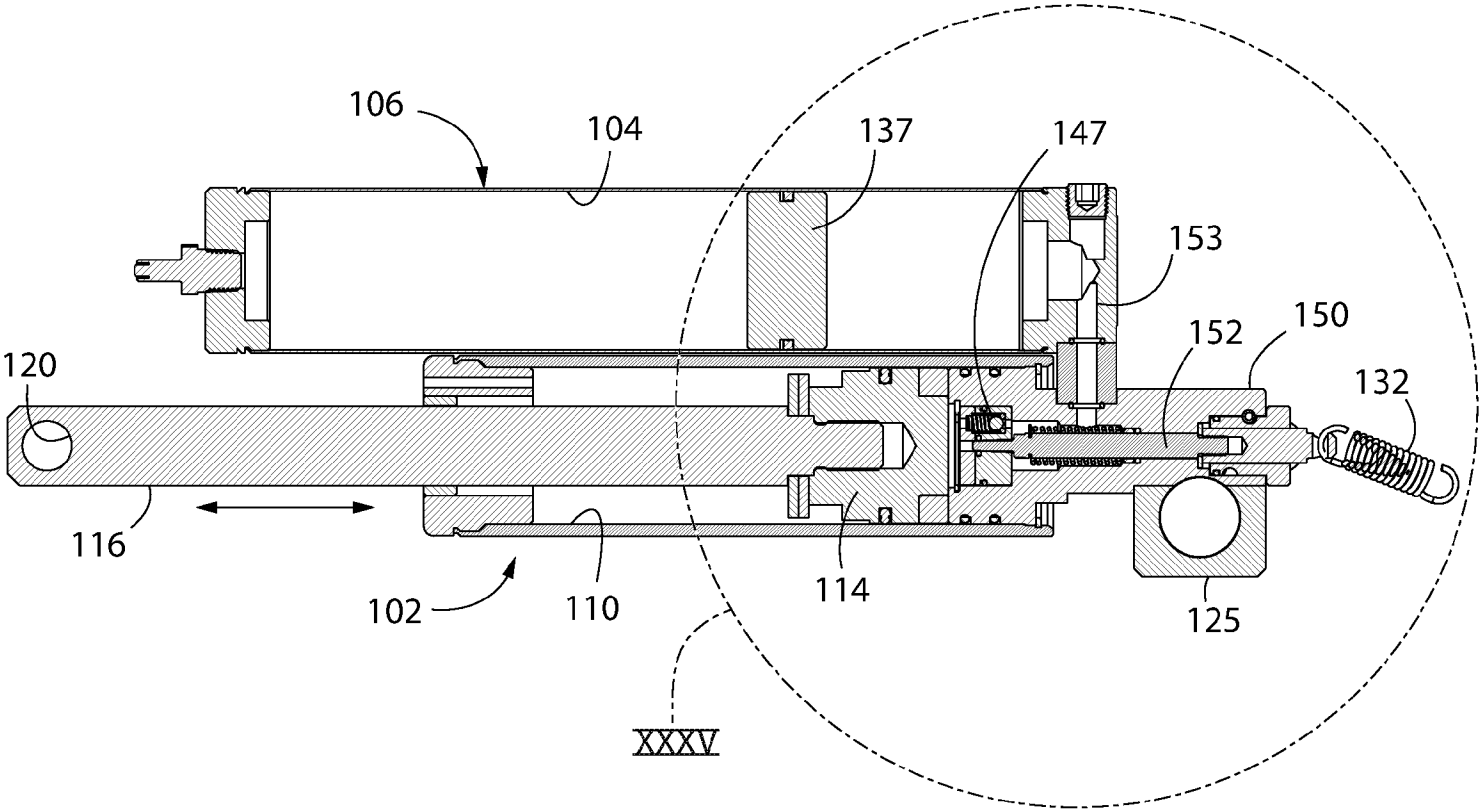
FIG. 34 is a longitudinal cross sectional view thereof.
Figure 35:
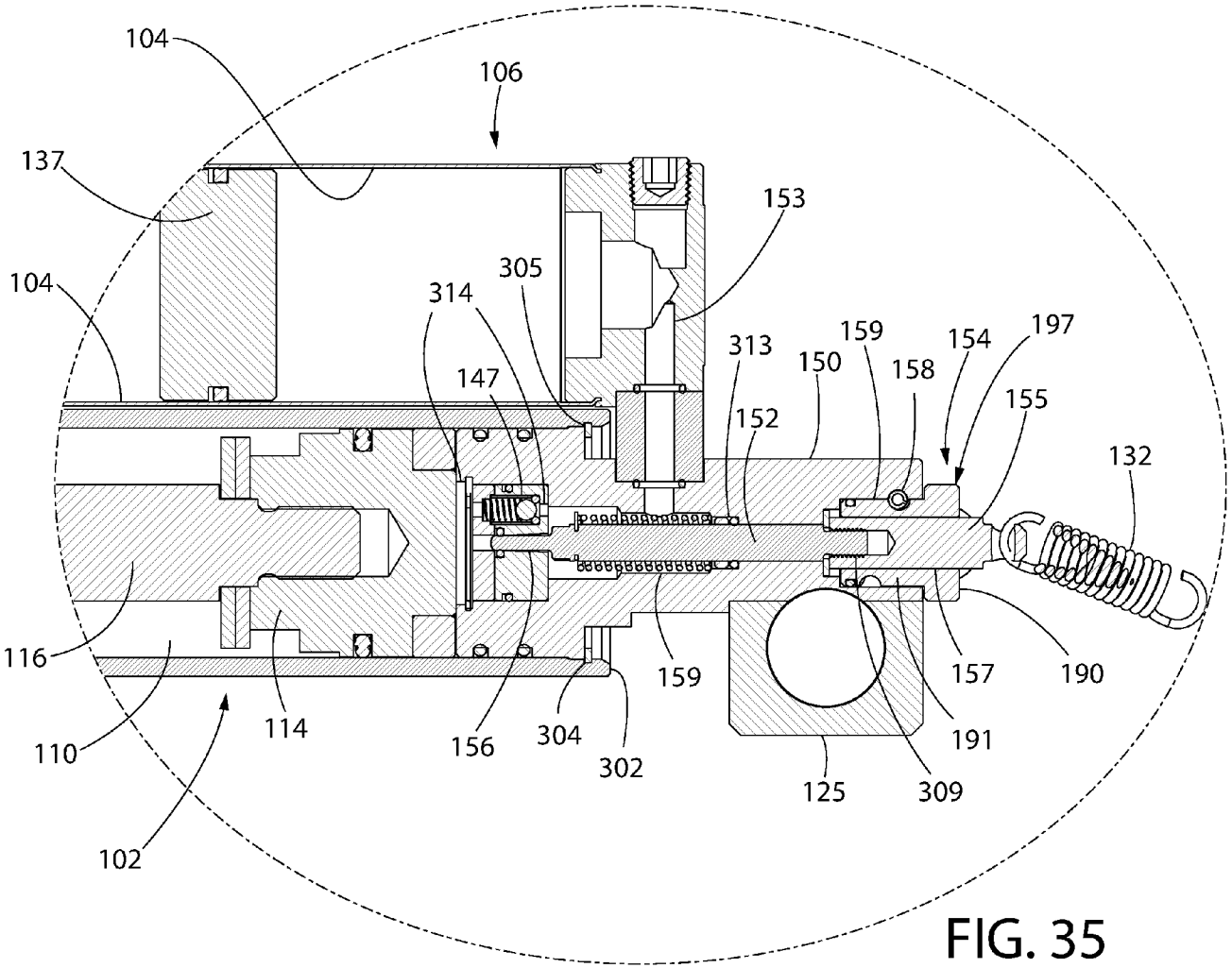
FIG. 35 is a detail view taken from FIG. 34.
Figure 36:
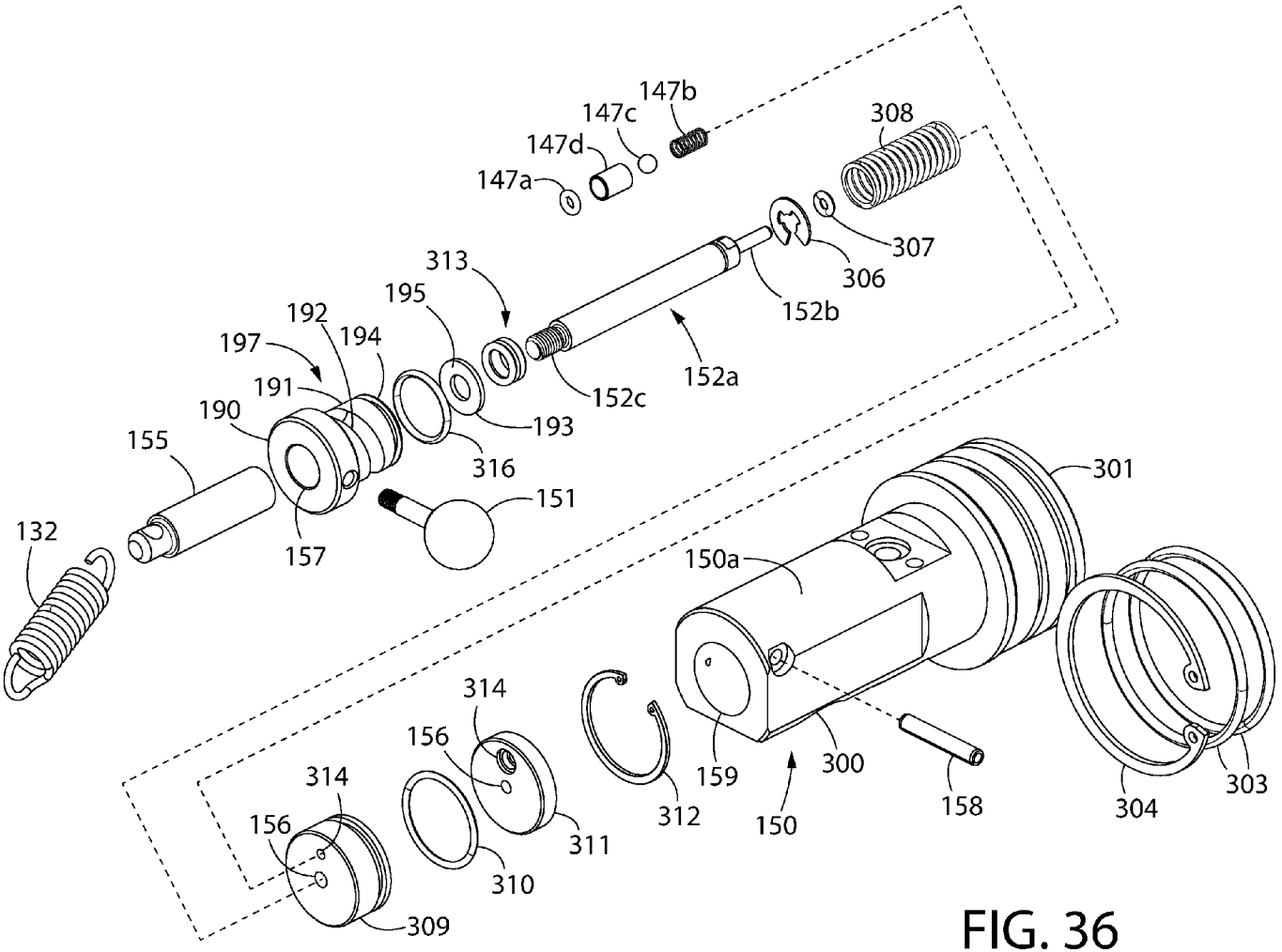
FIG. 36 is an exploded perspective view thereof.
Figure 37:
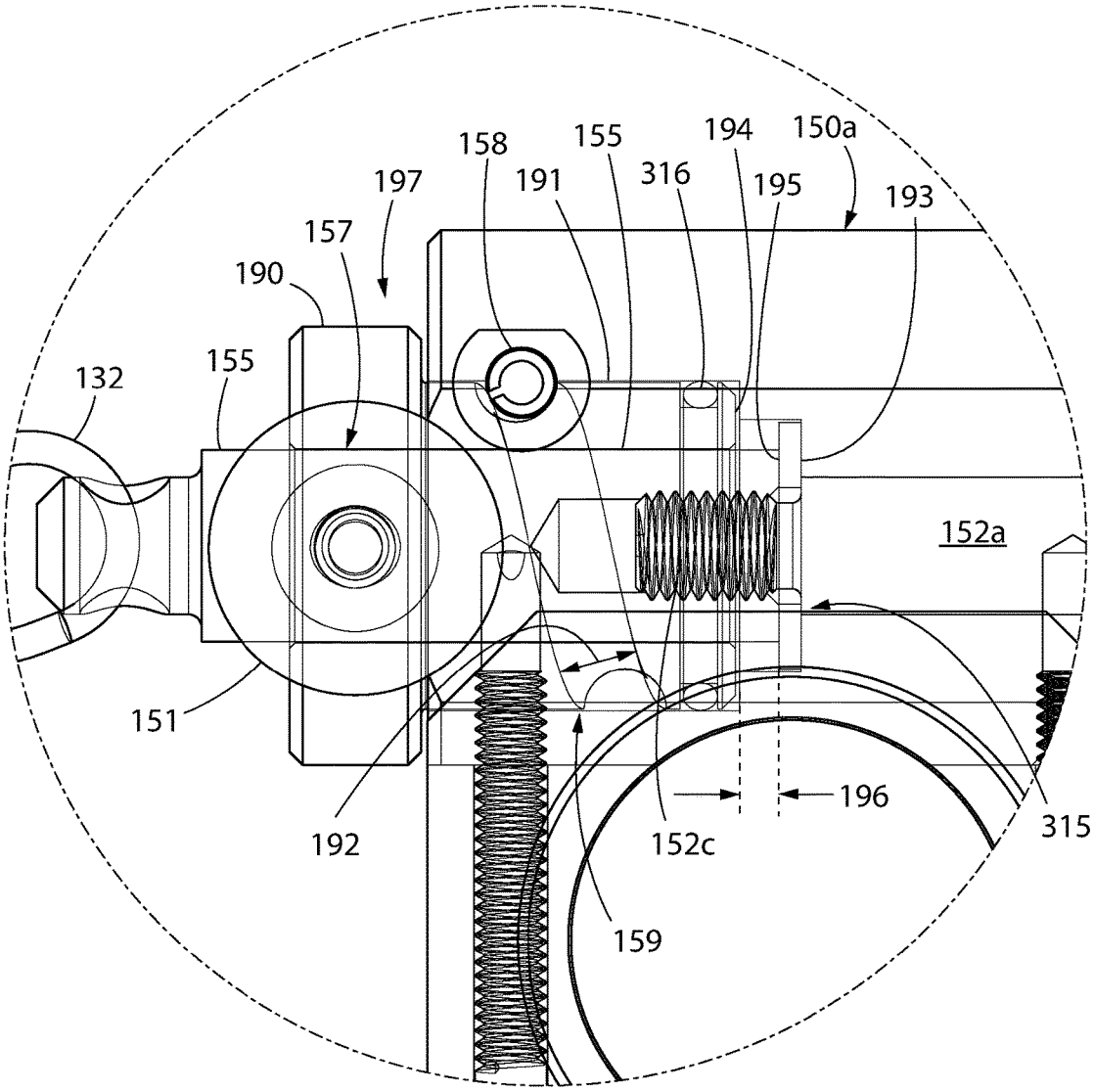
FIG. 37 is a detail side view of the flow control valve showing valve internals.

FIG. 28 shows the toggle cam 133 in a first inactive position with spring-biased cam follower 134 contacting an outer lateral region of cam surface 133*a* closest to pivot 135. The cam follower 134 is biased downward by plunger spring 123 to maintain contact with the cam surface 133*a* on the toggle cam and bias valve 122 into a closed position. Rotating the toggle cam 133 in a clockwise direction (in FIG. 28) via foot lever 130 and mechanical linkage 132 brings the central portion of cam surface 133*a* into engagement with the bottom end of the cam follower 134. This pushes the cam follower 134 and plunger 124 upward into the plunger valve 122 against the biasing force of the plunger spring 123. The plunger 124 is actuated and raised to move plunger valve 122 into a closed position.

Referring to FIG. 21-28, the hydraulic cylinder assembly 100 may utilize a suitable incompressible hydraulic oil used in such cylinders as the working fluid. In one implementation, the accumulator 106 may be a hydro-pneumatic gas-over-oil type in one embodiment incorporating a compressible gas with the hydraulic fluid oil. The gas may be compressed air or other suitable compressible inert gas (e.g. nitrogen, etc.) which is pre-charged (i.e. pre-pressurized) to an appropriate initial pre-charge pressure. The oil 101 occupies the hydraulic cylinder bore 110 and air 103 at least partially fills the accumulator chamber 104 (depending on whether the cylinder rod 116 is retracted or extended). An air-oil interface is formed between the air and oil within the chamber by an axially slidable piston 137 which shifts position in response to movement of the cylinder rod 116 and connected piston head 114 in hydraulic cylinder 102. Piston 137 is sealed at its peripheral edges to the chamber 104 by suitable annular seals to keep air oil from leaking past the piston into the oil. The air 103 may be filled into the chamber 104 at a pre-charge pressure via an air fill or charging valve 136 fluidly connected to the accumulator 106. Valve 136 may be a Schraeder type valve in one embodiment; however, other type valves may be used.

It should be noted that an air/oil accumulator is preferable over other designs due to lower manufacturing costs and added longevity of life. The rubber bladder used in other air or gas-over-oil type accumulators may be problematic for this design and application. Particularly when the hydraulic cylinder used in a substantially horizontal position as illustrated herein, the rubber bladder can rub and wear over time against the interior of the accumulator chamber, thereby ultimately leading to failure and leakage. However, rubber bladder type accumulators may viably be used nonetheless. Still in other embodiments contemplated, weight-loaded piston or spring type accumulators may be used. Accordingly, the choice of accumulator type does not limited the invention.

In operating principle, compressed air 103 at a pressure higher than atmospheric stores useable potential energy which is converted to kinetic energy to displace piston head 114 and automatically return the bench pad 50 to an upright position, as further described herein. The compressed air exerts pressure against a distal side of the piston 137 (farthest from valve 122) in accumulator 106 that separates the air and hydraulic fluid. Piston 137 in turn exerts force against the hydraulic oil 101 on the proximal side of piston 137 (closest to valve assembly 145). The oil acts in a rigid manner (due to the incompressible nature of the hydraulic oil) against the proximal side of the piston head 114 in the cylinder bore 110 when the bore and accumulator chamber 104 are fluidly connected. This pressure force is used to extend the cylinder rod 116 for forming the support pad auto-return feature of the present invention.

The hydraulic cylinder assembly 100 comprising the hydraulic cylinder 102 with cylinder rod 116 is the hydraulic support mechanism between the rear strut 42 of back pad 24 and the frame 22. When the cylinder rod 116 is fully extended, the back pad 24 is in its highest position relative to the floor and the frame. At this point, the hydraulic fluid fills the cylinder bore 110 in the hydraulic cylinder 102 pushing and extending the rod outwards from the cylinder.

The transfer of hydraulic fluid between the cylinder bore 110 and the air/oil accumulator chamber 104 controls the cylinder rod and hence back pad position. When the cylinder rod 116 is fully retracted inwards into the cylinder 102, the bench pad 50 is in the lowest position relative to the floor and frame. At this point, the hydraulic fluid fills the accumulator 106 and the rod is completely retracted. To adjust the vertical position of the back pad 24, the user may press the foot lever 130. The foot lever controls the position of flow control valve 122 (e.g. open or closed) which allows or prevents the exchange and flow of hydraulic fluid between the hydraulic cylinder 102 and accumulator 106.

Accordingly, it bears noting that moving the foot lever 130 changes the hydraulic cylinder mechanism between an activated condition in which the back pad is movable between the incline and decline positions when the foot lever is actuated, and a deactivated condition in which the back pad is locked into a selected one of the incline and decline positions when the foot lever is unactuated.

Operation of the hydraulic control system utilizing hydraulic cylinder 100 will now be described for the bench 20 having the fully automatic back pad 24 auto return feature. The auto return is activated merely by the user releasing the foot pedal 130 and removing pressure against the back pad 24, thereby allowing the back pad to automatically return to its uppermost position. In this embodiment, accordingly, valve assembly includes check valve 147 which provides the flow path required for the full auto return feature (i.e. back pad returned to uppermost position without user actuating or depressing the foot pedal 130).

Figure 38A:
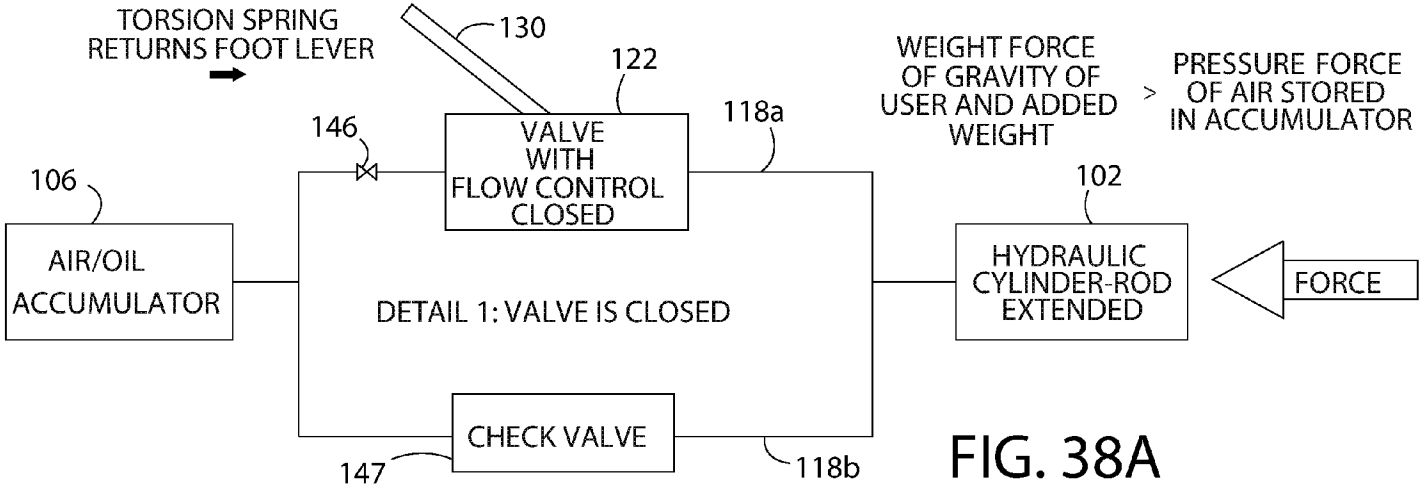
FIG. 38A is a schematic flow diagram of the hydraulic control system in a state when the back pad is in an incline, horizontal, or decline normal exercise position in which the exchange of hydraulic fluid between the hydraulic cylinder and accumulator is stopped by a closed lever actuated plunger valve.

FIG. 38A corresponds to back pad 24 in an uppermost exercise and highest adjustment position (see, e.g. FIG. 12). The back pad may be almost or perfectly vertical in orientation and is fully positioned above the longitudinal axis LA. Plunger valve 122 is closed in which foot lever 130 is in an upward unactuated position and the toggle cam 133 is in a corresponding upward position to close the valve. While the back pad 24 is in an upper incline exercise position with a weight lifter seated on bench 20 and applying a pressing force against the back pad, the gravity force from the weight of the user and the added weights of the barbell act as force against the hydraulic cylinder 102 in a direction towards retracting the rod 116 therein when the user leans against the back pad thereby applying a pressure force thereto. With the foot lever 130 in the upward unactuated position shown in the hydraulic flow diagram of FIG. 38A, however, the plunger valve 122 remains closed and does not permit hydraulic fluid to flow or exchange between the cylinder 102 and accumulator 106, thereby preventing the bench pad from dropping as the trapped hydraulic fluid acts as a solid support for the back pad 24. Accordingly, the hydraulic cylinder 102 is not in fluid communication with the accumulator 106 at this time. In this position, the weight training equipment is ready and operational for exercise. Due to the fact that hydraulic fluid is non-compressible, the hydraulic cylinder set-up provides the same rock solid feel as a rigidly welded component or piece of equipment.

Figure 38B:
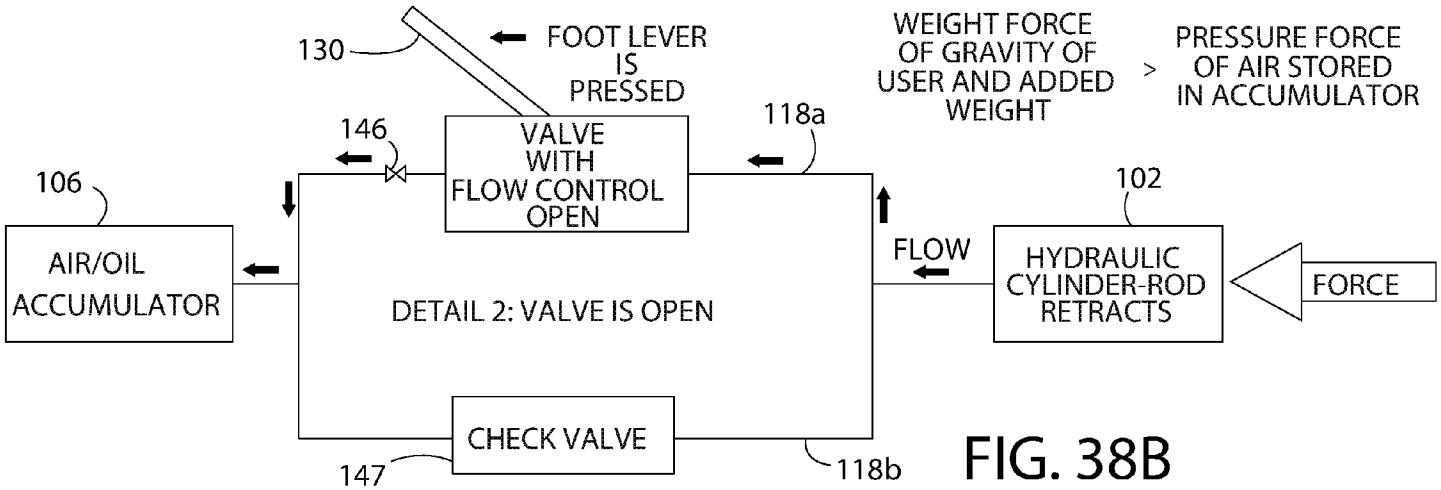
FIG. 38B is a schematic flow diagram of the hydraulic control system in a state when the back pad is in the process of descending towards a lower exercise or lowermost escape position in which hydraulic fluid flows from the hydraulic cylinder into the accumulator via an open plunger valve.

When the foot lever 130 is pressed downward and rotated towards the floor or ground to a downward actuated position, the plunger valve 122 opens as shown in flow diagram of FIG. 38B to implement either adjustment of the incline or decline positions, or the full decline position which equates to an escape scenario for the bench in the event of user fatigue. The downward motion of the foot lever 130 pulls the mechanical linkage 132 towards the front 26 (foot-end) of the bench to open the valve 122. The toggle cam 133 coupled to the valve rotates laterally and upward causing the valve plunger 124 to be urged downwards by spring 123 to open the valve 122. The gravity force of weight from the user against the back pad 24 (i.e. pressing force) and added weight of the barbell on the equipment forces the cylinder rod 116 to retract inwards into hydraulic cylinder 102 and the hydraulic fluid 101 to now flow from the cylinder 102 to the accumulator 106. As the rod 116 retracts into the cylinder 102, the downward gravity force against the back pad 24 causes it to pivot about pivot axis P1 at cross bolt 40, thereby causing the back pad to descend towards the floor F/frame 22 and change its angular position.

If the user intends to simply partially lower the back pad 24 to another incline or a decline position for an exercise routine, releasing the foot lever 130 at any point during the descending motion of the back pad will close the plunger valve 122 and lock/hold the back pad in the respective position selected. With the auto-return feature of the back pad 24 in the present valve embodiment provided by check valve 145, it bears noting that the user must maintain some pressure against the back pad with his/her back to prevent the back pad from automatically returning to the full uppermost incline position as described below. However, it will be appreciated that the user may use this first back pad operating mode with auto return to advantage when exercising. For example, the back pad 24 may be moved in a downwards direction (see, e.g. from full incline position of FIG. 12 towards full decline position of FIG. 16) by depressing the foot pedal 130, and then releasing the pedal which will lock the back pad in position and prevent further descending motion. If the user determines that the angle of the back pad 24 is too low, the user need not actuate the foot pedal to raise the back pad in position slightly. By merely leaning forward, the back pad will remain against the user's back and follow the user upwards to a new incline position. As long as the user does not sit up and break contact with the back pad, the back pad will automatically lock into the new incline position via the valve assembly 145 operation described above.

Figure 55:
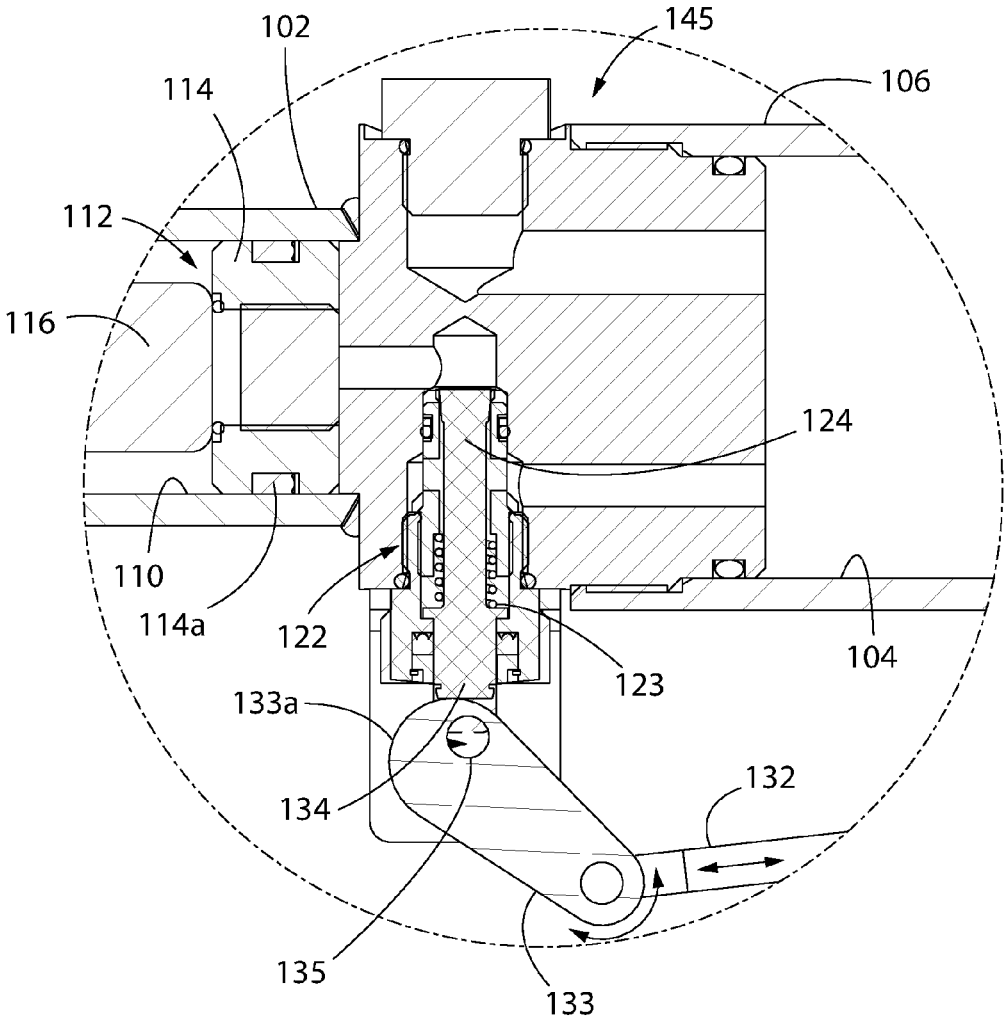
FIG. 55 is an alternative embodiment of a modified flow control valve assembly of FIG. 28 without a check valve and back pad automatic return feature.
Figure 56:
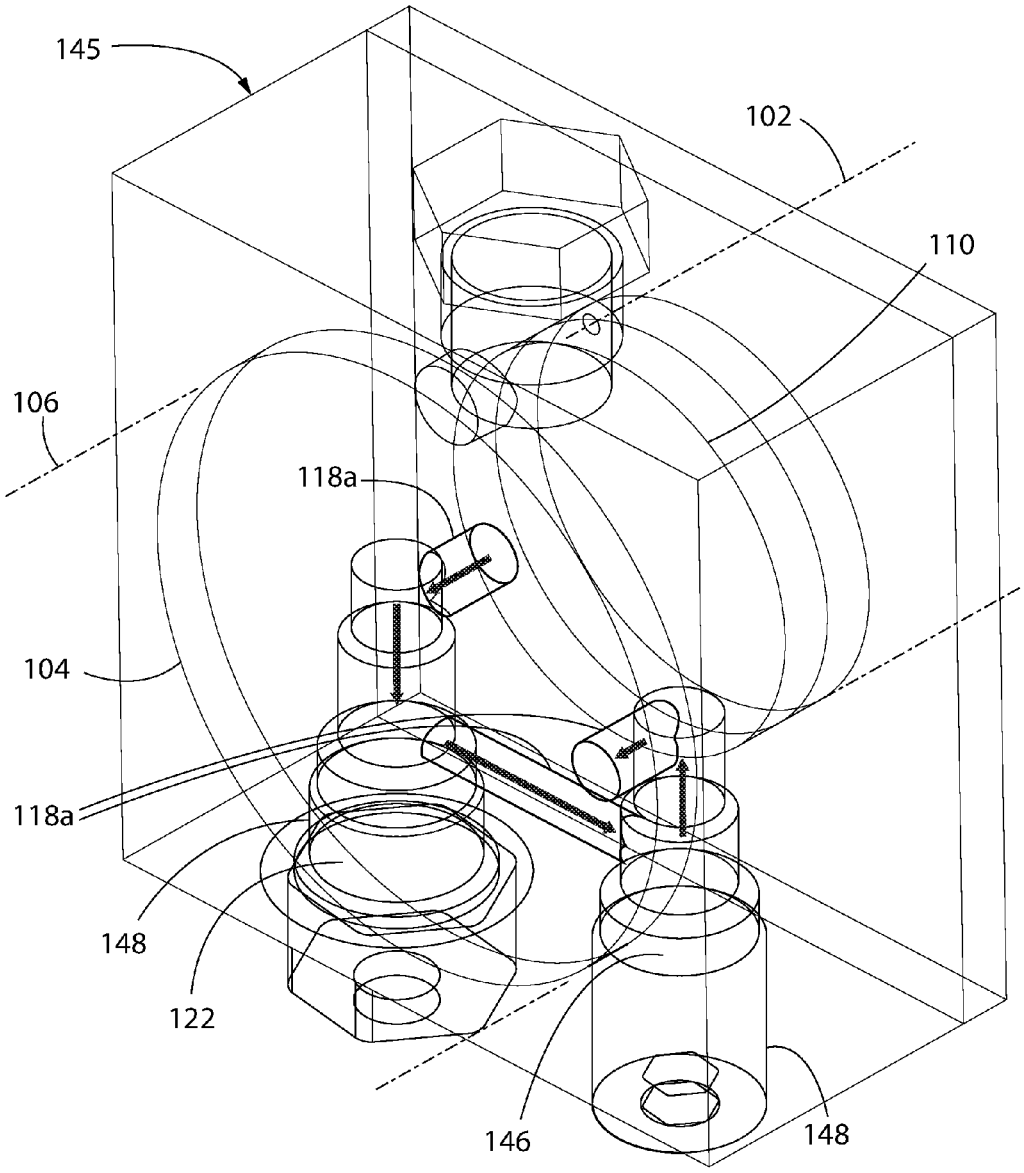
FIG. 56 is a perspective view thereof showing the interior components and flow paths.

A second back pad operating mode is created by a modified embodiment of the valve assembly 145 which eliminates the auto-return feature. Referring to FIGS. 55 and 56, the check valve 147 and its associated flow port 118*b* are removed. This eliminates any flow path directly between the accumulator 106 and cylinder 102 for return flow hydraulic fluid which was controlled by the check valve 147 in the original embodiment of FIGS. 27-31 described above. Hydraulic fluid exchange between the accumulator and cylinder is now always controlled by and must flow through the plunger valve 122 and pressure compensating valve 146 (if provided) without bypass. This second operating mode allows the user to adjust the back pad angle and lock the pad into a user-selected position the same as previously described. However, without the check valve 147, the back pad 24 will retain its angular selected position without the user having to maintain a pressure force against the pad. To return the back pad 24 upwards, the foot pedal 130 must be depressed to open the plunger valve 122 and permit flow of hydraulic fluid from the accumulator 106 back to the hydraulic cylinder 102.

Figure 10:
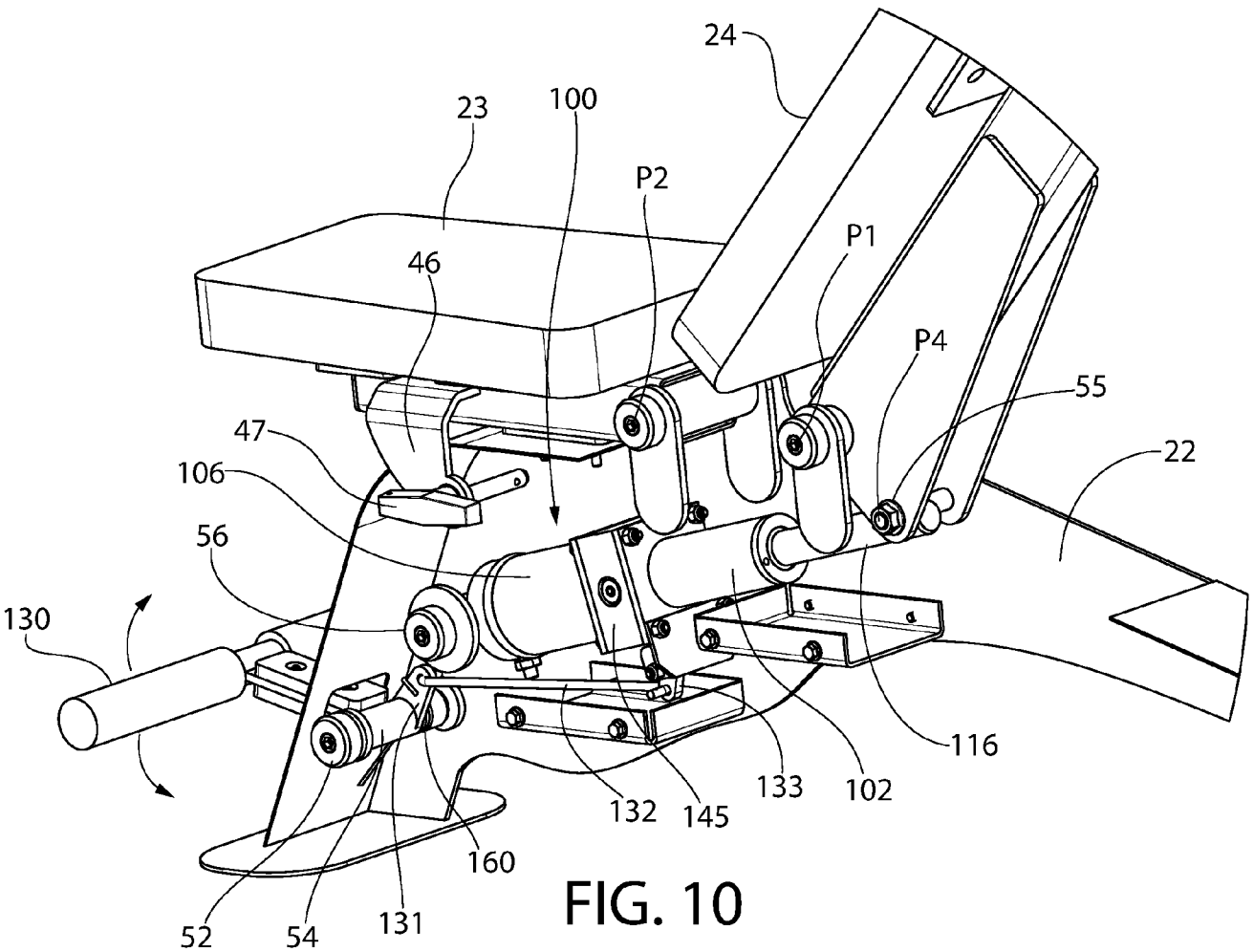
FIG. 10 is a left partial perspective view thereof with a portion of the frame removed and showing the hydraulic cylinder assembly mounted in the bench.
Figure 11:
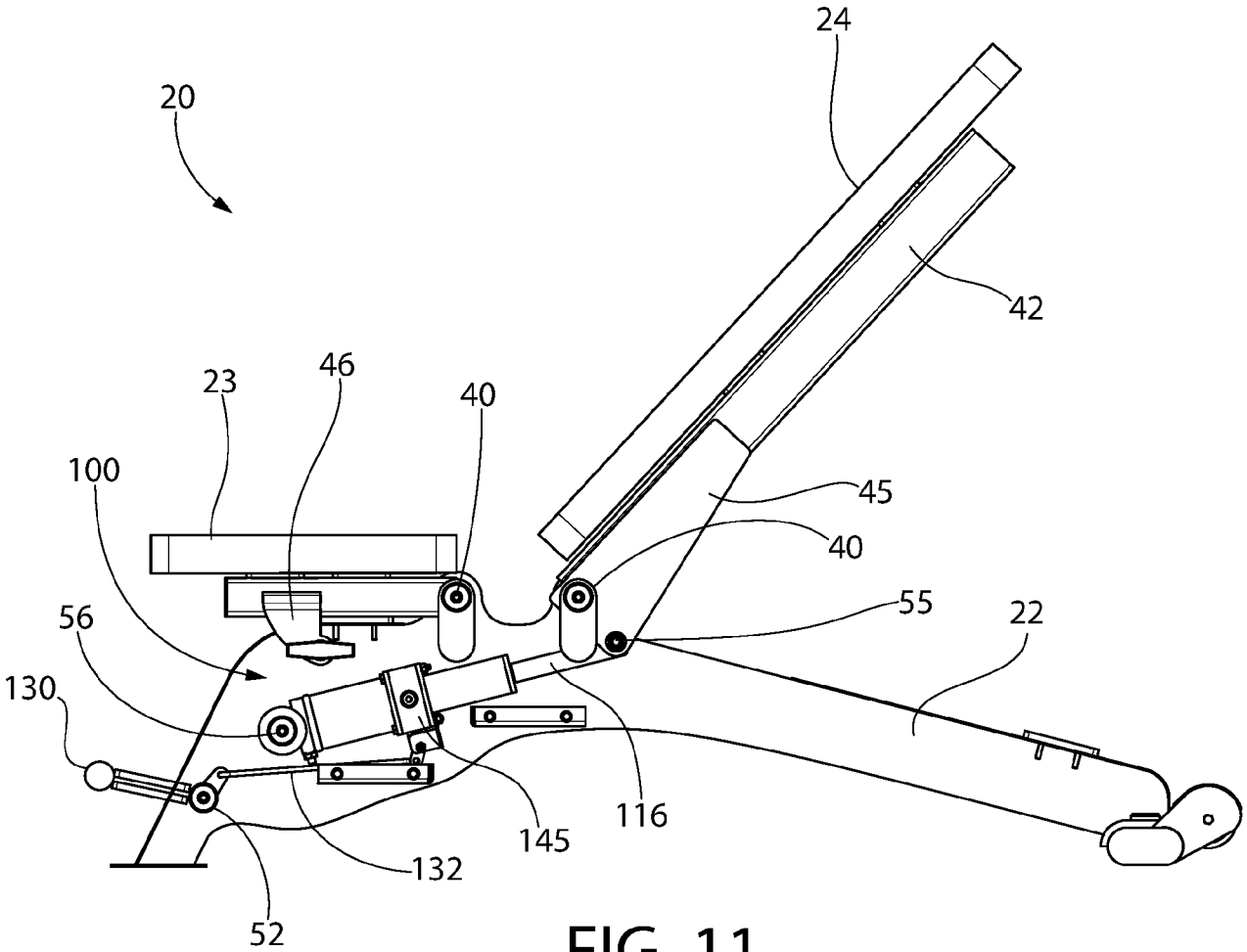
FIG. 11 is a left side view thereof with a portion of the frame removed.
Figure 21:
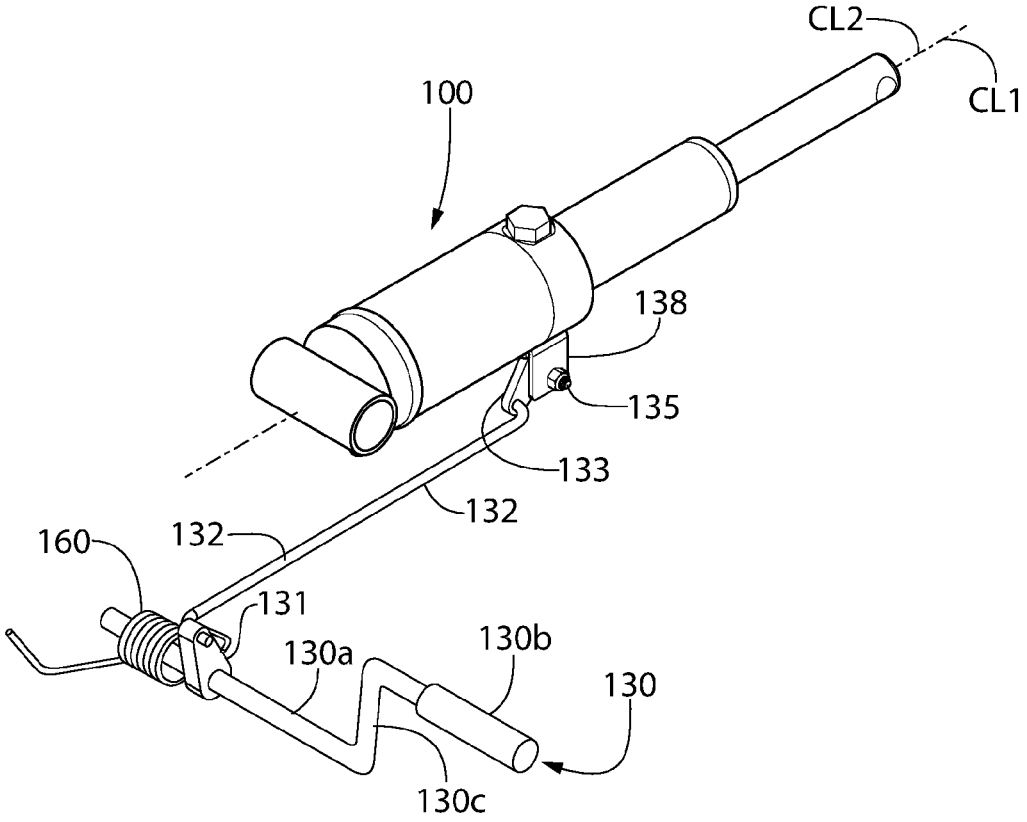
FIG. 21 is a front perspective view of one embodiment of a hybrid hydraulic cylinder system for operating the weight lifting bench of FIG. 1 and back pad assembly that comprises an integrated hydraulic cylinder, accumulator, and operating flow control valve assembly all in axial alignment.
Figure 22:
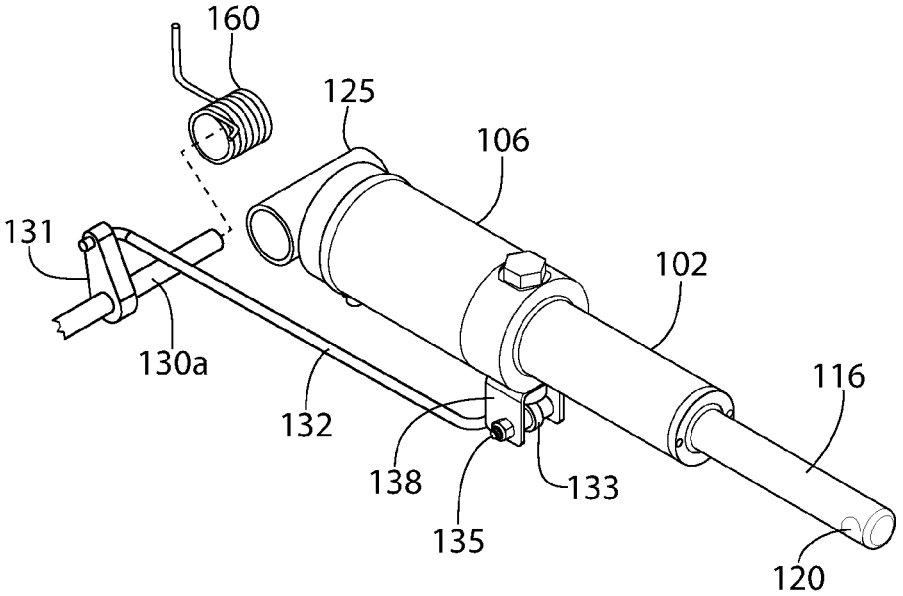
FIG. 22 is a rear perspective view thereof.
Figure 23:
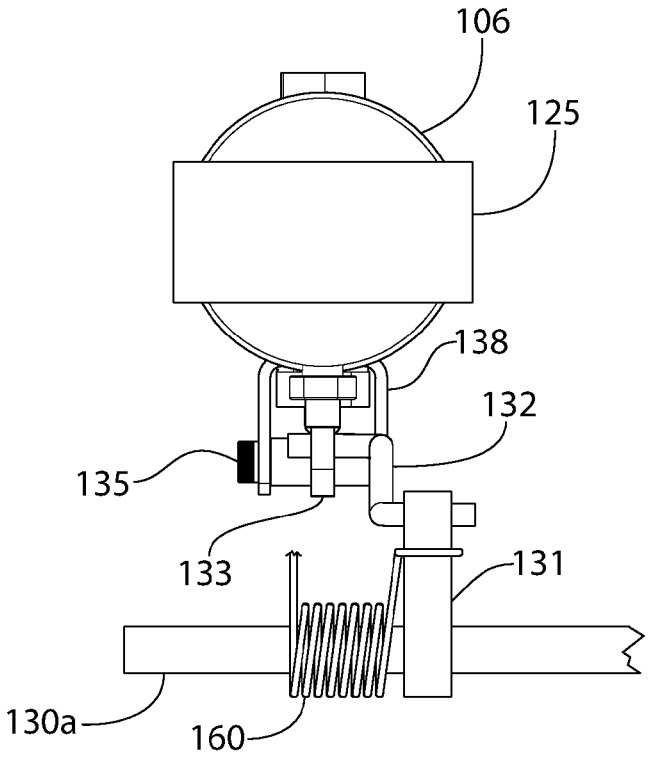
FIG. 23 is a front view thereof.
Figure 24:
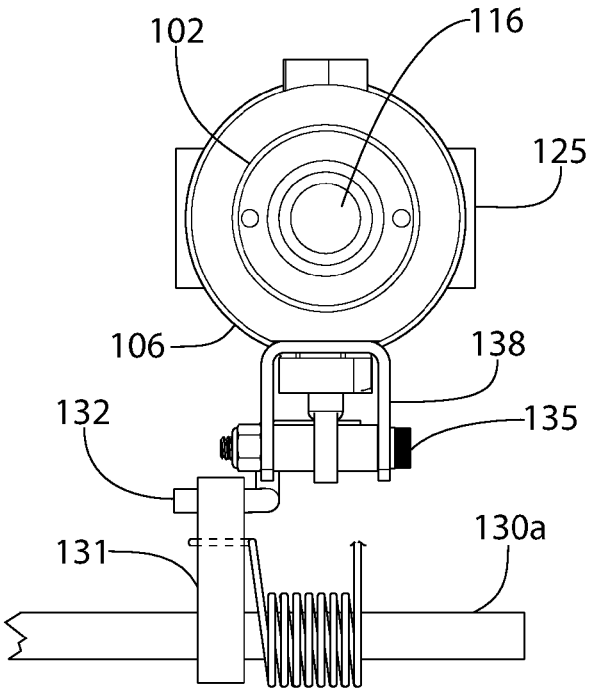
FIG. 24 is a rear view thereof.
Figure 25:
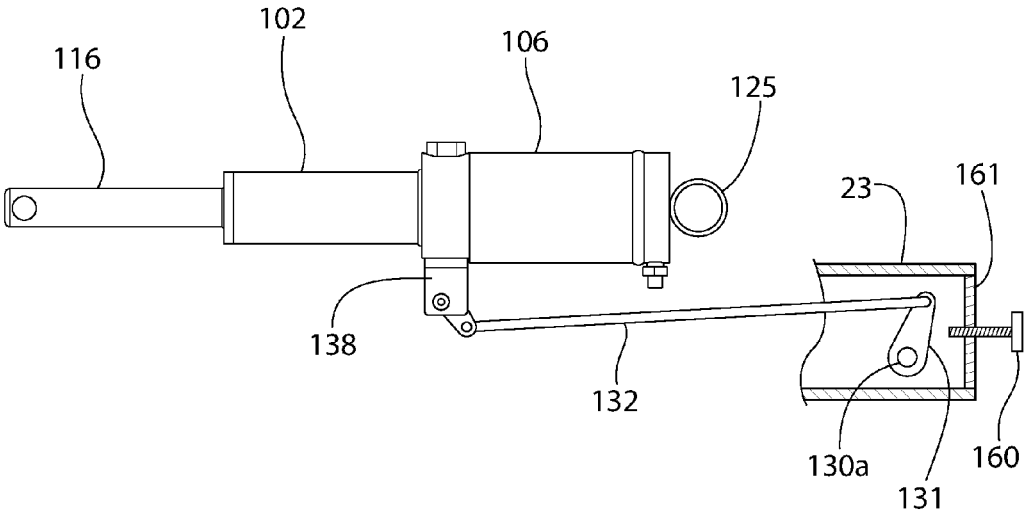
FIG. 25 is a side view thereof.
Figure 26:
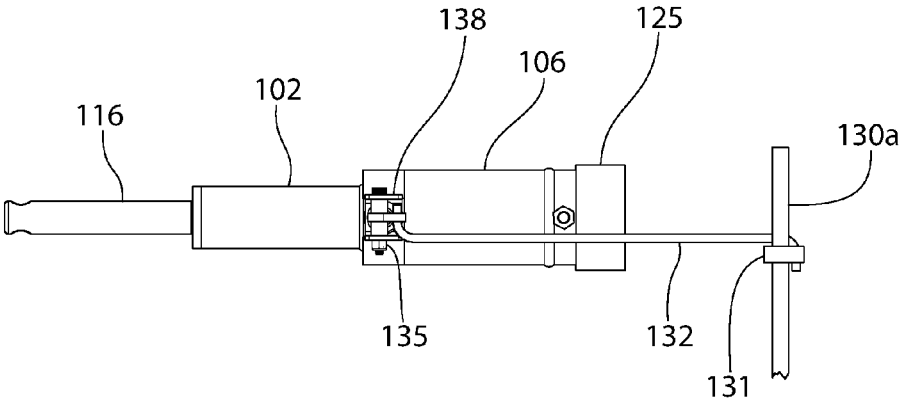
FIG. 26 is a top plan view thereof.
Figure 27:
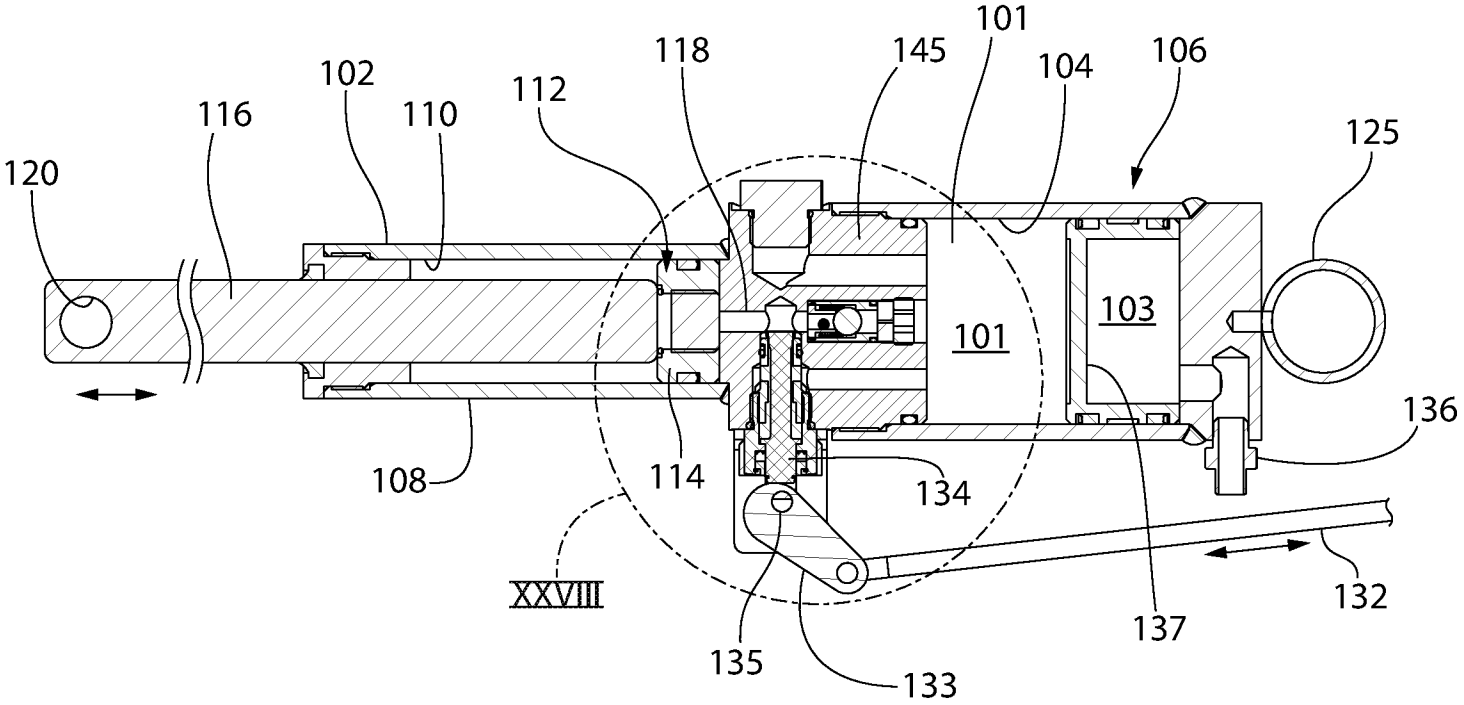
FIG. 27 is a longitudinal cross sectional view thereof.

Interaction of the foot lever or pedal 130 is briefly described. When the foot lever 130 is then released by the user, the lever automatically rotates back into the upward unactuated position under the biasing action of return spring 160, thereby moving the mechanical linkage 132 in an opposite direction back towards the rear head end 27 of the bench. FIGS. 10 and 21-22 show the return spring arrangement. In one embodiment, the return spring 160 may be torsion spring 160 arranged around cylinder mounting rod 52 of the T-shaped lever or the mounting section 130*a* of the S-shaped foot lever rod. One leg of the spring engages the frame 22 and the opposing leg engages the lever arm 131 of the foot lever assembly. This biases the lever arm 131 towards the rear end 27 (head end) of bench 20 (clockwise in FIG. 10), which in turn biases the foot lever 130 into the upwards unactuated position associated with full closure of the plunger valve 122. Without the return spring 160, the user would have to not only press the foot lever to open the valve, but then manually pull it back to close the valve. The automatic return of the foot lever is not only easier for the user to operate, but it is less problematic for the equipment to function as designed. In other possible arrangements, the torsion return spring 160 may alternatively be mounted to the valve assembly 145 around the pivot pin 135 supported by the support bracket or clevis 138 attached to the hydraulic cylinder assembly 100 such as the valve assembly 145. One leg of the spring may engage the toggle cam 133 and the opposing leg engages the clevis 138 or other part of the hydraulic cylinder assembly 100. The foot pedal 130 biasing action remains the same in this embodiment as described above, but the spring is mounted on the other end of the mechanical linkage 132 closest to the hydraulic cylinder instead of the foot pedal. It will be appreciated that other types of springs including helical compression springs, extension springs, etc. may alternatively be used to bias the foot lever into its upward unactuated position.

In order for the plunger valve 122 to stay open, the user must maintain pressure on the foot lever 130. If pressure is removed from the foot lever, the valve will close and the bench pad 50 will remain in a fixed position. This feature allows for "hands free" adjustable positioning of the back pad 24 without ever having to get off the equipment. When the weight lifter experiences maximum fatigue, he/she has the option to press the foot lever and lower the back pad 24 to a decline escape position closer to the ground until the weight (i.e. barbell) is removed safely by safety racks on the weight lifting rack, as further described herein.

By operation of the foot lever 130, the plunger valve 122 configured to function as an on, off, or throttling valve, is operable to create full flow when in a fully opened position, no flow in a fully closed position, and partial flow in a throttled position therebetween. The rate of descent at which the back pad 24 drops during an escape scenario or normal to reach a normal exercise position initiated by a user is determined by the amount that the valve 122 is open and gravity force generally of the weights of both the user and barbell held by user. In various embodiments, the rate of decent may be controlled automatically by the hydraulic cylinder flow control valve assembly 145 to achieve a safe controlled drop of the back pad 24 defining a bench descent speed control safety mechanism described below.

Bench Descent Speed Control Safety Mechanism

Prior weight lifting benches known having mechanisms for lowering the bench upon activation of a release mechanism did not provide a means for controlling the drop rate of the bench in an exercise escape scenario, thereby overlooking this important safety issue. The bench descent speed or rate control safety system according to the present disclosure however prevents the back pad 24 from slamming down when the foot lever 130 is depressed to initiate an escape scenario which may otherwise jolt the user creating a potential for injury. An automatic means for controlling the rate of descent for bench pad 50 to achieve a safe motion is provided in one embodiment by the pressure compensating valve 146 (which in the present embodiment is part of the valve assembly 145 described above). Valve 146 is preferably designed and set to maintain a preset pressure differential across the valve and hence flow rate through the valve regardless of pressure variations in the inlet hydraulic fluid stream that may be caused by users of different physical weights or handling barbell loads which may vary. Accordingly, the rate at which the bench pad 50 will drop when foot lever 130 is depressed downwards will always remain constant thereby reflecting a factory preset pressure differential regardless of whether a heavy or light user is seated on and using the bench, which affects the upstream pressure acting against the valve from the hydraulic cylinder 102 side of the valve. The preset pressure which coincides with the maximum predetermined speed or descent rate for bench pad 50 may preferably be set at the factory as a safeguard and is not adjustable by the user; however, the user may be provided with some ability to adjust the descent rate up to the maximum descent speed. The predetermined maximum descent rate of the bench is therefore independent of the weight load applied to the bench pad. Pressure compensating valves have a cartridge acted on by a spring that regulates the degree that the valve is open. The valve preset pressure differential/flow rate is preferably selected to provide flow of hydraulic fluid through the valve which provides a reasonable rate of descent for the bench pad 50 thereby avoiding a rapid uncontrolled drop jarring the user. Pressure compensating valves are available from numerous commercial sources such as Parker Hannifin Corporation and others.

Hybrid Hydraulic Cylinder Valve Assembly

FIGS. 41-54 depict the hydraulic cylinder assembly 100 of FIGS. 21-31 described in detail above with an alternative embodiment of a unique hybrid and pressure compensating flow control valve assembly 500 having a compact design. Functionally, the compact valve assembly 500 operates under the same principles as, but replaces pressure compensating flow control valve assembly 145 shown in FIGS. 21-31 with differences in the valve internals. In the compact valve assembly 500 design, the pressure compensating valve 502 interacts directly with and is engageable with the ball check valve 147 to control the position of the check valve. Advantageously, the separate plunger valve 122 is eliminated allowing for a more compact and mechanically simpler hydraulic cylinder design that achieves the same functionality with fewer parts due to the unique arrangement of valve elements.

Referring to FIGS. 41-54, pressure compensating flow control valve assembly 500 includes a valve body which defines a flow manifold block 504 comprising a vertically elongated axial central bore 506 for housing the pressure compensating valve 502 and check valve 147 components. Axial bore 506 defines a vertical centerline CL3 of the valve assembly. A plurality of internal fluid conduits defined by hydraulic cylinder and accumulator ports 507, 508 is formed by additional bores in the manifold block 504. Flow ports 507 and 508 may be oriented perpendicular to axial central bore 506 and centerline CL3 in one embodiment as illustrated; however, other orientations are possible. Flow port 508 creates a flow path between accumulator 106 and axial central bore 506. Flow port 507 creates a flow path between hydraulic cylinder 102 and the axial bore 506. Collectively, the axial central bore 506 and flow ports 507, 508 establish a fluid flow path between hydraulic cylinder 102 and accumulator 106 which is controlled by the pressure compensating valve 502 and check valve 147, as further described herein.

In one implementation, manifold block 504 further includes a first side recess 563 which receives an end of the cylindrical tube of the accumulator 106 and an opposing second side recess 564 which receives an end of the cylindrical tube of the hydraulic cylinder 102. The accumulator and hydraulic cylinder tubes may be inserted into the recess and sealed to the manifold block 504 to prevent leakage of hydraulic fluid by any suitable means. Forms of providing a leak-proof seal include without limitation bolted radial flanges and gaskets/seals, circumferential seal welds, shrink fitting, etc. The hydraulic cylinder 102 and accumulator 106 are cantilevered from the manifold block 504 in opposing directions in which the hydraulic cylinder and accumulator are coaxially aligned as illustrated. Other arrangements are possible.

Check valve 147 includes essentially the same cylindrical check body 503 that defines annular valve seat 147*a*, ball 147*c*, and spring 147*b* already described herein with respect to control valve assembly 145 shown in FIGS. 21-31. The valve seat 147*a* is defined by an internal annular shoulder formed inside the central passage 529 of the check body 503 which defines a flow orifice 562 therethrough which is alternatingly closed by the check ball 147*c* to prevent flow in one operating position, and opens in another operating position to permit flow through the check valve. In one embodiment, the check valve 147 may be disposed proximate to the lower of the manifold block 504 and in direct flow communication with flow port 507 which may similarly be disposed near the lower end of the valve body. Check valve 147 is oriented in a vertical position with the seat 147*a* being at the top and the ball and spring immediately below. Spring 147*b* biases the ball 147*c* upwards against the seat to close off the central flow passage 503 of and flow through the check body 503.

Figure 44:
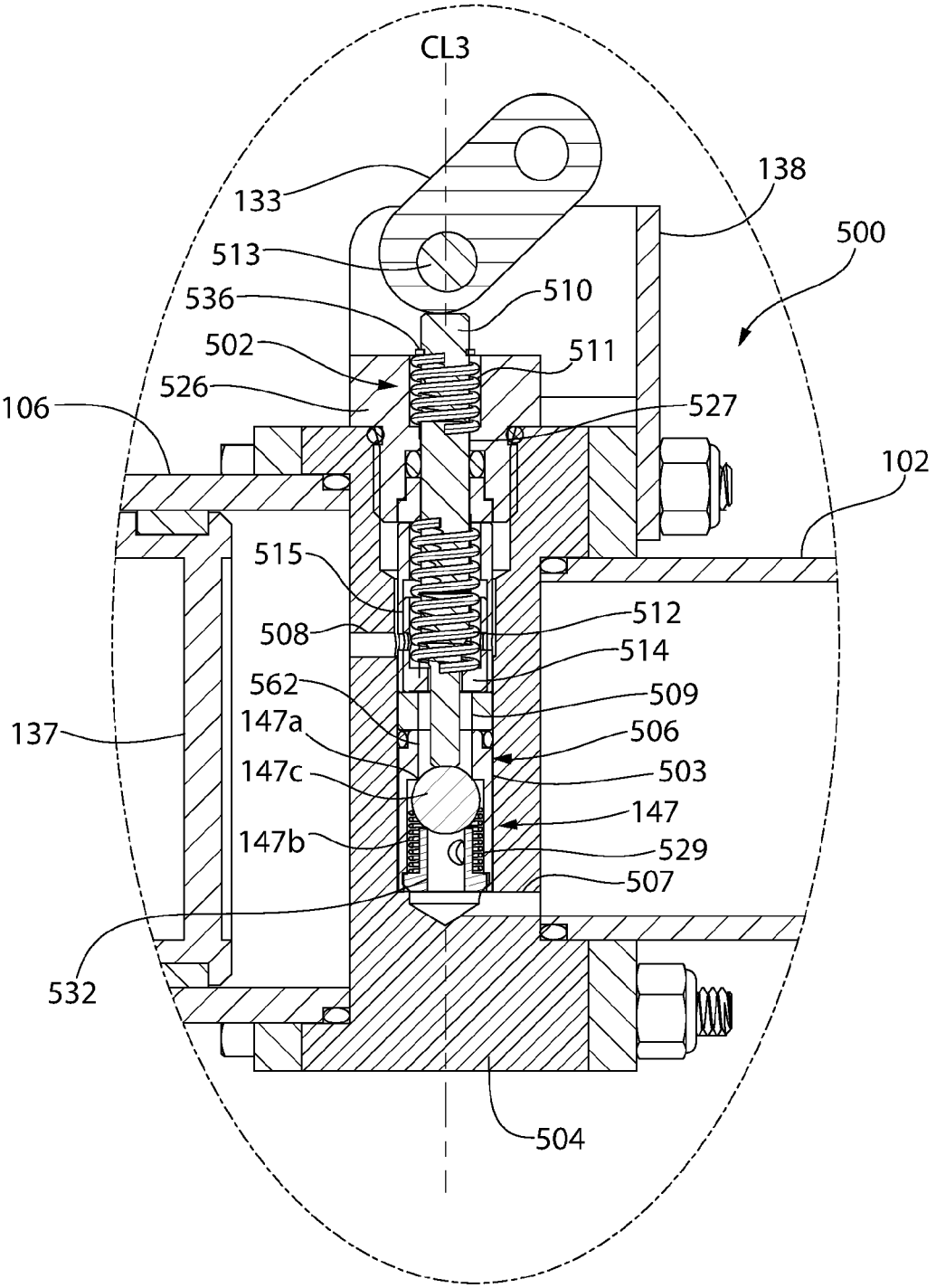
FIG. 44 is a detail side cross sectional view taken from FIG. 43 of the flow control valve assembly.
Figure 45:
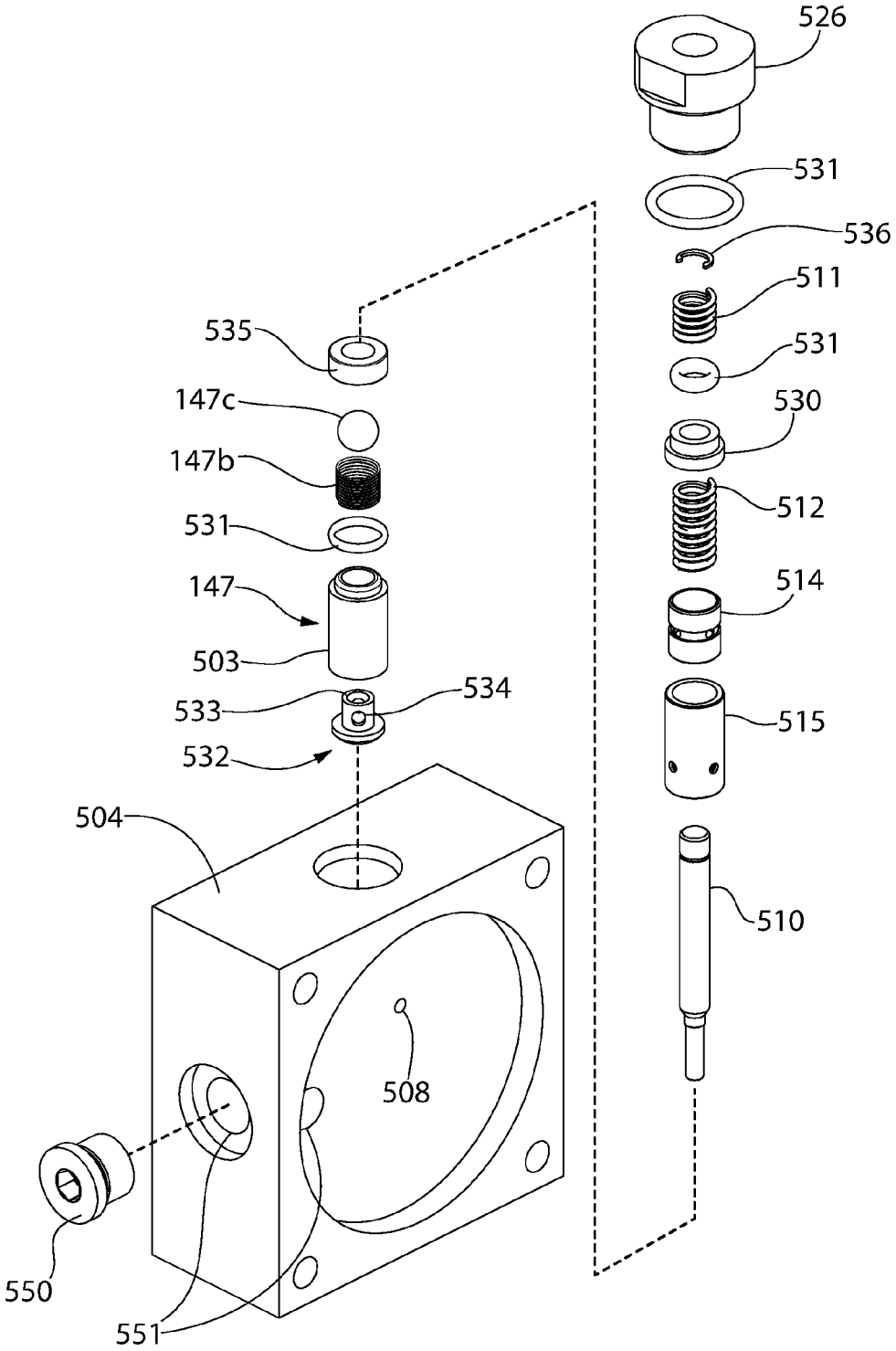
FIG. 45 is an exploded perspective view thereof.
Figure 46:
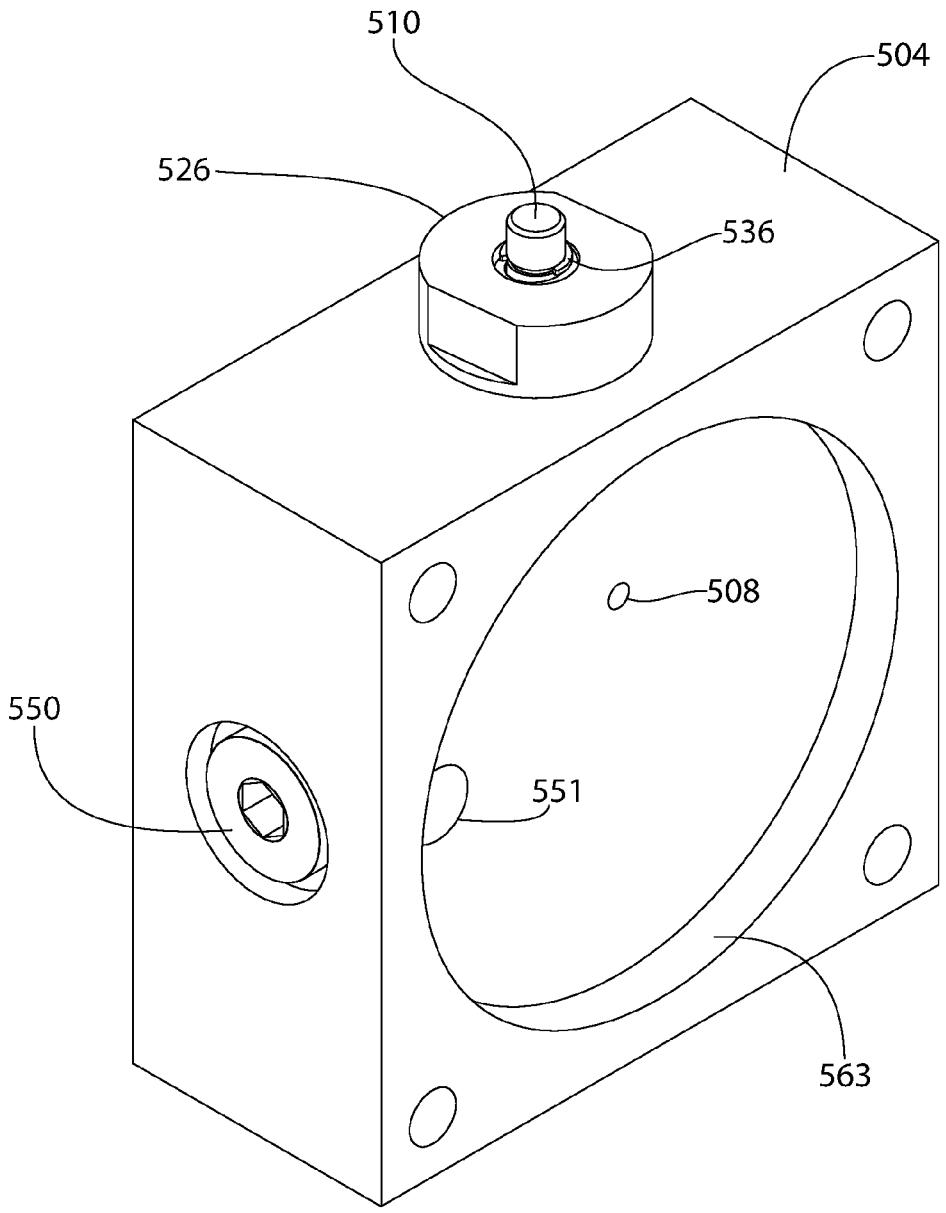
FIG. 46 is a first side perspective view thereof.
Figure 47:
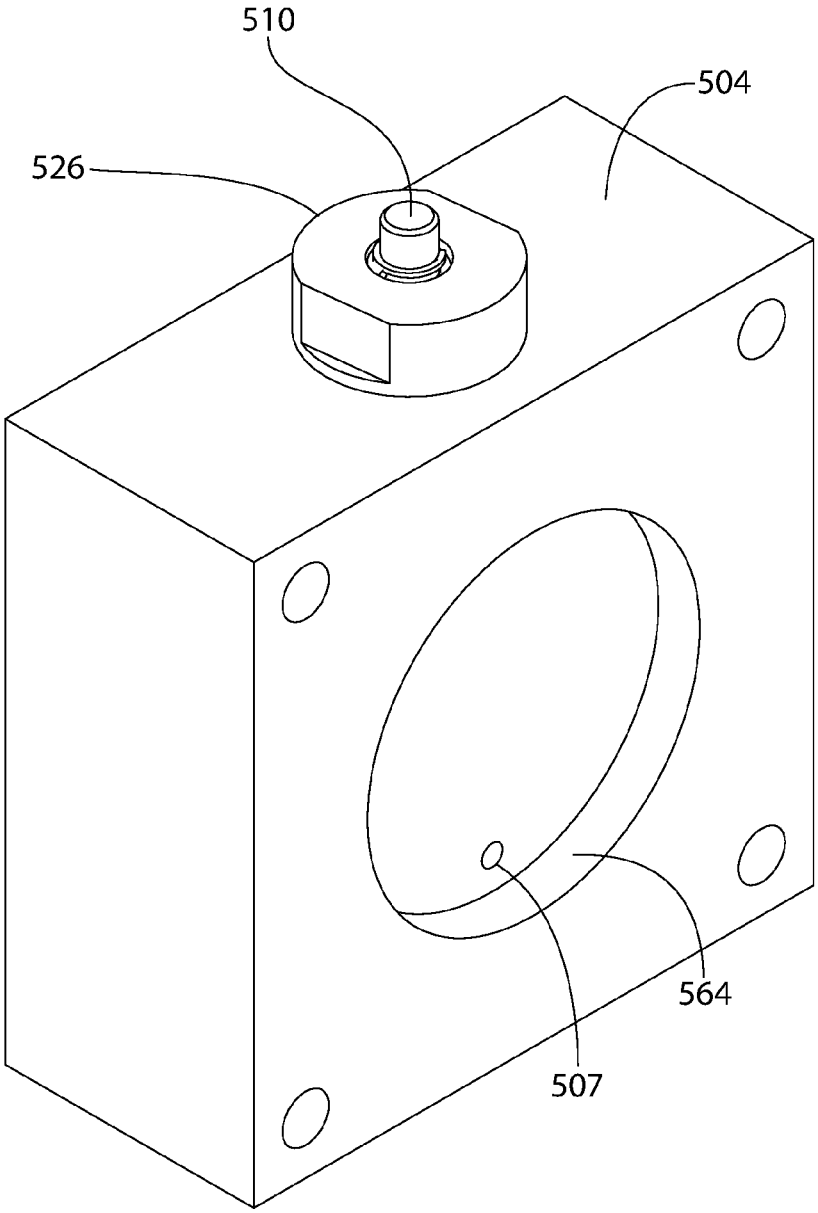
FIG. 47 is a second side perspective view thereof.
Figure 48:
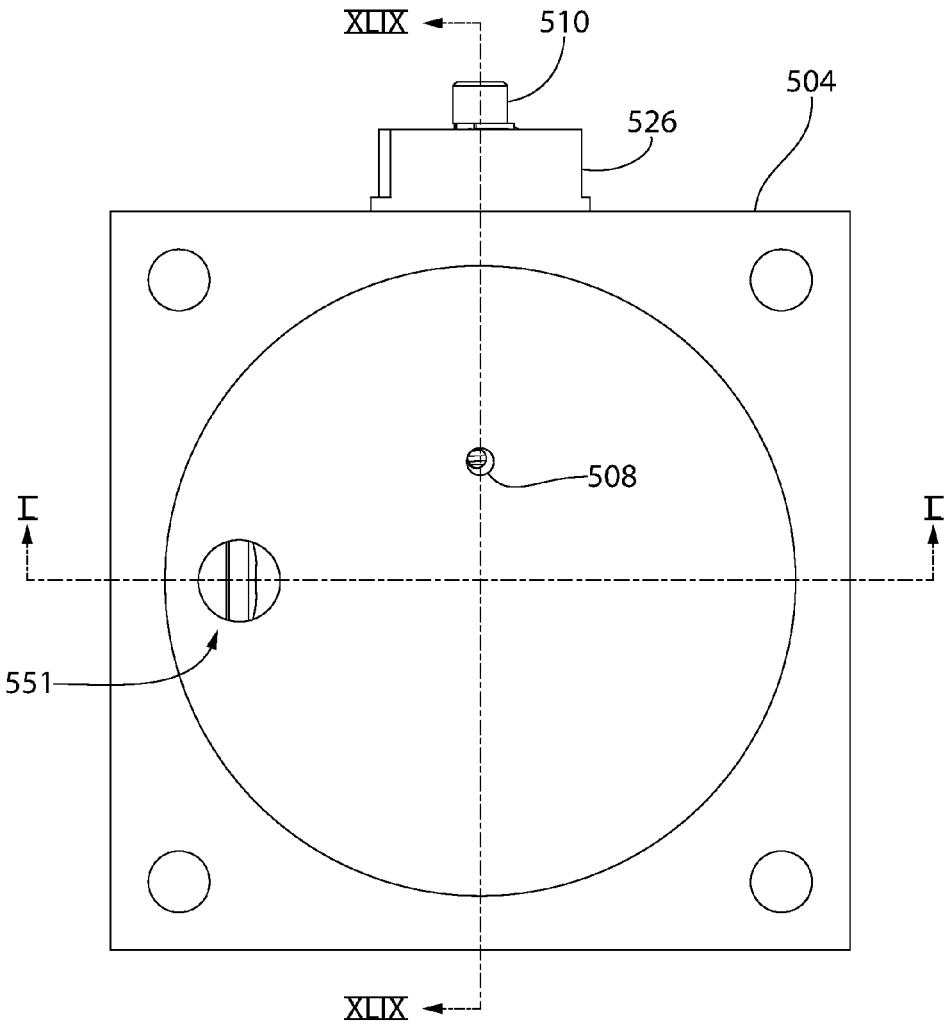
FIG. 48 is a front view thereof.

A generally cylindrical exhaust retainer 532 (see, e.g. FIGS. 45 and 53A-B) is positioned in the bottom of the axial central bore 506 of the manifold block 504. Retainer 532 has an axial through passage 533 and plurality of lateral flow openings 534 which communicate with the through passage 533. The exhaust retainer 532 nests inside the check body 503 as best shown in FIG. 44. The retainer 532 may have a diametrically enlarged head at the bottom end that may include chamfered sides to conform to the shape of the central axial passage 503 closed bottom end.

The pressure compensating valve 502 includes elongated cylindrical plunger 510 movable disposed in manifold block 504 for axial upward and downward movement between extended and retracted positions relative to the manifold block 504. Plunger 510 is biased in an upwards outward direction towards the extended position by return spring 511 toward toggle cam 133 pivotably mounted via pivot 513 to the manifold block 504 above the plunger. In this embodiment, the toggle cam 133 defines a valve operator whose position is changed by mechanism linkage 132 as previously described herein. The bottom end of spring 511 engages a socket disposed in the top of cap housing 526 and top end of the spring may be retained by a retainer clip 536 which engages an annular groove 537 in the plunger 510 (see, e.g. FIG. 54). The top end of the plunger 510 is acted on by the toggle cam 133 (i.e. cam surface 133*a*) and bottom end of the plunger acts on and engages check ball 147*c* as illustrated. Plunger 510 is alternatingly movable between (1) a lower unblocking position (see, e.g. FIG. 49B) to unseat the check ball 147*c* from its seat 147*c* to permit flow through the check valve, and (2) an upper blocking position (see, e.g. FIG. 49B) in which the ball 147*c* is seated to prevent or block flow through the check valve. Accordingly, plunger 510 is coaxially aligned with check valve 147 (and ball 147*c*) in one embodiment.

Figure 54:
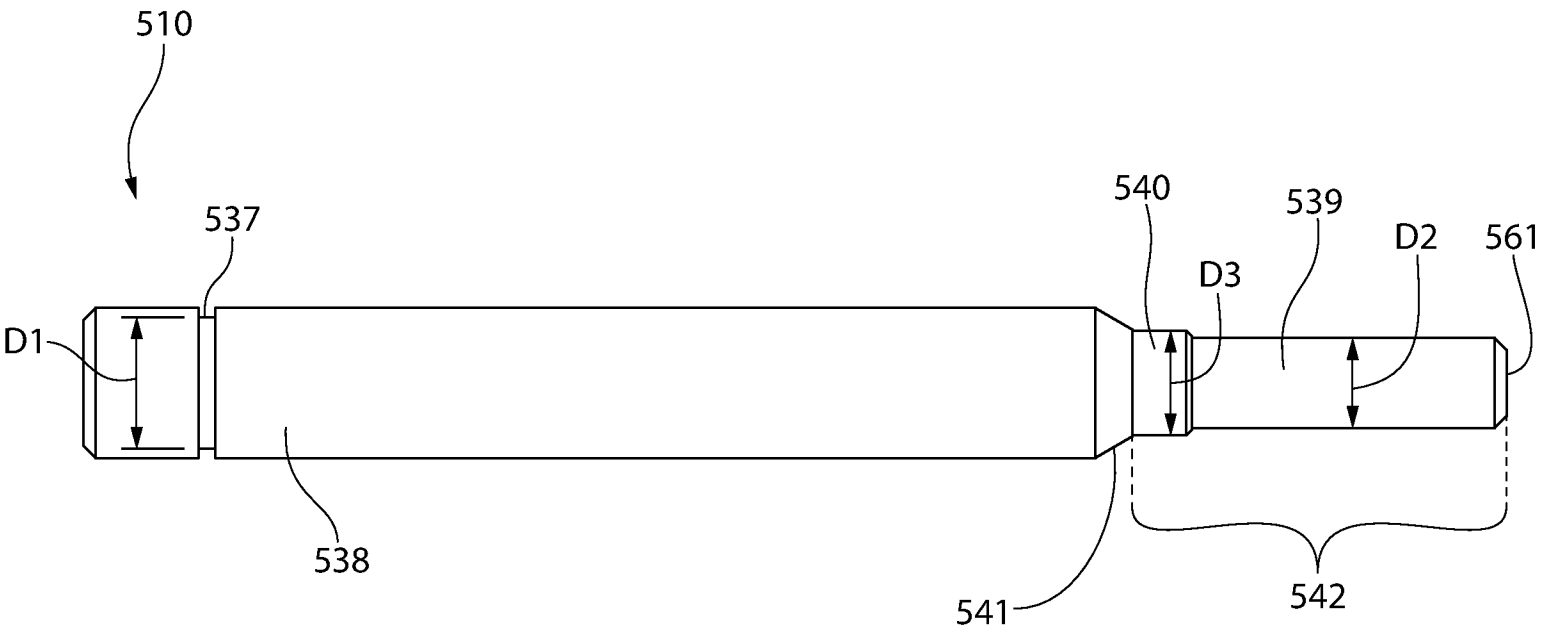
FIG. 54 is a side view of the plunger of the flow control valve assembly.

In one embodiment with reference to FIG. 54, plunger 510 includes an upper operating end 538 having a diameter D1 and a diametrically narrowed and stepped lower working end 542 of various diameters. The working end includes a terminal end segment 539 distal-most to the operating end and having a diameter D2, and an intermediate segment 540 spaced apart from the working end tip 561 of the plunger and adjoining the end segment 539. The terminal end segment 539 defines tip 561. The intermediate segment 540 has a diameter D3 which is larger than D2. Both D2 and D3 are smaller than D1. A frustoconical-shaped shoulder 541 forms a transition between the operating end 538 and working end 542 of plunger 510.

The working end 542 of plunger 510 interfaces with and is alternatingly projectable and retractable in a flow control orifice 543 defined by the head 525 of piston 514 (further described below and shown in FIG. 51A-C) to control the flow of the hydraulic fluid through pressure compensating flow control valve assembly 500 between hydraulic cylinder 102 and accumulator 106. The plunger 510 thereby provides a variable flow control orifice 543 in which the flow rate of hydraulic fluid depends on the position of the plunger in the orifice. Orifice 543 has a diameter D4 slightly larger than both diameters D2 and D3 to allow the working end 542 of plunger 510 to be received through the orifice. In one illustrative example, without limitation, orifice diameter D4 may be 0.180 inches, and the plunger working end diameters D2 and D3 may be 0.150 inches and 0.175 inches. In each instance, the flow area through flow control orifice 543 is defined by the diameter D4 minus diameters D2 or D3, as further described herein.

Pressure compensating valve 502 further includes flow control spring 512, a flow modulation device such as flow control piston 514, and flow control outer sleeve 515. The piston 514 is axially movable in a reciprocating quickly cycling fashion to alternatingly open and close the flow path between the hydraulic cylinder 102 and accumulator 106 when the flow control valve is in the open position with check ball 147 unseated. As best shown in FIGS. 51A-C and 52A-C, flow control piston 514 and sleeve 515 may each generally have a cylindrical tubular shape. Piston 514 has cylindrical sidewalls which define an internal flow control cavity 516 extending from and through bottom end 523 to top end 524 of the piston. The diameter of the flow control cavity 516 is smaller at bottom end 523 than the top end 524 and defines the flow control orifice 543 formed by a hole through piston head 525 at the bottom end, as illustrated. Similarly, flow control sleeve 515 has an open interior defining central passage 519 extending from bottom end 522 to top end 521. The diameter of the central passage 519 is smaller at bottom end 522 than the top end 521 forming an internal annular shoulder 560 of the sleeve. When the valve is assembled, the piston 514 nests inside sleeve 515 (i.e. passage 519) and is slideably movable therein with respect to the sleeve.

Flow control spring 512 is positioned inside axial central bore 506 of the pressure compensating flow control valve assembly 500 and acts on the piston 514. This biases the piston downwards inside the sleeve 515 in a direction towards the bottom of the valve axial central bore 506 (see, e.g. FIG. 49A). Spring 512 extends through both the piston and sleeve. The spring 512 is retained in the manifold block 504 by cap housing 526 removably mounted to the top end of the body in axial central bore 506. Cap housing 526 may include an upwardly/downwardly open central bore 527 through which the plunger 510 extends and is movable upwards/downwards therethrough. Return spring 511 is seated in the bore 527 around the upper portion of the plunger 510.

Plunger 510, piston 514, and ball check valve 147 are coaxially aligned and mounted in axial central bore 506 as shown for example in FIG. 44. Hydraulic fluid flows axially through these components and within the central passage parallel to the valve assembly centerline CL3 and both enters and leaves the central passage in a transverse direction to the centerline, as further described herein.

In one embodiment, flow control piston 514 includes circumferentially spaced apart lateral flow orifices 517 extending completely through the sidewalls of the piston from central passage 516. Similarly, flow control sleeve 515 includes circumferentially spaced apart lateral flow orifices 520 extending completely through the sidewalls of the piston from central passage 519. The outer surface of the piston sidewalls may include an annular slot 518 recessed into the sidewalls which is in fluid communication with the lateral flow orifices 517. Slot 518 extends only partially through the piston sidewalls.

The pressure compensating flow control valve assembly 500 further includes other valve appurtenances such as multiple seals 531 such as O-rings, an O-ring retainer 530 inserted into the cap housing 526 as shown, and check O-ring retainer 535. A bleed port 551 extending through the manifold block 504 and fluidly coupling the accumulator 106 to the ambient environment is provided for initially bleeding air from the hydraulic cylinder assembly. In one embodiment, the bleed port may be L-shaped; however, other shapes and orientations of a bleed portion may be used. A plug 550 which may be threaded into the manifold block 504 is provided which seals the bleed port 551 off during normal operation of the hydraulic cylinder assembly.

Operation of the hybrid pressure compensating flow control valve assembly 500 will now be briefly described. The bench auto-return and controlled descent features previously described herein function in the same general manner as before; the primary difference being in the hydraulic and air fluids flow control and path provided by the hybrid valve assembly. Accordingly, the flow schematic diagrams of FIGS. 38-40 remain applicable except plunger valve 122 shown therein is replaced by the present pressure compensating flow control valve assembly 500.

Figure 49A:
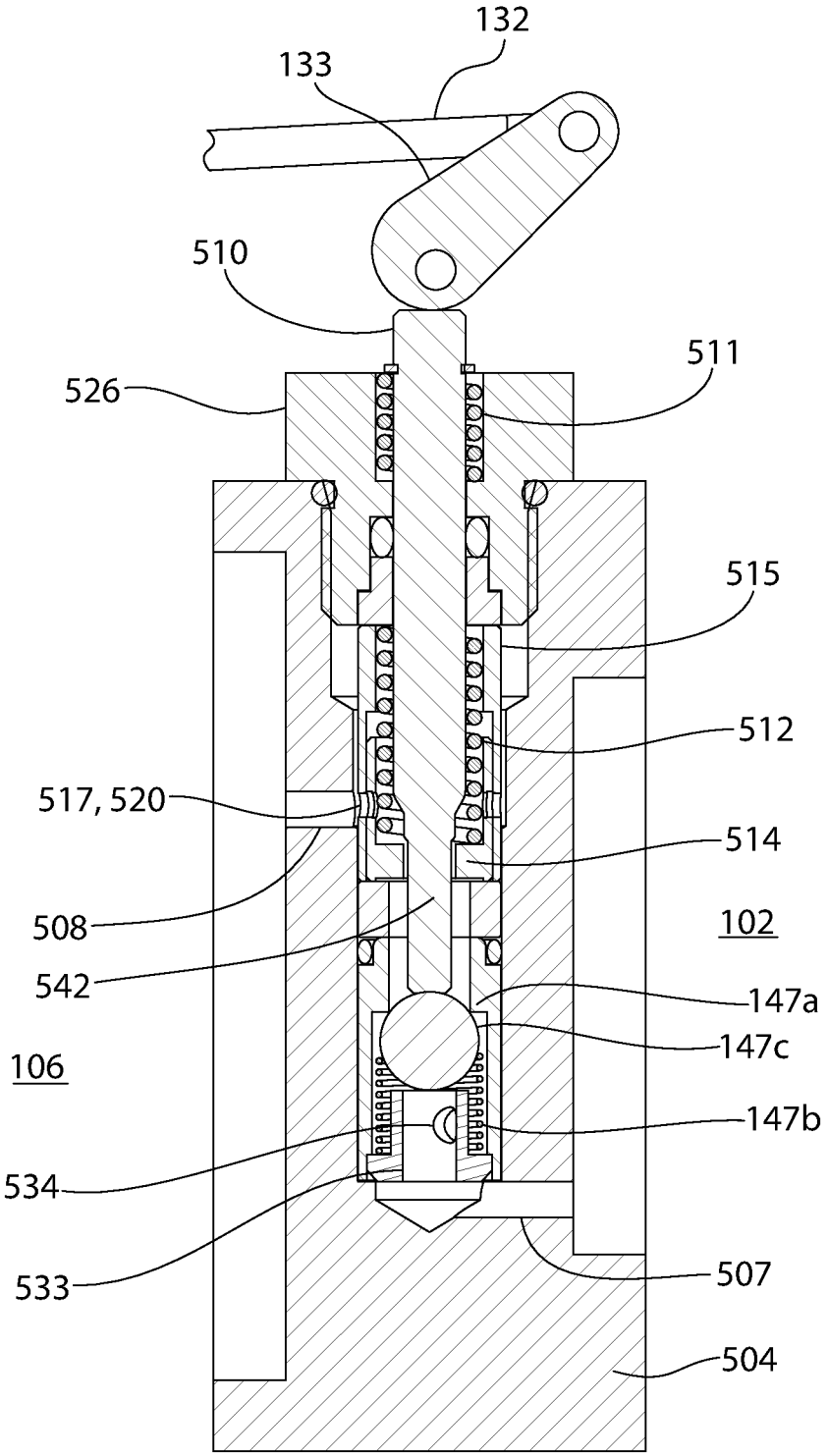
Figure 49B:
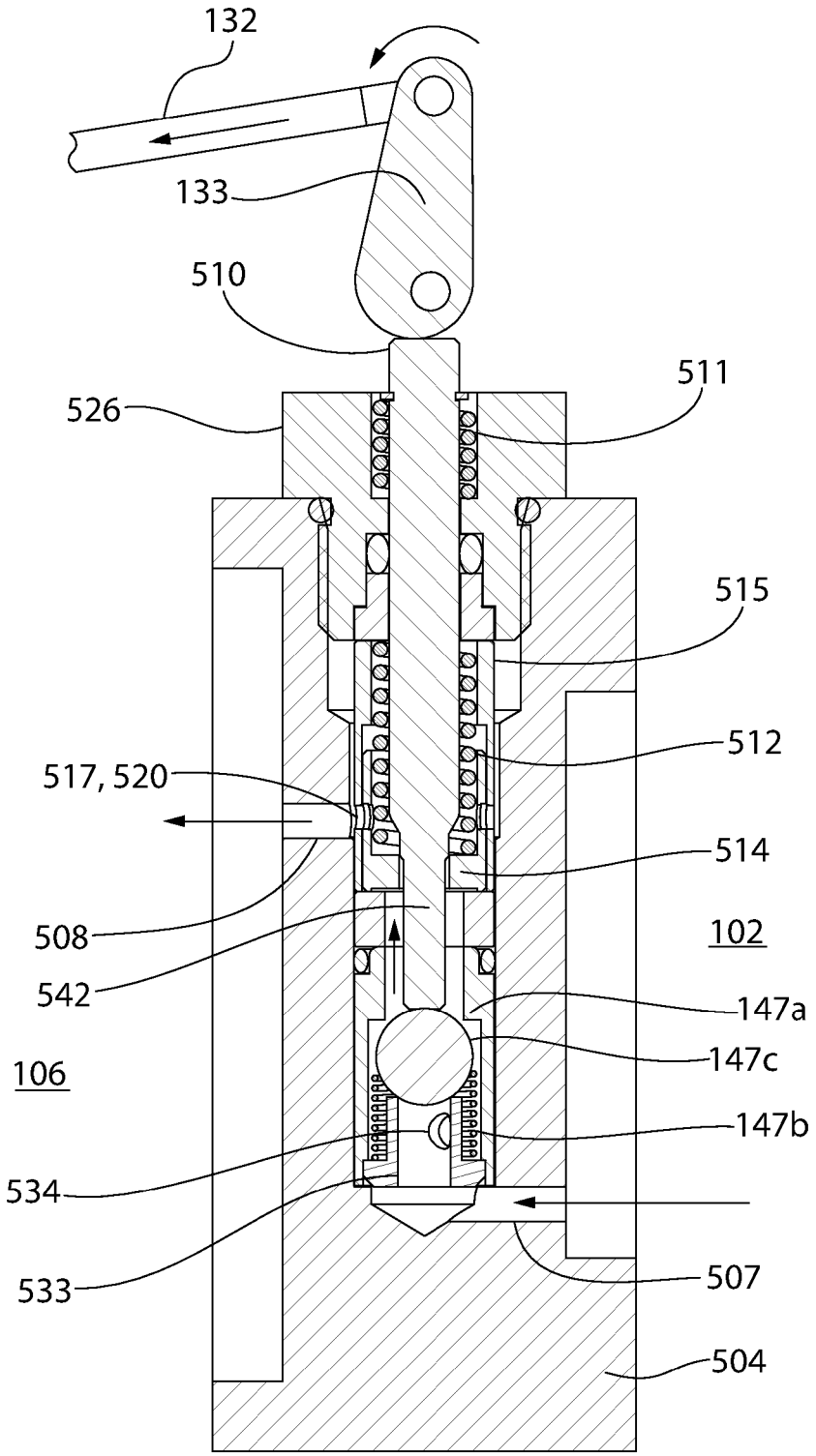

FIGS. 49A-D show sequential cross sectional images of the pressure compensating flow control valve assembly 500 during operation. FIG. 49A shows the valve assembly 500 in its initial position prior to a user seated on the bench initiating an escape scenario via actuation of the foot pedal 130. The hydraulic control system is in the state shown in FIG. 38A. Bench pad 50 is in the fully extended normal upper exercise position in which the exchange of hydraulic fluid 101 between the hydraulic cylinder 102 and accumulator 106 is stopped by a closed pressure compensating valve 502 and check valve 147. In this static state, plunger 510 is in the normally "valve closed" extended position and the cylinder rod 116 is fully extended and locked (bench in the full upright position). The flow control piston 514 is in it lower proximal position with piston head 525 abuttingly engaging the top of the check O-ring retainer 535. The lateral flow orifice 517 and annular groove/slot 518 of the flow control piston 514 are horizontally aligned with the lateral flow orifices 520 of flow control sleeve 515. It bears noting that the annular slot 518 eliminates the need for the lateral flow orifices 517 and 520 of the piston and sleeve respectively to be concentrically aligned to enable flow therethrough. Similarly, an annular gap is formed by clearance between the sleeve 515 and inside of the central axial cavity 506 of the flow manifold block 504 eliminating the need for the sleeve's lateral flow orifices 520 to be concentrically aligned with the accumulator port 508.

At this point in the bench descent operating process, the working end 542 of the plunger 510 is positioned in flow control orifice 543 of the piston 514. The working end tip 561 of the plunger is positioned proximate to (i.e. contacting or slightly spaced apart from) the check ball 147*c*. Check valve 147 is closed and its ball is fully biased upwards and seated on valve seat 147*a* via spring 147*b*, thereby blocking the flow path of and preventing hydraulic fluid from flowing from the hydraulic cylinder 102 to the accumulator 106 through valve 502. The hydraulic fluid 101 is pressurized by the weight of the user, added equipment weight of the bench pad assembly, and any free weights being held by the user at the time.

When the user then initiates an escape scenario as already described herein by pressing down on the foot pedal 130, the bench pad 50 and user will begin to descend at a regulated controlled rate as a result of the pressure compensating flow control valve assembly 500. The flow diagram of FIG. 38B is applicable to this stage in the benches' operation. The plunger 510 is pushed downwards via rotation of the toggle cam 133 to the "valve open" retracted position shown in FIG. 49B (noting that the operated end of the plunger need not be even flush with the outer surface of the manifold block 504 or recessed therein in the retracted position). The bottom tip of the plunger 510 if not previously contacting the check valve ball 147*c* engages and displaces the ball downwards pushing it off of its annular valve seat 147*a*. This opens flow control orifice 543 allowing hydraulic fluid flow in the path shown in FIG. 38B from the hydraulic cylinder 102, through the open check valve, into the pressure compensating valve 502, and finally then into the accumulator cavity. This causes the cylinder rod 116 to retract into the cylinder at a constant speed rate regardless of weight/force on the bench and cylinder rod. Because the pressure in the hydraulic cylinder 102 is initially greater than inside the piston flow control cavity 516 and air 103 in accumulator 106, hydraulic fluid flows through the lower port 507 and upwards through the check valve 147. The hydraulic fluid flows into exhaust retainer 532 from port 507 and laterally outwards therefrom through the lateral openings 534 of the exhaust retainer, around the ball 147*c*, and then upwards in the valve through the flow control orifice 543 and into the flow control cavity 516 of piston 514. At this point, the lowermost terminal end segment 539 of plunger 510 remains positioned in the flow control orifice 543, thereby defining a first flow area formed by the open annular space between the plunger and orifice.

It bears noting that the constant speed rate of descent of the bench pad 50 under compression is achieved by the upwards/downward axial reciprocating motion of the flow control piston 514, which in some embodiments may cycle on a nearly continuous basis as and until the bench moves from the upper position to lower escape position. When the piston is pressurized initially by the hydraulic fluid as described immediately above, the hydraulic fluid pressure acts on the bottom face (end 523) of the piston head 525 causing the piston 514 to move upwards against and compressing flow control spring 512 because the pressure on the face of the piston is greater than the initial pressure inside the piston flow control cavity 516 (see FIG. 49C). This temporarily partially or fully closes the port 508 to the accumulator chamber 104 since the lateral flow orifices 517 and annular slot 518 of the piston 514 become horizontally misaligned with the lateral flow orifices 520 of sleeve 515, thereby partially or fully blocking flow from the piston flow control cavity 516 to the port 508 (see, e.g. FIG. 49C). Hydraulic fluid flow from hydraulic cylinder 102 into the pressure compensating valve 502 is thus restricted and minimized, thereby reducing the bench descent rate. As further seen in FIG. 49C, the diametrically larger flow intermediate segment 540 of the plunger 510 is now positioned in the flow control orifice 543 of the piston 514, creating a second flow arear between the orifice and plunger which is less than the first flow area created when the terminal end segment 539 was positioned in the orifice. This further acts to instantaneously reduce hydraulic fluid flow and slow the bench descent rate.

Figure 49C:
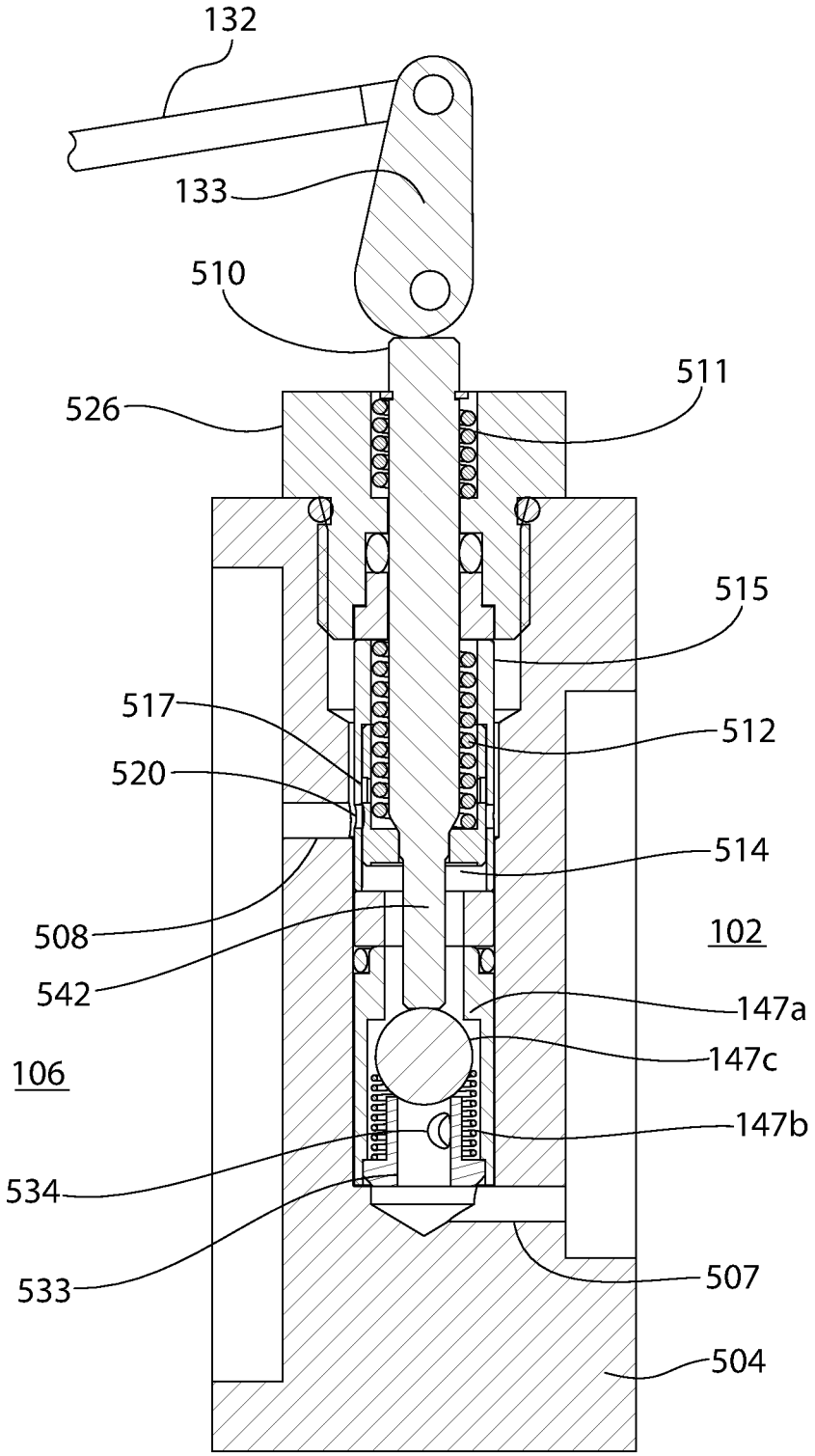
Figure 49D:
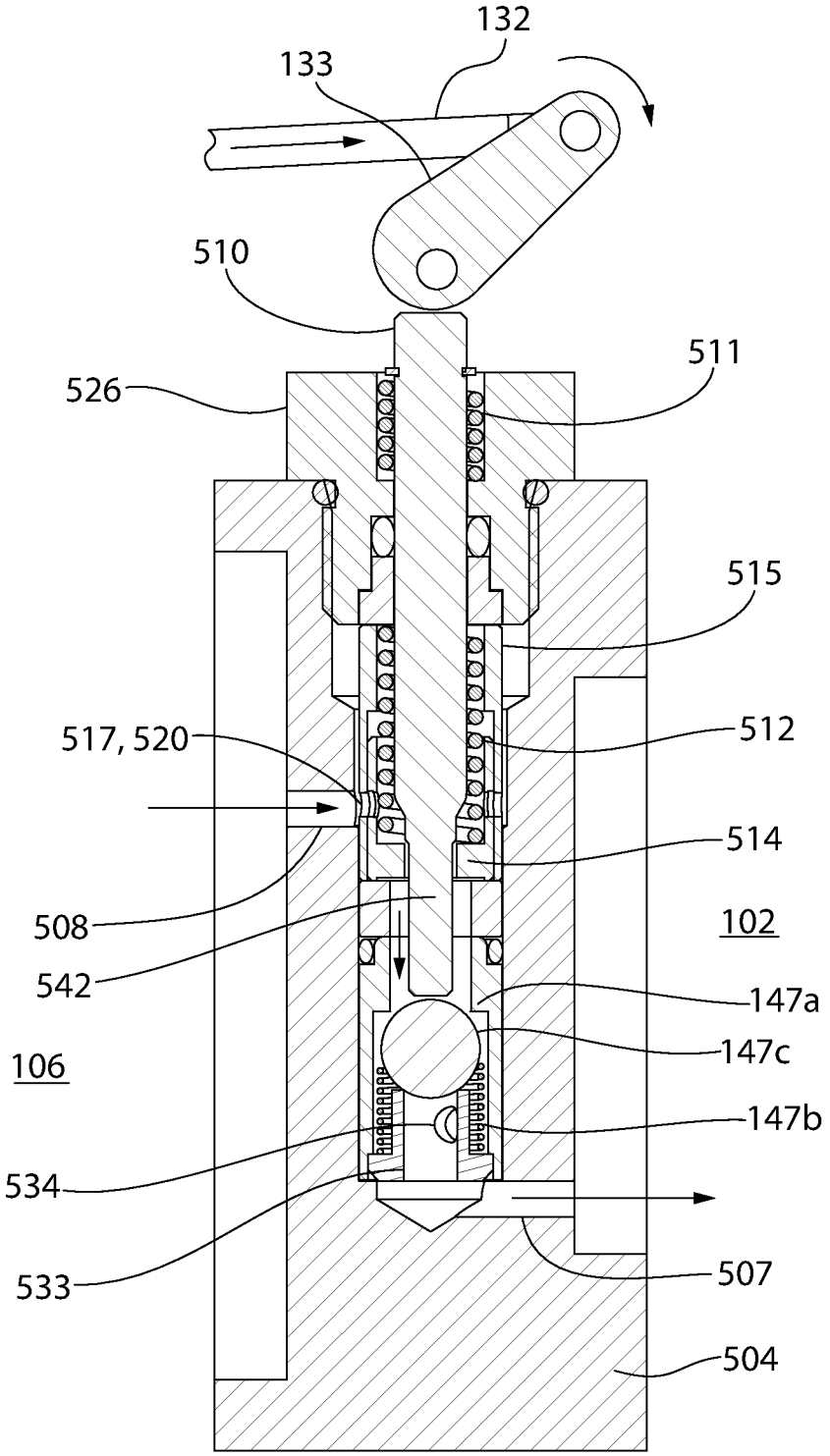
Figure 50:
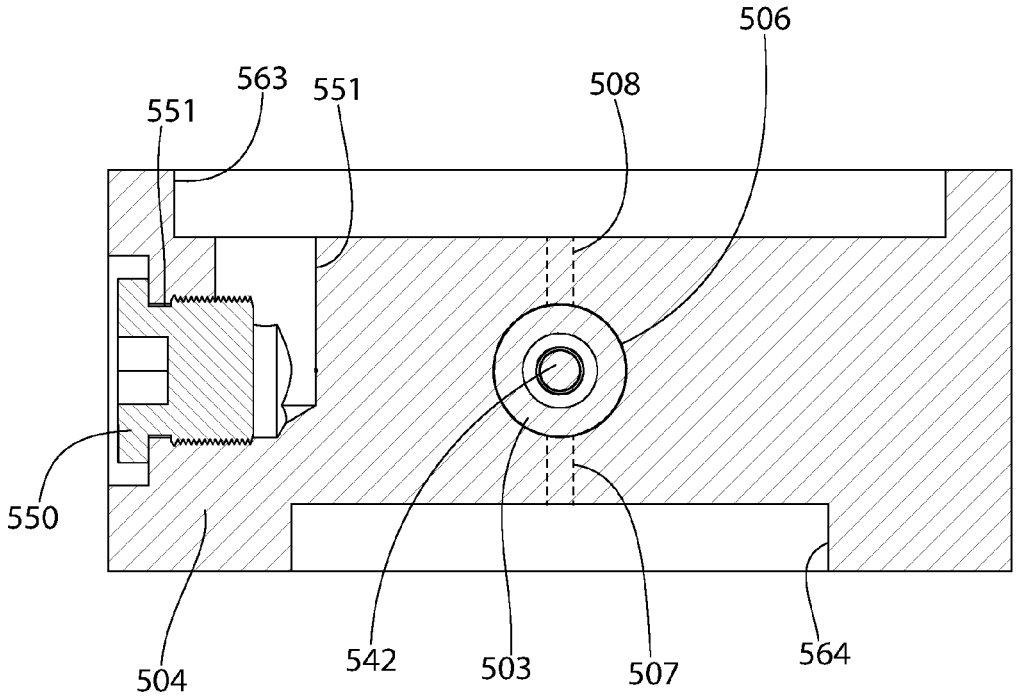
FIG. 50 is a top cross sectional view of the flow control valve assembly taken from FIG. 44.
Figure 51A:
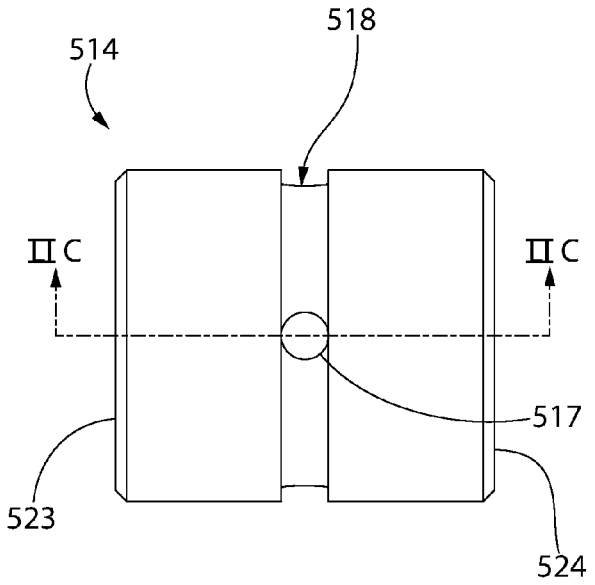
FIG. 51A is a side view of the piston of the flow control valve assembly.
Figure 51B:
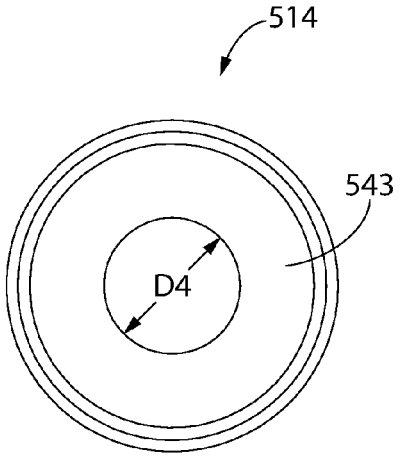
FIG. 51B is an end view thereof.
Figure 51C:
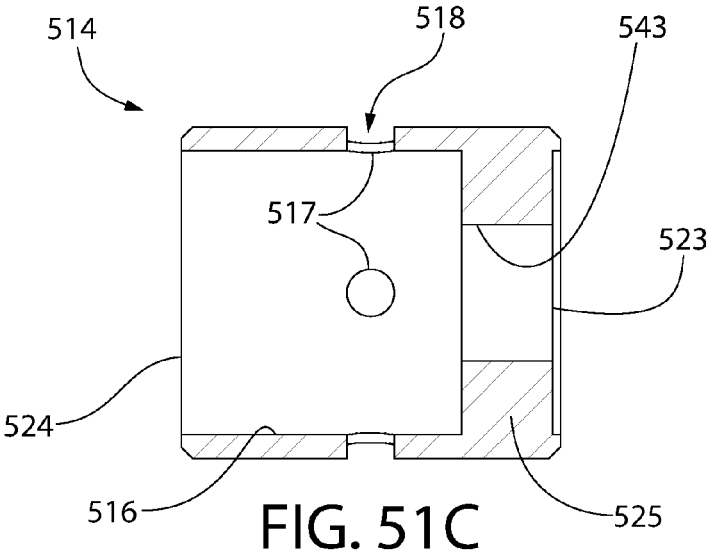
FIG. 51C is a side cross sectional view thereof.
Figure 52A:
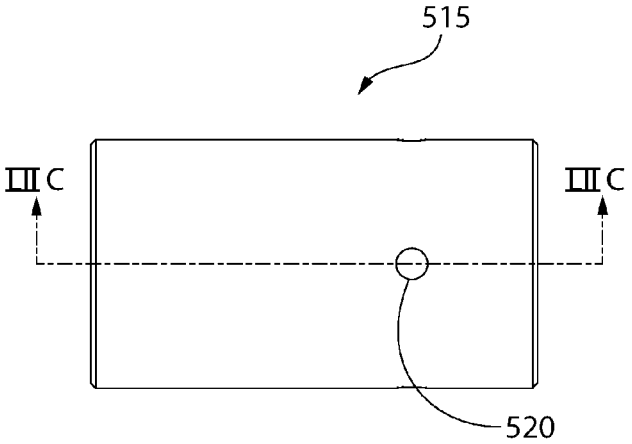
FIG. 52A is a side view of the piston sleeve of the flow control valve assembly.
Figure 52B:
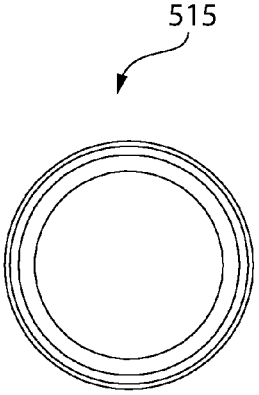
FIG. 52B is an end view thereof.
Figure 52C:
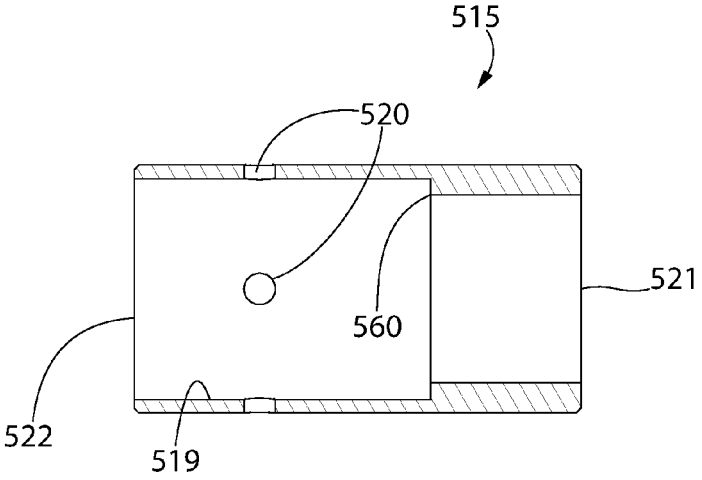
FIG. 52C is a side cross sectional view thereof.
Figure 53A:
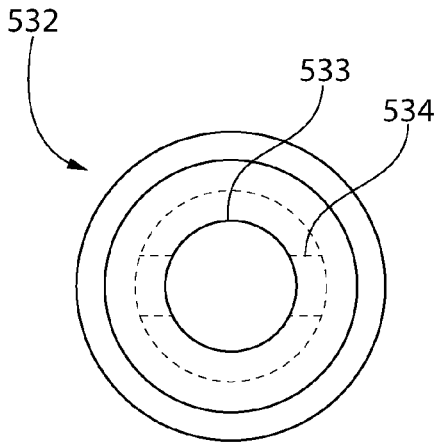
FIG. 53A is an end view of the exhaust retainer of the flow control valve assembly.
Figure 53B:
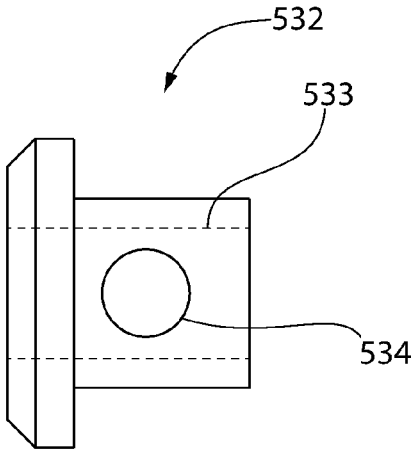
FIG. 53B is a side view thereof.

It bears noting that the maximum upward travel of the piston 514 within outer sleeve 515 is limited by the vertical gap shown in FIG. 48A between the top end 524 of the piston and internal annular shoulder 560 of the sleeve (see also FIGS. 51 and 52) which is formed when the piston is in its lower proximal position relative to check valve 147. In FIG. 49C, this gap is eliminated when the piston 514 is in its upper distal position relative to the check valve.

As the pressure in the piston internal flow control cavity 516 becomes equalized and balanced with the hydraulic pressure on the hydraulic cylinder side of the piston head 525, the biasing action of the flow control spring 512 now is enable to actively press the flow control piston 514 back down to its lower proximal position in a downward movement which again opens the accumulator port 508 as the lateral flow orifices 517, 520 of the piston and outer sleeve 515 become horizontally aligned again. This allows greater hydraulic fluid flow from the hydraulic cylinder 102 into the accumulator chamber 104. This causes the cylinder rod 116 compression/retraction rate and bench descent rate to increase slightly temporarily until the pressure in the piston internal flow control cavity 516 decreases enough to move the flow control piston upward again as describe above when the piston once again partially or fully closes the accumulator port 508 to hydraulic fluid flow.

This foregoing reciprocating piston motion and feedback loop is achieved by the unique design of the pressure compensating valve 502 that provides a constant hydraulic cylinder compression/retraction rate regardless of how much pressure/force is applied to the cylinder rod by the bench and user's weight. Advantageously, this minimizes the possibility of injury to the user caused by rapid dropping and stopping of the bench. It bears noting that the foregoing cyclical motion of the reciprocating piston occurs relatively rapidly and repeats sequentially during the time that the bench pad 50 is in the process of descending until the lower escape position is reached.

Figure 39:
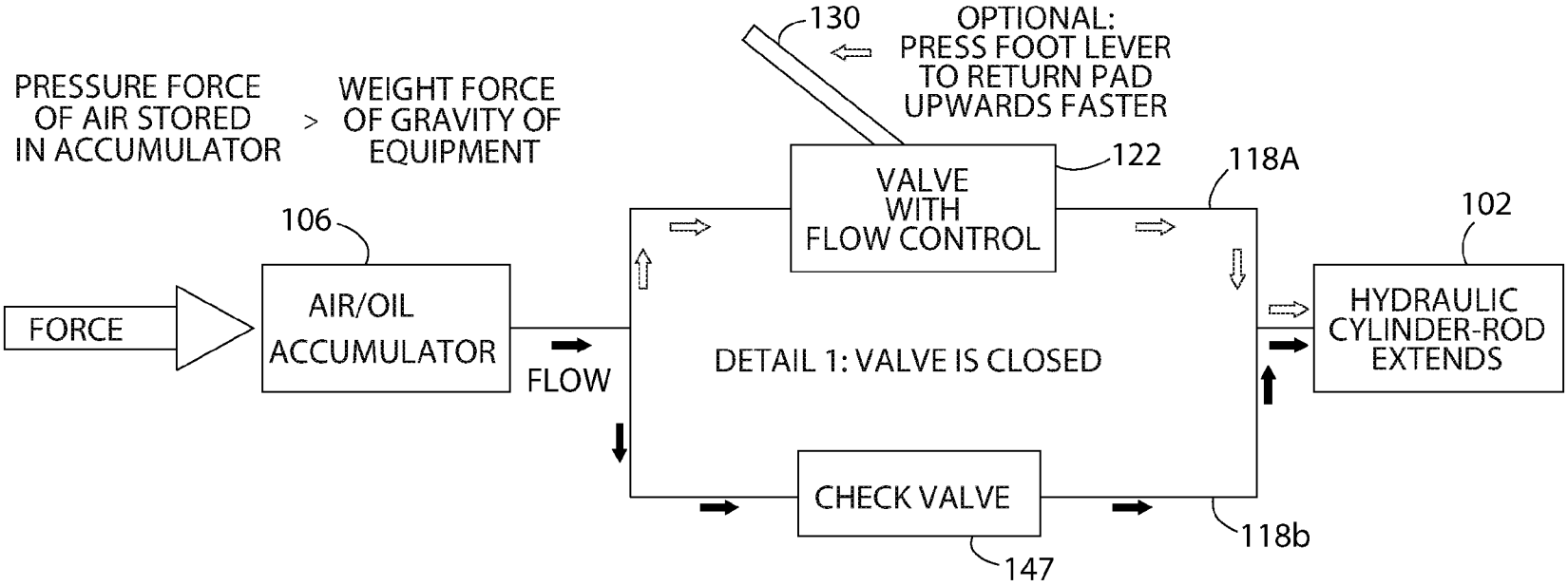
FIG. 39 is a schematic flow diagram of the hydraulic control system in a state when the automatic back pad return mechanism is activated and the back pad is in the process of ascending toward an uppermost exercise position in which hydraulic fluid flows from the accumulator to the hydraulic cylinder via a check valve and/or an open plunger valve.

After the bench pad 50 reaches it lowermost decline escape position, the user may then exit the bench and release the foot pedal 130 to activate the bench auto return feature. The flow diagram of FIG. 39 is applicable to this stage in the benches' operation which initiates the bench auto-return feature. The pressure compensating flow control valve assembly 500 now returns to the position shown in FIG. 49D. When the cylinder rod 116 becomes unloaded (user removed from bench), and is in partial or full compression/retraction into the cylinder 102, and plunger 510 is returned upward via urging by return spring 511 back to its normally extended position, the pressurized hydraulic fluid in and from the accumulator 106 is forced back through check valve 147 causing the cylinder rod to extend and lock in the fully extended position. The bench pad 50 return Because the pressure of the hydraulic fluid in the accumulator is greater than on the hydraulic cylinder side of the pressure compensating valve 502, the fluid from the accumulator is able to displace downward and unseat the ball 147*c* of the check valve 147 permitting flow through the valve to the hydraulic cylinder as shown despite the fact that the plunger 510 is upward and not forcing the ball from its seat. Once the pressure balances between the hydraulic cylinder and accumulator side of the pressure compensating valve 502, the ball will again return upward via the spring and seat, thereby closing the flow path through the valve as seen in FIG. 48A at the beginning of the process.

Although the flow control valve assembly 500 is shown for convenience of description without limitation in a vertical oriented herein, it will be appreciated that the valve assembly may be used in any other suitable angular orientation because the foregoing valve components do not rely on gravity for operation of the valve as described above. The piston 514, plunger 510, and ball check valve 147 are spring biased which allows multiple possible orientations of the valve assembly while still retaining its full functionality. For example, the hydraulic cylinder assembly 100 shown in the weight lifting bench 20 of FIGS. 1-16 herein is disposed obliquely to the vertical and horizontal. Accordingly, the flow control valve assembly 500 is expressly not limited in its applicability to any particular orientation.

Adjustable Flow Control Valve

In an example of a manual type speed control mechanism to regulate the rate of descent of the bench pad 50 shown in FIGS. 32-37, a manually adjustable flow control plunger valve 150 assembly may be provided instead of or in addition to the speed stop 140 described above for fail safe redundancy. The pressure compensating valve 146 is omitted in this design. The adjustable flow control plunger valve 150 may be similar to plunger valve 122, but also includes a rotary stop cam 197 configured to permit external adjustment of the amount of hydraulic fluid flow between the hydraulic cylinder 102 to the accumulator 106. This allows the user to manually adjust the maximum flow rate of hydraulic fluid that passes through the valve to in turn control the rate at which the bench drops when the foot lever 130 is actuated. In one embodiment, the rotary stop cam 197 may be a rotary type knob having a working end inside the valve which interfaces with the plug assembly 152, as further described below.

Referring still to FIGS. 32-37, a hydraulic cylinder assembly 100 comprising adjustable flow control plunger valve 150 is shown having an accumulator 106 which is not coaxially aligned with the hydraulic cylinder 102 like that shown in FIG. 22. Instead, the accumulator 106 is mounted alongside the hydraulic cylinder such as on the top (shown), bottom, or either lateral side such that the axial centerline CL2 of accumulator 106 is parallel to but spaced radially apart from axial centerline CL1 of the hydraulic cylinder 102 in a "piggy-back" type mounting arrangement. In other possible embodiments, the accumulator 106 may be disposed at a 90 degree or oblique angle to the hydraulic cylinder. In yet other possible embodiments, the accumulator 106 may be mounted separately from the hydraulic cylinder 102 in any position and on any appropriate part of the frame 21, and further fluidly connected to the hydraulic cylinder by a flow conduit such as tubing or piping. The mounting position and arrangement of the accumulator with respect to the hydraulic cylinder is not limiting of the invention.

Referring to FIGS. 32-37, the adjustable flow control plunger valve 150 may be mounted on the front or foot end of the hydraulic cylinder 102 as shown. Valve 150 has an axially elongated body 150*a* comprising a cylindrical front end 300 and a diametrically enlarged rear end 301. Rear end 301 is inserted into the open front end 302 of hydraulic cylinder 102 and interfaces with the piston head 114. A pair of annular seals 303 such as O-rings seals the interface between the valve body and cylinder 102 to prevent outleakage of hydraulic fluid. A snap ring 304 fitted to an annular groove 305 on the interior of the hydraulic cylinder 102 proximate to rear front end 302 to removably lock the rear end 301 of the valve body 150*a* to the cylinder.

In the present embodiment, the valve 150 has a spring-biased cylindrical plug assembly 152 comprising elongated shaft 152*a* disposed in an axial bore 159 extending completely through valve body 150*a* from front to rear end. A portion of bore 110 fluidly coupled to the hydraulic cylinder 102 forms a flow conduit between the accumulator 106 and cylinder. Shaft 152*a* is concentrically aligned with the bore 110 of the hydraulic cylinder 102. The shaft includes a diametrically narrow front end 152*b* and opposing threaded rear end 152*c* for threadable coupling to threaded bore 309 in the front end of plunger 155. Front end 152*b* is axially and removably insertable into flow orifice 156 formed through cylindrical valve seat member 309 of the valve seat assembly. An annular seal 307 such as an O-ring disposed around orifice 156 and between a cylindrical end cap 311 and valve seat member 309 is engaged with the terminal front end 152*b* of plug assembly shaft 152*a* when the flow control plunger valve 150 is in a fully closed position.

Compression spring 308 biases plug assembly 152 rearward towards the hydraulic cylinder 102 and closed position of flow control valve 150. External snap ring 306 fitted to the plug assembly shaft 152 engages the rear end of spring 308 and an opposite front end of the spring engages an annular seat formed in axial bore 159. An annular seal 313 between the axial bore 159 and shaft 152 at the front end of spring 308 prevents leakage of air and hydraulic fluid along the shaft outwards from the valve 150. Seal 313 may comprise two or more seals of the same or different type.

In one embodiment, the check valve 147 may be disposed in the valve seat assembly. The check valve which may be a ball type check valve in one embodiment that resides in a flow conduit 314 which extends completely through the valve seat member 309 and end cap 311. Flow conduit 314 fluidly communicates with the flow conduit portion of axial bore 159 (i.e. active portion between annular seal 313 and hydraulic cylinder 102) to form a flow path from the hydraulic cylinder through the check valve 147, and in turn to the accumulator 106 via flow conduit 153. Check valve 147 includes valve seat 147*a*, ball 147*c*, and spring 147*b*. The ball and spring may be movable disposed in an outer sleeve 147*d* in one embodiment.

The end cap 311 of the valve seat assembly traps and holds the valve seat member 309 and check valve 147 in the rear open end of axial bore 159 in the valve 150. A snap ring 312 fitted to the valve body 150*a* adjacent bore 159 locks the valve seat assembly into the valve 150. An annular seal 310 may be provided to seal the valve seat member 309 to valve body 150*a* inside bore 159, thereby ensuring flow exchange between the accumulator 106 and hydraulic cylinder 102 is either through the axial bore 159 or check valve flow conduit 314.

Referring to FIGS. 32-37, flow control valve 150 fluidly communicates with the accumulator 106 via a flow conduit 153 extending from the internal flow conduit portion of axial bore 159 in the valve 150 housing the plug assembly 152 to the accumulator chamber 104. Part of flow conduit 153 is therefore transversely oriented to the cylinder 102. The check valve 147 as shown is physically and fluidly disposed between the bore 110 of the hydraulic cylinder 102 and flow conduit 153 leading to the accumulator 106.

An actuator 154 is mounted on the front foot end of the adjustable flow control plunger valve 150 which includes an elongated and axially slidable cylindrical stem or plunger 155 partially disposed inside the valve. Plunger 155 is connected to the plug assembly 152 at one end internal to the valve 150 and to mechanical linkage 132 at the opposite end which protrudes outwards beyond the valve body. In this embodiment, the mechanical linkage 132 is shown in the form of an extension spring having one end loop connected to a through aperture in plunger 155 and an opposite end loop that connects to the lever arm 131 of the foot lever 130. Linear movement of plunger 155 in opposing axial directions via the foot lever in turn linearly moves the plug assembly 152 in the same manner to open or close the plunger valve 150.

With particular reference to FIGS. 34-37, the plunger 155 of plunger valve 150 is mounted inside an axial passageway 157 formed inside and through the rotary stop cam 197 for sliding movement. Rotary stop cam 152 includes an enlarged circular operator head 190 disposed outside the valve body 150*a* and an elongated cylindrical stem 191 inserted through a complementary configured end portion of axial bore 159 formed in the front foot end of the valve body 150*a* opposite the hydraulic cylinder 102. The stem 191 has a first diameter sized for insertion into bore 159 and operator 190 has a second diameter larger than the stem 191 and bore 159 such that the operator is not insertable into the bore and remains outside the valve body.

The rotary stop cam 197 cooperates with the operating stem 155 to limit the amount that the plunger valve 150 can be opened when the foot lever 130 is fully actuated (i.e. depressed downwards towards the floor). To achieve this, the stem 191 of plunger 155 includes a partial helical cam groove 192 extending partially around the circumference of the stem which receives a lateral cam follower pin 158 therein. Cam groove is obliquely oriented with respect to centerline axis CL1 of the hydraulic cylinder 102. Pin 158 is transversely mounted to axis CL1 in the valve body 150*a*. The pin 158 partially protrudes into axial bore 159 in the valve body that receives stem 191. The stem 191 advances or retracts axially by a small distance each time the actuator head 190 is rotated (depending which direction the head is turned) via cooperation between the cam groove 192 and cam follower pin 158.

The free end of the rotary stop cam stem 191 opposite operator head 190 defines a vertical annular stop surface 194 which faces towards hydraulic cylinder 102. Surface 194 interacts with a mating vertical annular abutment surface 195 defined by a diametrically enlarged washer 193 abuttingly engaging the rear end of the plunger 155 in axial bore 159 opposite the end of the plunger with through hole coupled to mechanical linkage 132. Washer 193 forms an operable part of plunger 155 being fixedly secured thereto and trapped between the rear end of the plunger and step 315 in shaft 152*a* between diametrically smaller front end 152*c* and main portion of the shaft. When the plunger valve 150 is in a closed position, an axial gap 196 is formed between the stop and abutment surfaces 194, 195. The gap closes when valve 150 is opened causing stop surface 194 to abuttingly engage abutment surface 195. It bears noting that the washer 193 engaged with the rear end of plunger 155 further functions to prevent the mechanical linkage 132 connected to the opposite end of the plunger from completely pulling the plunger out of the valve body via the mutual engagement between the stop and abutment surfaces 194, 195. An annular seal 316 seals the rotary stop cam stem 191 to the axial bore 159 of the valve body 150*a* to prevent fluid or air leakage therebetween.

The axial position of the stop surface 194 is adjustable by the user via rotating actuator head 190 which activates the cam and follower features described above. The position of stop surface 194 limits the amount that the plunger 155 and plug assembly 152 connected thereto can move axially via mutual engagement between the stop and abutment surfaces 194, 195 when gap 196 is closed. This in turn limits the degree to which the working end of plug assembly 152 is inserted or removed from the flow orifice 156 at the hydraulic cylinder, thereby in effect limiting the amount that the plunger valve 150 is opened or closed which controls the flow rate of hydraulic fluid through the valve and importantly the drop rate of the bench pad 50. The greater amount that the rotary stop cam stem 191 is inserted into the valve body 150*a*, the lower the flow rate of hydraulic fluid through the flow orifice 156, and vice-versa.

The safety feature of a controlled bench pad 50 drop rate may be achieved in one possible approach by design of the circumferential extent or length of the helix of the helical cam groove 192 based on the foregoing discussion. The cam stem 191 can only be inserted or withdrawn from the valve body 150*a* by an amount commensurate with the extent or length of the groove 192 in which the cam follower pin 158 travels. A maximum safe amount that the valve 150 may be opened which controls drop rate of back pad 50 is controlled by preselecting a circumferential extent/length of the cam groove 192 at the factory such that the pad will drop slow enough for a heavy user to avoid too rapid a descent and sudden stop when the bench fully lowers in the escape position, yet still function to allow the bench pad to drop if a light user is lifting weights on the bench. Other means for controlling the maximum degree to which the valve 150 may be opened to cause the back pad 50 to drop at a safe rate may be used.

Operation of the adjustable flow control plunger valve 150 will now be briefly described. In use, the adjustable flow control plunger valve 150 is normally spring biased into the closed position which cuts off flow of hydraulic fluid from the cylinder 102 to the accumulator 106 (see, e.g. FIGS. 34 and 35). The plug assembly 152 is shown with the narrow front end 152*b* of plug assembly shaft 152*a* inserted into the flow orifice 156 between the hydraulic cylinder 102 bore and portion of the flow conduit 153 internal to the valve.

Valve 150 operates in a similar manner to plunger valve 122 described above and shown in the flow diagrams of FIGS. 38A-B. The plug assembly 152 in the present embodiment however is concentrically aligned with the hydraulic cylinder bore 110 instead of disposed at a 90 degree angle. In sum, pressing the foot lever 130 downwards pulls the mechanical linkage 132 (an extension spring in this embodiment) forward towards the front of the bench, thereby axially withdrawing the plug assembly 152 from the internal flow orifice 156. The plug assembly 152 is configured such that the rate of hydraulic fluid flowing through the valve 150 may be regulated by the degree to which the valve is opened via the foot lever.

The maximum amount that the valve 150 is able to open when actuated can be adjusted by the user in advance via the rotary stop cam 197 which acts as a speed limit stop to restrict the axial motion of the plunger 155, as described above. In short, rotating the rotary stop cam 197 in opposing directions moves the annular stop surface 194 of the stop cam closer or farther away from abutment surface 195 of the plunger assembly, thereby adjusting the width of the control gap 196 therebetween. When the foot lever 130 is fully depressed to implement an escape action, the gap 196 is eliminated as the plunger 155 moves axially towards the front of the bench bringing surfaces 194, 195 into contact. This restricts the amount that the plug assembly shaft 152*a* is withdrawn from the flow orifice 156 in the valve seat assembly to limit the flow rate of hydraulic fluid from the cylinder 102 to the accumulator 106. The greater the valve 150 opens, the faster the back pad 24 will drop and vice-versa thereby controlling the rate of descent of the pad. The adjustable flow control plunger valve 150 is moveable between a fully open position allowing full flow, a closed position stopping flow, or a throttled position therebetween by action of the foot lever 130. Preferably, the rotary stop cam 197 is designed via the provided length of the cam groove 192 thereon as described above to limit the maximum width of the control gap 196 which will always provide a safe controlled drop rate of the back pad 24 regardless of any adjustments made by the user. This is considered an important safety feature not heretofore provided by known weight lifting bench mechanisms.

It bears noting that foot lever 130 and mechanism linkage 132 although in the form of a spring in this non-limiting embodiment operate in the same manner and interact with the plunger 155 to open/close the plunger valve 150 as in the pressure compensating valve assembly 145 described herein.

Bench Pad Auto-Return Feature

According to one aspect of the invention, an auto-return system is provided which automatically returns the back pad 24 to its uppermost incline/exercise position from a lower exercise position or after a full decline escape scenario. FIG. 39 is a schematic flow diagram showing the hydraulic fluid flow path and circuit during the back pad auto-return system mode of operation. The accumulator 106 described herein provides one means for returning the back pad upwards, as explained below.

As already described herein and shown in FIGS. 38A-B, the descending operation is first initiated by the user pressing the foot lever 130 downwards which lowers the back pad 24 to the lower incline or decline position. When the user now gets off the bench equipment with the back pad 24 in its lower position, the user releases the spring-biased foot lever 130 which automatically returns to the upward unactuated position that in turn moves the plunger valve 122 (or alternatively adjustable plunger valve 150 if provided instead) back to its closed position via the mechanical linkage 132. Referring to the hydraulic flow diagram of FIG. 39, at this point in the process the force from the pressurized air stored in the accumulator 106 now is greater than the gravity force from the weight of the equipment without the user pressing against the back pad 24. This is accomplished by initially pressuring the air in the accumulator 106 to a pressure which exceeds the bare weight of the bench pad structure alone without a user seated thereon. The pressurized air forces the hydraulic fluid 101 in the accumulator 106 to bypass the plunger valve 122 (now closed), and flow back to the hydraulic cylinder 102 through a check valve 147. This extends the cylinder rod 116 from its prior retracted position when the back pad 24 is in the lower exercise or escape position. As the rod extends, it exerts a force on the bottom end of back pad rear strut 42 causing the strut operably coupled by the back pad 24 to move back upwards with the pad. The rear strut 42 pivots about pivot axis P1, causing the angle between the strut relative to the ground and frame 22 to increase, thus raising the back pad 24 to the upper exercise position.

In addition to relying on the reverse flow path formed by the check valve 147 to return the back pad 24 upwards, the user may optionally also press downwards on the foot lever 130 to open the plunger valve 122 and speed up the bench return. This will create a dual reverse flow path for the hydraulic oil 101 from the accumulator 106 back into the hydraulic cylinder 102 as shown in FIG. 39. This alterative flow path back in a reverse direction through plunger valve 122 to the hydraulic cylinder 102 is represented by open flow arrows and the normal automatic flow path through the check valve 147 to the cylinder is represented by the closed (solid) flow arrows.

The automatic bench return feature can be accomplished using either the stored air pressure in the accumulator 106 described above to pressurize the hydraulic cylinder 102 (which is high enough to overcome the weight of the unloaded bench pad without a user thereon), or in an alternative embodiment an extension spring mechanism, or a combination of both.

Second Operating Lever and Accumulator Option

Figure 40:
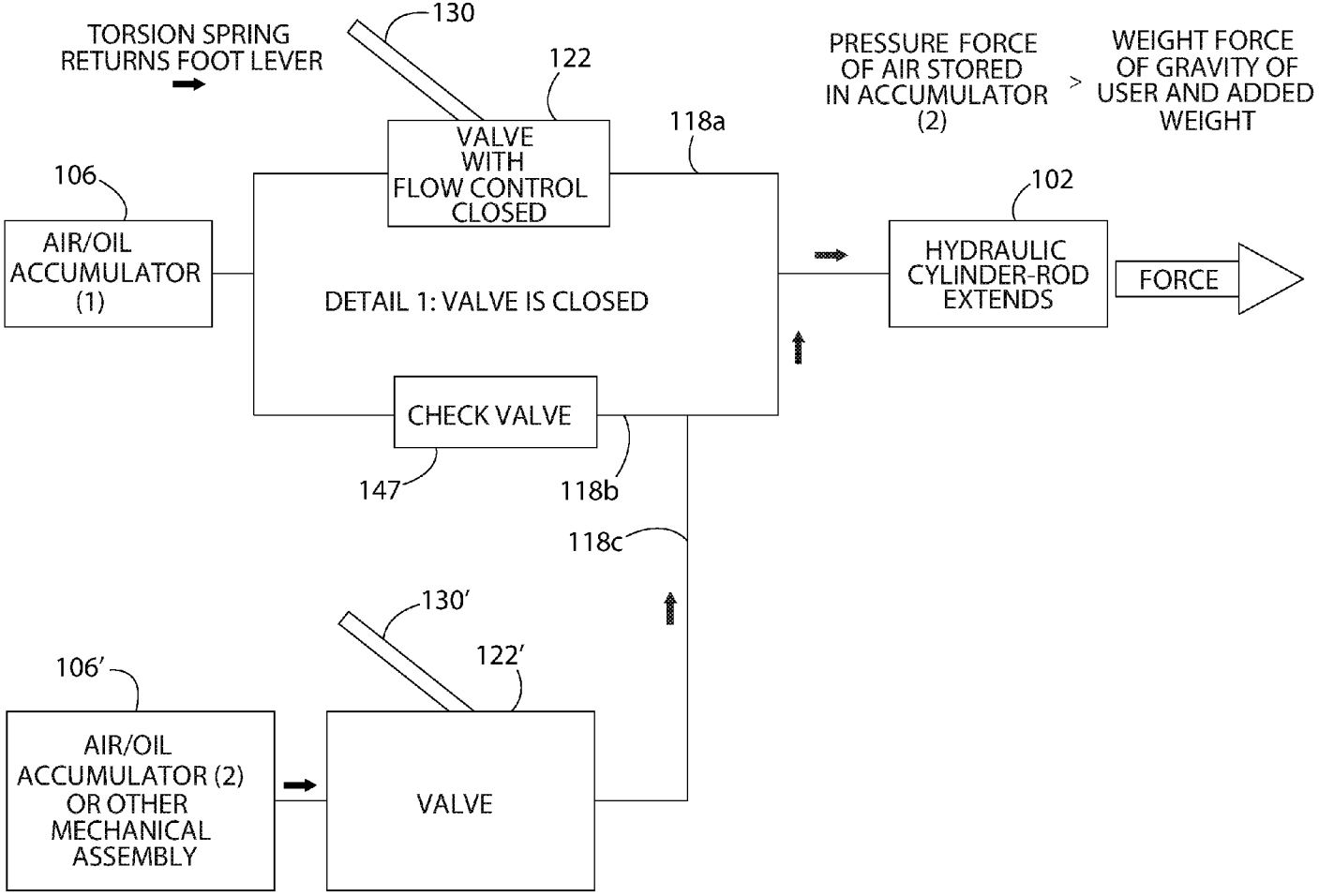
FIG. 40 is a schematic flow diagram of a modified hydraulic control system having a second accumulator and lever operated plunger valve which allows a user to adjust the upper exercise position of back pad independently of the first plunger valve and accumulator.
Figures 41, 42:
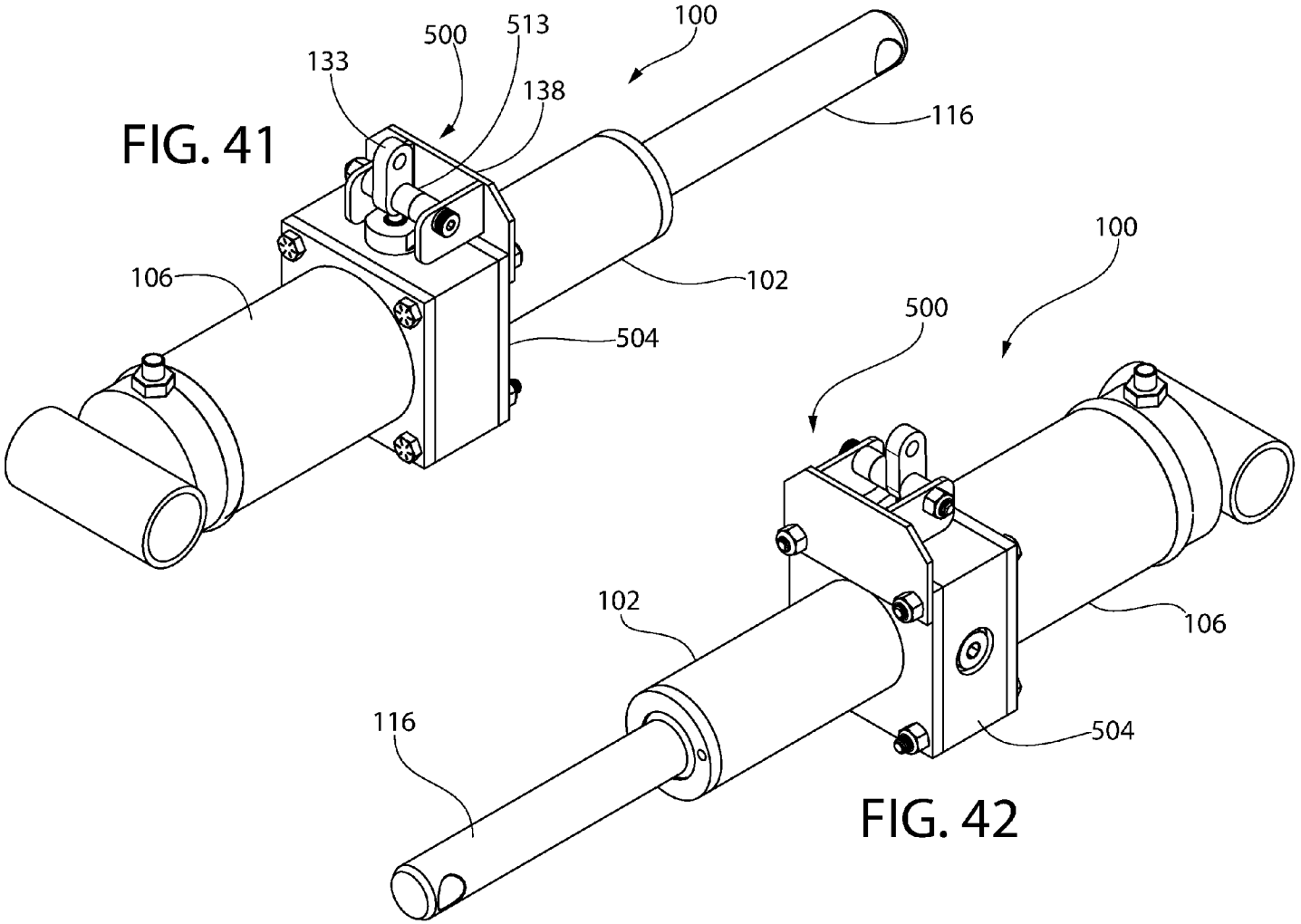
FIG. 41 is a front top perspective view of an alternative hydraulic cylinder assembly according to another embodiment including a hydraulic cylinder, accumulator, and flow control valve assembly.
FIG. 42 is a rear top perspective view thereof.
Figure 43:
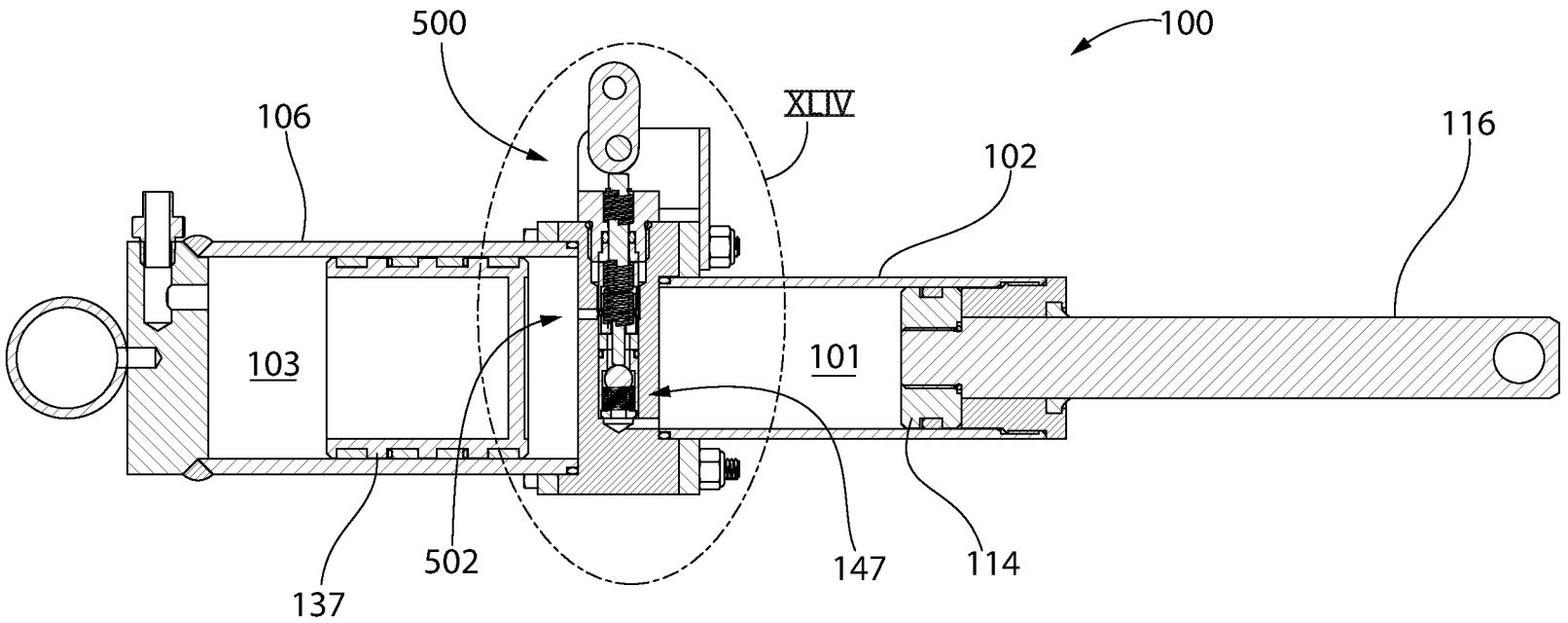
FIG. 43 is a side cross sectional view thereof.

In another embodiment shown in FIG. 40, the user can initiate the auto return of the back pad 24 by using an additional second foot or hand operating lever, plunger valve, and accumulator or another mechanical component (e.g. spring-loaded strut or piston, etc.). While the user remains on the bench pad 50, a second foot lever 130' in one embodiment can be depressed to provide a force generated from the compressed air in a second accumulator 106', or another mechanical means, to raise the bench pad 50 back upright towards its starting upper exercise position. If the angle of the bench is increased beyond that is which desired, this option provides the user ability to decrease the angle back towards the starting position. The force generated by the second accumulator, or other mechanical means, must be such that the force is greater than the weight force of gravity from the body of the user and the bench pad equipment to raise the bench pad upwards with the user seated thereon.

FIG. 40 illustrates a flow diagram of one possible configuration of a flow conduit circuit 118*c* incorporating a second hydraulic cylinder assembly including a second accumulator 106' and second plunger valve 122' with a second operating lever 130' which are fluidly connected via a suitable flow conduit (e.g. tubing and/or piping) arranged as shown. This embodiment allows the user to raise the back pad 24 while remaining pressed back against the back pad applying a pressure force to the pad. If the user while remaining reclined finds that the back pad was lowered too far, the second hydraulic cylinder assembly allows the user to raise the back pad back up to find the perfect exercise position intended.

Operating lever 130' may be a foot lever configured similarly to foot lever 130, or alternatively a hand-operated lever. Second operating lever 130' functions with the second hydraulic cylinder assembly in the same manner as the first hydraulic cylinder assembly and foot pedal 130. Flow conduit circuit 118*c* is tied into flow conduit circuit 118*b* downstream of check valve 147, but upstream of hydraulic cylinder 102 in the original hydraulic circuit. The upper flow circuits 118*a* and 118*b* with check valve 147 as shown incorporate the back pad 24 automatic return feature described herein which is initiated automatically by releasing the foot pedal 130. The lower flow circuit 118*c* is not controlled by a check valve, and therefore does not include the auto return feature requiring this flow circuit to be opened/closed by operation of the second plunger valve 122'. In this embodiment, the pressure of compressed air in the second accumulator 106' is preferably pre-pressurized to a pressure sufficient to raise the back pad against the weight force of the user, the back pad equipment, and in some embodiments also the barbell. In such a case when the second operating lever 130' would be depressed (i.e. actuated), the added weight of the barbell would cause the hydraulic fluid 101 to flow in a reverse direction through flow conduit 118*c* into the second accumulator 106', thereby automatically dropping the back pad 24 to its lower escape position as a safety precaution.

In operation, with the user seated on the seat pad 23 and reclined against the back pad, the second operating lever 130' alone is depressed and actuated which opens second plunger valve 122'. Compressed air flows from second accumulator 106' through second valve 122' and flow conduit circuit 118*c* into flow conduit 118*b* to the hydraulic cylinder 102. This extends the cylinder rod 116 thereby raising the position of the back pad 24 to the desired angle. When the position sought is reached, the operating lever 130' is released which returns automatically to its original position which shuts off flow of air from the second accumulator 106'. It may be noted that the second accumulator is pressurized to a higher pressure than the original accumulator 106 which has insufficient pressure to raise the back pad 24 against the weight force of the user and bench pad equipment and barbell. The back pad 24 may be declined to a lower exercise position or the lowermost decline escape position at any time by activating the first hydraulic cylinder assembly and original foot pedal 130 in the manner already described herein.

Power Rack and Bench Combination

FIGS. 17-20 depict a power rack 70 usable with the angularly adjustable bench 20 for performing a weight lifting exercise routine. Power rack 70 includes a longitudinal axis A-A which is alignable with longitudinal axis LA of bench 20, a base frame 72 configured for resting on a surface such as floor F, and an upper frame 75. Base frame 72 may include including a pair of laterally spaced apart longitudinal members 71 to provide room for positioning the bench 20 therebetween. A cross support 73 may be provided which extends between longitudinal members 71 as shown for lateral stability.

A pair of longitudinally spaced apart upright stanchions 74 extend upwards from each longitudinal member 71 of the base frame 72. The upper portions of the stanchions are interconnected by the upper frame 75 which provides stability for the stanchions. The upper frame 75 may comprise a plurality of elongated bracing members 78 which extend between the stanchions as illustrated in one non-limiting embodiment. The base frame longitudinal members 71, upper frame 75, and stanchions 74 may be formed by metallic tubular structural members of suitable cross sectional shape and material, such as without limitation steel, aluminum, titanium, or combinations thereof.

Figure 19:
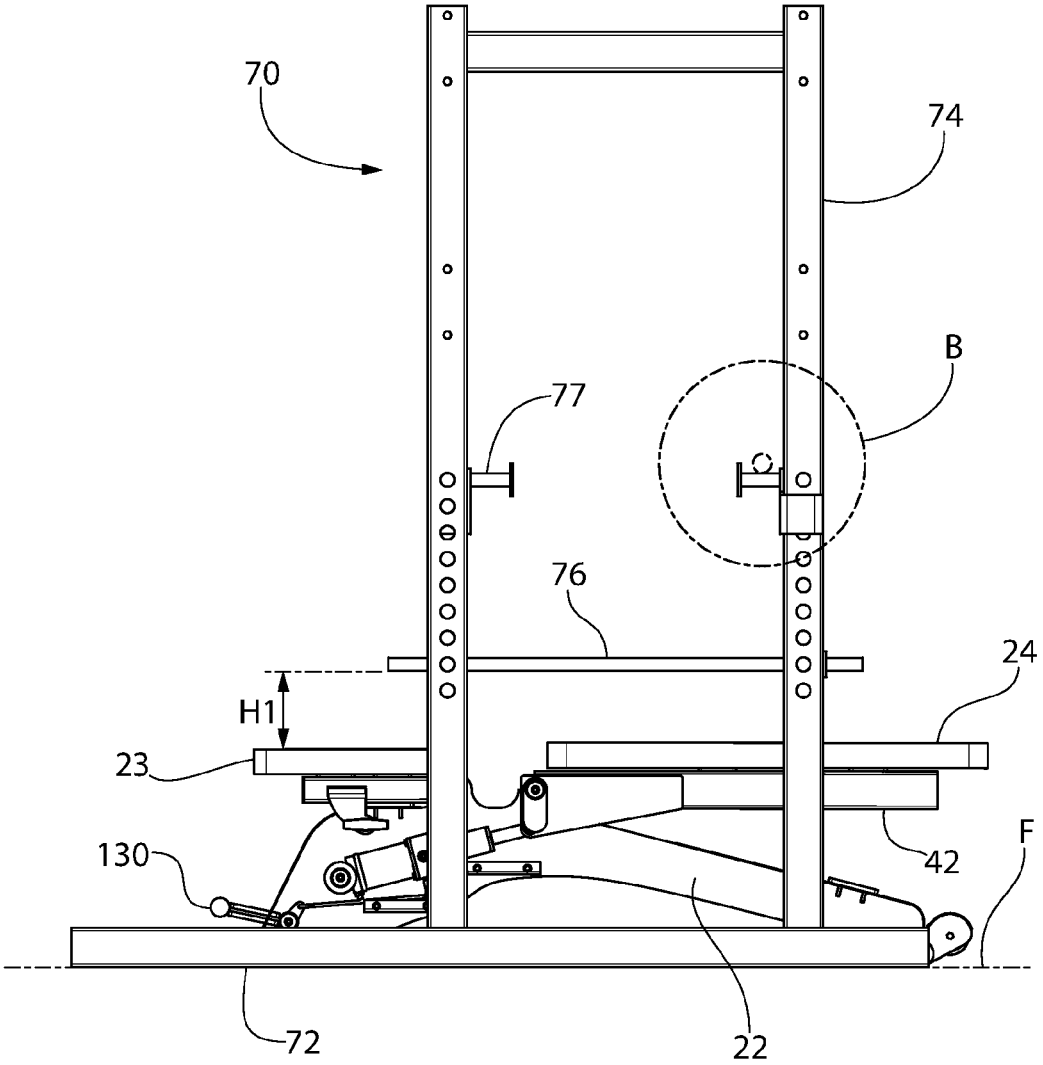
FIG. 19 is a left side view thereof with the bench of FIG. 1 positioned therein and in a horizontal position representative of an exercise position.

Power rack 70 further includes a plurality of weight rests 77 configured and constructed to support a barbell B as shown in FIG. 19. At least one pair of weight rests 77 may be provided, and in some embodiments each stanchion 74 may have a weight rest 77 as shown.

In some embodiments, power rack 70 may further include safety bars or racks 76. A safety rack 76 is provided between each pair of stanchions 74 on each side of the power rack 70. The safety racks 76 are preferably positioned to receive the barbell B when the user experiences fatigue and cannot return it safely to the weight rests 77. The safety racks 76 in combination with the adjustable bench 20 described herein provide a safety system which safely removes the barbell from a user's chest and allows egress from the bench.

Safety Rack Height Relative to Bench Position

Figure 20:
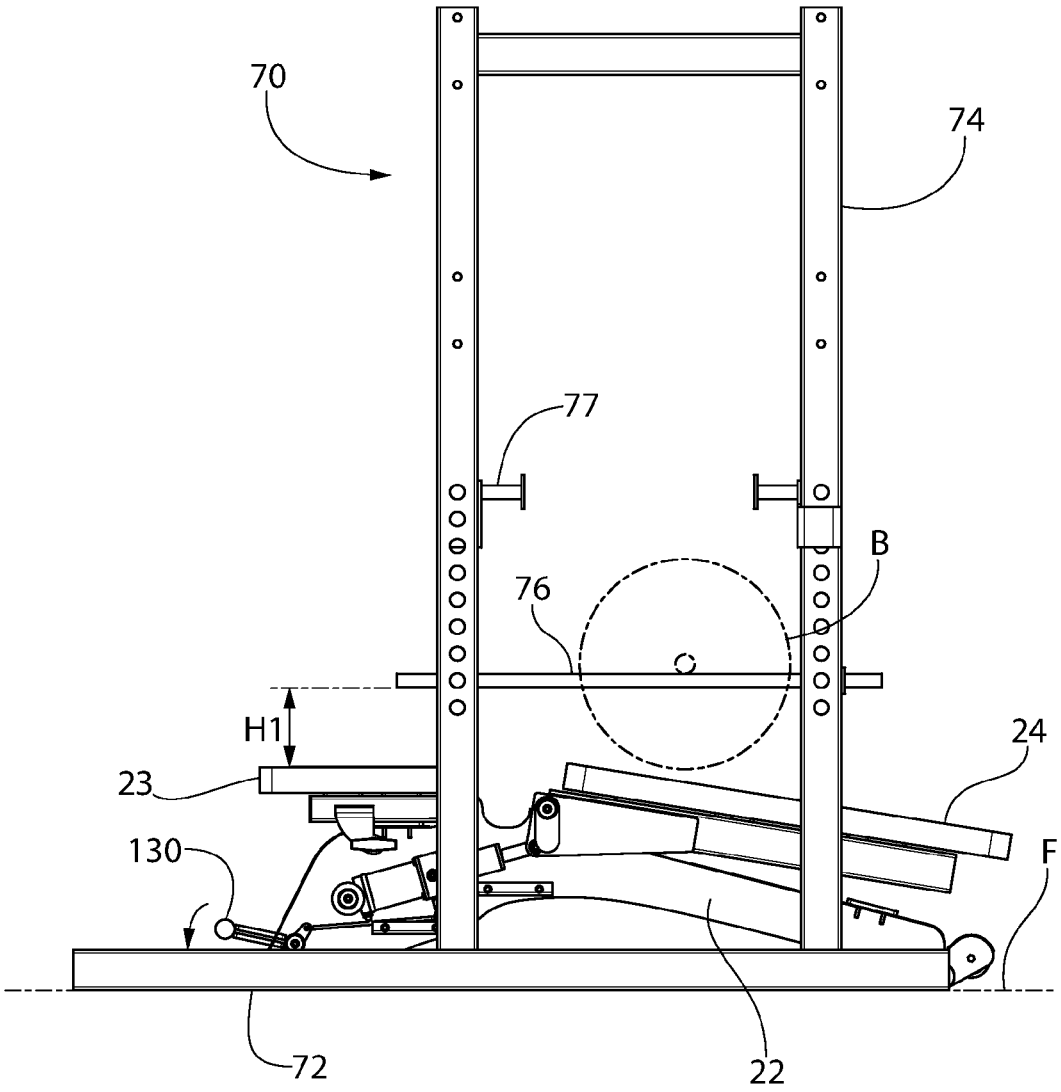
FIG. 20 is a left side view thereof with the bench of FIG. 1 positioned therein and in the lowermost decline position representative of an escape position.

It is desirable that when the back pad 24 is in the lowest decline escape position, the safety racks 76 are positioned and sufficiently elevated such that the top of the safety racks are located above the user's chest or torso region. In all instances, when the user presses the foot lever 130 and the bench pad lowers to its lower escape position shown for example in FIG. 16, the main rod or bar of the barbell B which a user grasps must rest on the safety racks 76 at a height such that the barbell and its weight are completely removed from the user's torso region (barbell shown in dashed lines). To achieve this accordingly, in the lower escape position of the back pad 24, the top surface of the safety rack 76 on which the barbells rests is positioned at a critical height H1 above the highest front part of the back pad 23 when the back pad is in the lowermost decline position as shown in FIG. 20. For contrast and reference, FIG. 19 shows the back pad 24 in a horizontal position. The critical height H1 is sufficient to vertically separate the top surface of the safety racks 28 and barbell B during an escaped scenario from the user's torso region in a manner that completely and safely removes the weight from the user to prevent injury. Preferably, the height H1 is further selected to also provide adequate clearance for the user to readily have an easy path of egress from beneath the barbell B and off of the bench.

Although in some embodiments, the height of the safety racks 28 may be adjustable, as well as the working or exercise height of the back pad 24, it remains important that when the back pad is in the lowest escape position, the safety racks 76 are positioned such that the top surface of the safety racks are still located the critical height H1 and above the users torso as shown in FIG. 20. For such instances in which the safety racks are adjustable, a safety stop is preferably positioned on the rack uprights (vertical stanchions 74) to prevent the safety racks 76 from being lowered to a position that is less than the critical height H1. In one embodiment, the safety stop may be configured as an angle bracket or clip which is welded to each of the stanchions 76 to engage the safety racks 76 and maintain the critical height H1.

Accordingly, when the back pad 24 is positioned in its lowest adjustment and escape position shown for example in FIG. 16 (represented by angle A5) and full actuation of the foot lever 130 has been implemented for an escape maneuver, the critical height H1 is still maintained. As a means of egress from beneath the barbell B when the foot lever 130 is fully depressed and the back pad 24 drops to its lowest escape position, the barbell essentially becomes an integral part of the escape system. The barbell rests on the safety racks 76 and provides a stable hold for the user to grip and slide themselves out from under the weights. The user may push the barbell against the upright stanchions 76 for this purpose. The force then applied by the user against the horizontal safety racks 76 and the stanchions 74 allows the user to push or pull themselves rearward towards the rear end 27 of the bench, and safely up and off the equipment to escape from underneath the barbell.

It bears further noting that the bench 20 disclosed herein which may include the back pad descent speed control and auto-return mechanisms may be provided independently of any weight lifting frame with weight rests. Accordingly, the invention is expressly not necessarily limited to the presence of the weight lifting frame in order to possess full functionality and the various features associated with the bench pad assembly described herein.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An adjustable weight lifting bench comprising:

a bench frame configured for resting on a surface, the frame defining a horizontal longitudinal axis parallel to the surface and a vertical axis;

a seat pad coupled to the frame;

a back pad pivotably coupled to the frame about a first pivot axis defined at an orthogonal intersection between the longitudinal axis and the vertical axis, the back pad angularly adjustable relative to the frame between a plurality of user-selectable incline and decline positions;

a hydraulic cylinder mechanism operably coupled between the frame and back pad that supports the back pad in the incline and decline positions, the hydraulic cylinder mechanism changeable between an activated condition in which the back pad is movable between the incline and decline positions, and a deactivated condition in which the back pad is locked into a selected one of the incline and decline positions; and an operating lever operably coupled to the hydraulic cylinder mechanism, the operating lever movable to change position of the hydraulic cylinder mechanism between the activated and deactivated conditions;

wherein the hydraulic cylinder mechanism is operable such that: (i) when the hydraulic cylinder mechanism is placed in the activated condition via a first position of the operating lever and a user applies a pressing force against the back pad, the back pad pivots in a downward direction from the incline positions towards the decline positions, and (ii) when the hydraulic cylinder mechanism is in the deactivated condition via a second position of the operating lever, the back pad locks in the selected one of the incline and decline positions;

wherein the hydraulic cylinder mechanism is further operable such that when the hydraulic cylinder mechanism is in the activated condition with the operating lever in the first position and the pressing force is removed from the back pad, the hydraulic cylinder mechanism automatically pivots the back pad in an upward direction from the selected one of the incline and decline positions.

2. The weight lifting bench according to claim 1, wherein the hydraulic cylinder mechanism comprises:

a hydraulic cylinder comprising a piston, an extendable-retractable cylinder rod attached thereto, and a hydraulic fluid; and an accumulator containing a compressible liquid and in fluid communication with the hydraulic cylinder through a flow control valve interposed in a flow path between the hydraulic cylinder and the accumulator, the flow control valve having open and closed positions, the flow control valve when open operable to move the bench pad between the incline and decline positions.

3. The weight lifting bench according to claim 2, wherein the flow control valve includes a flow modulation device that regulates flow of the hydraulic fluid exchanged between the hydraulic cylinder and accumulator, the flow modulation device axially movable in a reciprocating manner between a closed axial position preventing exchange of hydraulic fluid and an open axial position allowing exchange of hydraulic fluid.

4. The weight lifting bench according to claim 3, wherein when the flow control valve is in the open position, the flow modulation device automatically regulates flow of the working fluid from the hydraulic cylinder to the accumulator in a manner which limits lowering of the back pad to a predetermined maximum descent rate independently of a weight load applied to the back pad by the user.

5. The weight lifting bench according to claim 2, wherein the operating lever comprises a pivotable foot pedal with mechanical linkage coupled to the flow control valve, the foot pedal pivotably movable and operable to open and close the flow control valve.

6. The weight lifting bench according to claim 2, wherein the frame comprises a pair of longitudinally-extending lateral sides which define an internal cavity therebetween, the hydraulic cylinder disposed in the cavity and at least partially concealed from view.

7. The weight lifting bench according to claim 1, wherein the operating lever is a pivotable foot pedal with mechanical linkage operably coupled to the hydraulic cylinder mechanism, the foot pedal movable in opposing downwards and upwards directions by the user for activating or deactivating the hydraulic cylinder mechanism thereby providing hands free adjustment of the back pad position.

8. The weight lifting bench according to claim 1, wherein the first pivot axis is located proximate to a top of the frame, the back pad being positioned at least partially above the longitudinal axis when in the incline positions and at least partially below the longitudinal axis when in the decline positions.

9. The weight lifting bench according to claim 1, wherein the operating lever is a foot pedal comprising a T-shaped bar arranged on the frame for ambidextrous operation by a right or left foot of the user to operate the hydraulic cylinder mechanism.

10. The weight lifting bench according to claim 1, wherein the hydraulic cylinder mechanism comprises:

a hydraulic cylinder comprising a piston, an extendable-retractable cylinder rod attached thereto, and a hydraulic fluid; and an accumulator containing a compressible liquid and in fluid communication with the hydraulic cylinder through a flow control valve interposed in a flow path between the hydraulic cylinder and the accumulator, the flow control valve having open and closed positions, the flow control valve when open operable to move the bench pad between the incline and decline positions;

wherein the flow control valve includes a shutoff valve having open and closed positions, and a pressure compensating valve, the pressure compensating valve operating to automatically regulate flow of the hydraulic fluid from the hydraulic cylinder to the accumulator in a manner which limits lowering of the back pad to a predetermined maximum descent rate independently of a weight load applied against the back pad by the user.

11. The weight lifting bench according to claim 1, wherein the back pad is attached to an elongated rear strut having a lower end pivotably coupled to the frame at the first pivot axis, the rear strut positionable above and below the seat pad.

12. The weight lifting bench according to claim 1, wherein the seat pad is pivotably coupled to the frame about a second pivot axis, the seat pad being angularly adjustable between a plurality of angular positions relative to the frame.

13. The weight lifting bench according to claim 1, wherein the hydraulic cylinder mechanism comprises:

a hydraulic cylinder comprising a piston, an extendable-retractable cylinder rod attached thereto, and a hydraulic fluid; and an accumulator containing a compressible liquid and in fluid communication with the hydraulic cylinder through a flow control valve interposed in a flow path between the hydraulic cylinder and the accumulator, the flow control valve having open and closed positions, the flow control valve when open operable to move the bench pad between the incline and decline positions;

wherein the frame comprises a pair of longitudinally-extending lateral sides which define an internal cavity therebetween, the hydraulic cylinder disposed in the cavity and at least partially concealed from view;

wherein the back pad is adjustable and lockable within a range of angles between 90 and −90 degrees measured relative to the longitudinal axis about the first pivot axis between the top of the frame and the back pad.

14. A hands free adjustable weight lifting bench comprising:

a bench frame comprising a longitudinal axis, a bottom configured for resting on a surface, and a top spaced above the bottom;

a seat pad coupled to the frame;

a back pad pivotably coupled to the frame about a first pivot axis, the back pad angularly movable between an uppermost position, a lowermost position, and a continuum of intermediate positions therebetween;

a hydraulic cylinder assembly operable to support and move the back pad;

the hydraulic cylinder assembly including a hydraulic cylinder comprising an extendable-retractable cylinder rod pivotably coupled to the back pad and containing a hydraulic fluid, an accumulator pivotably coupled to the frame and containing a compressible liquid, and a flow control valve fluidly connected between the hydraulic cylinder and the accumulator for exchange of hydraulic fluid therebetween;

the valve having an open position allowing exchange of hydraulic fluid between the hydraulic cylinder and accumulator and concomitant retraction or extension of the cylinder rod, and a closed position blocking the exchange of hydraulic fluid and retraction or extension of the cylinder rod;

a foot-operated lever operably coupled to the valve and movable to change the valve between the open and closed positions;

wherein depressing the lever opens the valve and allows movement of the back pad to a selected one of the back pad positions by retracting or extending the cylinder rod, and releasing the lever closes the valve and prevents movement of the back pad;

wherein moving the valve to the open position via the lever and a user applying a pressing force against the back pad pivots the back pad in a downward direction from the uppermost position towards the lowermost position, and moving the valve to the closed position via the lever locks the back pad in the selected one of the positions;

wherein moving the valve to the open position via the lever and removing the pressing force from the back pad causes the back pad to automatically return in an upward direction from the selected one of the back pad positions towards the uppermost position.

15. The weight lifting bench according to claim 14, wherein the flow control valve includes a flow modulation device that regulates flow of the working fluid exchanged between the hydraulic cylinder and accumulator, the flow modulation device axially movable in a reciprocating manner between a closed axial position preventing exchange of hydraulic fluid and an open axial position allowing exchange of working fluid.

16. The weight lifting bench according to claim 14, wherein the flow control valve includes a flow modulation device that regulates flow of the working fluid exchanged between the hydraulic cylinder and accumulator, the flow modulation device axially movable in a reciprocating manner between a closed axial position preventing exchange of hydraulic fluid and an open axial position allowing exchange of working fluid;

wherein when the flow control valve is in the open position, the flow modulation device automatically regulates flow of the working fluid from the hydraulic cylinder to the accumulator in a manner which limits lowering of the back pad to a predetermined maximum descent rate independently of a weight load applied to the back pad by the user.

17. A method for operating an adjustable weight lifting bench, the method comprising:

providing the weight lifting bench according to claim 14;

a user sitting on the seat pad;

depressing the foot-operated lever a first time;

applying pressure against the back pad;

the back pad moving downward from the uppermost position to a first intermediate position;

releasing the foot-operated lever which locks the back pad into the first intermediate position;

depressing the foot-operator lever a second time;

applying pressure against the back pad;

the back pad moving downward from the uppermost position to a second intermediate position lower than the first intermediate position;

releasing the foot-operated lever which locks the back pad into the second intermediate position;

depressing the foot-operated lever a third time; and removing pressure from the back pad, the back pad automatically moving upward from the second intermediate position to the uppermost position.

18. A hands free adjustable weight lifting bench comprising:

a bench frame comprising a longitudinal axis, a bottom configured for resting on a surface, and a top spaced above the bottom;

a seat pad coupled to the frame;

a back pad pivotably coupled to the frame about a first pivot axis, the back pad angularly movable between an uppermost position, a lowermost position, and a continuum of intermediate positions therebetween;

a hydraulic cylinder assembly operable to support and move the back pad;

the hydraulic cylinder assembly including a hydraulic cylinder comprising an extendable-retractable cylinder rod pivotably coupled to the back pad and containing a hydraulic fluid, an accumulator pivotably coupled to the frame and containing a compressible liquid, and a flow control valve fluidly connected between the hydraulic cylinder and the accumulator for exchange of hydraulic fluid therebetween;

the valve having an open position allowing exchange of hydraulic fluid between the hydraulic cylinder and accumulator and concomitant retraction or extension of the cylinder rod, and a closed position blocking the exchange of hydraulic fluid and retraction or extension of the cylinder rod;

a foot-operated lever operably coupled to the valve and movable to change the valve between the open and closed positions;

wherein depressing the lever opens the valve and allows movement of the back pad to a selected one of the back pad positions by retracting or extending the cylinder rod, and releasing the lever closes the valve and prevents movement of the back pad;

wherein the flow control valve includes a shutoff valve having the open and closed positions, and a pressure compensating valve, the pressure compensating valve operating to automatically regulate flow of the hydraulic fluid from the hydraulic cylinder to the accumulator in a manner which limits lowering of the back pad to a predetermined maximum descent rate independently of a weight load applied against the back pad by a user.

* * * * *